US008498863B2

(12) United States Patent
Wang et al.

(10) Patent No.: US 8,498,863 B2
(45) Date of Patent: Jul. 30, 2013

(54) METHOD AND APPARATUS FOR AUDIO SOURCE SEPARATION

(75) Inventors: Tianyu Wang, Roswell, GA (US); Thomas F. Quatieri, Jr., Newtonville, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 261 days.

(21) Appl. No.: 12/875,950

(22) Filed: Sep. 3, 2010

(65) Prior Publication Data

US 2011/0282658 A1 Nov. 17, 2011

Related U.S. Application Data

(60) Provisional application No. 61/240,062, filed on Sep. 4, 2009.

(51) Int. Cl.
*G10L 21/02* (2006.01)

(52) U.S. Cl.
USPC ..... 704/226; 704/200; 704/500

(58) Field of Classification Search
USPC ..... 704/200–230
See application file for complete search history.

(56) References Cited

U.S. PATENT DOCUMENTS

| | | | | |
|---|---|---|---|---|
| 7,797,154 | B2 * | 9/2010 | Ichikawa | 704/226 |
| 2004/0054527 | A1 * | 3/2004 | Quatieri, Jr. | 704/207 |
| 2009/0268962 | A1 * | 10/2009 | Fearon et al. | 382/168 |
| 2009/0271182 | A1 * | 10/2009 | Athineos et al. | 704/205 |

OTHER PUBLICATIONS

Shamma, S.A., "Joint Acoustic and Modulation Frequency," *EURASIP Journal on Applied Signal Processing*, 7: 668-675 (2003).
Barker, J., et al., "Recent advances in speech fragment decoding techniques," *Interspeech 2006 Speech Recognition/Separation Challenge*, [online] 2003, [retrieved on May 10, 2010]. Retrieved from the Internet URL: http://www.aapsj.org/view.asp?art=ps050107.
Hershey, J.R., et al., "Super-human multi-talker speech recognition: A graphical modeling approach," *Computer Speech and Language*, 24: 45-66 (2010).

(Continued)

*Primary Examiner* — Douglas Godbold
(74) *Attorney, Agent, or Firm* — Hamilton, Brook, Smith & Reynolds, P.C.

(57) ABSTRACT

The present invention relates to co-channel audio source separation. In one embodiment a first frequency-related representation of plural regions of the acoustic signal is prepared over time, and a two-dimensional transform of plural two-dimensional localized regions of the first frequency-related representation, each less than an entire frequency range of the first frequency related representation, is obtained to provide a two-dimensional compressed frequency-related representation with respect to each two dimensional localized region. For each of the plural regions, at least one pitch is identified. The pitch from the plural regions is processed to provide multiple pitch estimates over time. In another embodiment, a mixed acoustic signal is processed by localizing multiple time-frequency regions of a spectrogram of the mixed acoustic signal to obtain one or more acoustic properties. A separate pitch estimate of each of the multiple acoustic signals at a time point are provided by combining the one or more acoustic properties. At least one of the multiple acoustic signals is recovered using the separate pitch estimates.

36 Claims, 42 Drawing Sheets

OTHER PUBLICATIONS

Gunawan, D., et al., "Spectro-Temporal Modeling of Harmonic Magnitude Tracks for Music Source Separation," *Multimedia Signal Processing, 2009. MMSP '09. IEEE International Workshop on Multimedia Signal Processing*, [online] 2009, [retrieved on May 3, 2010] Retrieved from the Internet URL: http://ieeexplore.ieee.org/xpl/freeabs_all.jsp?arnumber=5293318.

Vishnubhotla, S., et al., "An Algorithm for Speech Segregation of Co-channel Speech," *Proceedings of the 2009 IEEE International Conference on Acoustics, Speech and Signal Processing*, pp. 109-112 (2009).

Coy, A., et al., "An automatic speech recognition system based on the scene analysis account of auditory perception," *Speech Communication*, 49: 384-401 (2007).

Schmidt, M.N., et al., "Nonnegative Matrix Factor 2-D Deconvolution for Blind Single Channel Source Separation," *Proceedings of the 6th International Symposium on Independent Component Analysis and Blind Signal Separation* (2006).

Mesgarani, N., et al., "Speech Enhancement Based on Filtering the Spectrotemporal Modulations," *IEEE International Conference on Acoustics, Speech and Signal Processing*, 1: 1105-1108 (ICASSP 2005).

Shashanka, M.V.S., et al., "Sparse overcomplete Decomposition for Single Channel Speaker Separation," *IEEE International Conference on Acoustics, Speech and Signal Processing*, 2: II-641-II-644 (ICASSP 2007).

Heming, Z., et al., "Co-channel speech separation based on sinusoidal model for speech," *IEEE 5th International Conference on Signal Processing*, 2: 815-818 (WCCC-ICSP 2000).

Chi, T., et al., "Multiresolution spectrotemporal analysis of complex sounds," *J. Acoust. Soc. Am.*, 118(2): 887-906 (Aug. 2005).

Lin, Z., "Speech Quality Enhancement in High Noise Environments." Unpublished master's thesis, Carleton University, Ottawa Ontario, Canada (Aug. 2003).

Deshmukh, O.D., et al., "Modified Phase Opponency Based Solution to the Speech Separation Challenge," Proceedings of *Interspeech 2006*, Pittsburgh, USA.

Every, M.R., et al., "Enhancement of harmonic content of speech based on a dynamic programming pitch tracking algorithm," Proceedings of *Interspeech 2006*, Pittsburgh, USA.

Runqiang, H., et al., "CASA Based Speech Separation for Robust Speech Recognition," Proceedings of *Interspeech 2006*, Pittsburgh, USA.

Kristjansson, T., et al., "Super-Human Multi-Talker Speech Recognition: The IBM 2006 Speech Separation Challenge System," Proceedings of *Interspeech 2006*, Pittsburgh, USA.

Ming, J., et al., "Combining missing-feature theory, speech enhancement, and speaker-dependent/ -independent modeling for speech separation," *Computer Speech and Language*, 24: 67-76 (2010).

Virtanen, T., "Speech Recognition Using Factorial Hidden Markov Models for Separation in the Feature Space," Proceedings of *Interspeech 2006*, Pittsburgh, USA.

Srinivasan, S., et al., "A Computational Auditory Scene Analysis System for Robust Speech Recognition," To appear in *Proc. Interspeech 2006*, Sep. 17-21, Pittsburg, USA.

Schmidt, M.N., et al., "Single-Channel Speech Separation using Sparse Non-Negative Matrix Factorization," [online] [retrieved on Sep. 2, 2010]. Retrieved from the Internet URL: http://eprints.pascal-network.org/archive/00002722/01/imm4511_01.pdf.

Quatieri, T.F., et al., "An Approach to Co-Channel Talker Interference Suppression Using a Sinusoidal Model for Speech," IEEE Transactions on Acoustics, Speech and Signal Processing, 38(1): 56-69 (Jan. 1990).

Wang, T. and Quatieri, T., "Towards Co-Channel Speaker Separation by 2-D Demodulation of Spectrograms", *IEEE Workshop on Applications of Signal Processing to Audio and Acoustics*, New Paltz, NY: 65-68 (2009).

Notification of Transmittal of the International Search Report and the Written Opinion of the International Searching Authority for PCT/US2010/047888. Date Mailed: Feb. 25, 2011.

Wang, T. and Quatieri, T., "2-D Processing og Speech for Multi-Pitch Analysis," Proceedings of *Interspeech Sep. 6-10, 2009*, Brighton, UK.

* cited by examiner

500

| | Single Speaker Filtering | Single Speaker Demod. | Mixed Speaker SBSS | Mixed Speaker Demod. | Mixed Speaker TruePhase |
|---|---|---|---|---|---|
| SNR (dB) | 11.24 | 12.51 | 3.62 | 4.09 | 5.96 |

FIG. 5

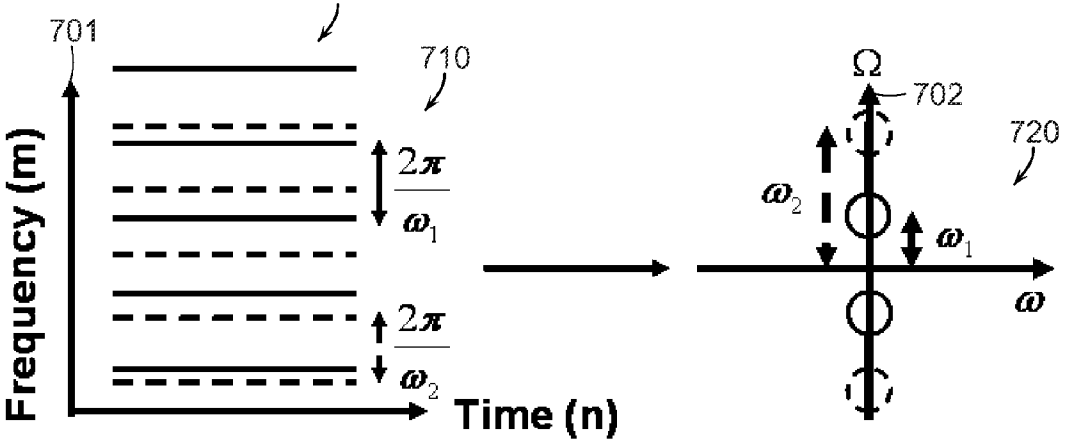
FIG. 7A
FIG. 7B
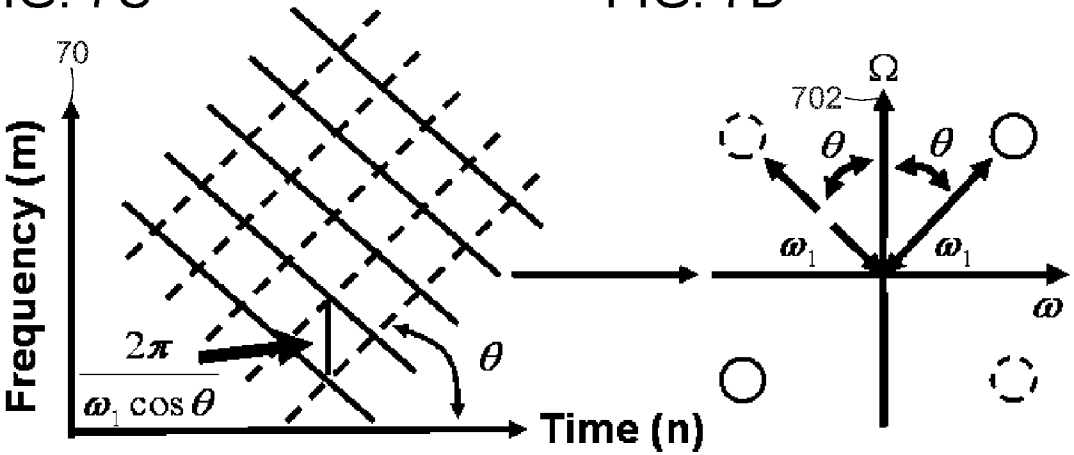
FIG. 7C
FIG. 7D

× clustering
□ single-region
— truth

| | Syn1 | Syn2 | Syn3 | Syn4 | Real1 | Real2 |
|---|---|---|---|---|---|---|
| oracle | 0.00 | 0.00 | 0.03 | 0.00 | 0.00 | 0.00 |
| clustering | 1.74 | 1.44 | 1.00 | 1.08 | 5.46 | 7.91 |
| single | 5.98 | 14.97 | 13.24 | 9.13 | 42.18 | 20.13 |

Average percent errors across time for each mixture and method

FIG. 13

| | Avg. E_gross 2410 | Avg. E_fine 2420 | Avg. E_total 2430 |
|---|---|---|---|
| Pruned 2440 | 14.83 | 6.70 | 21.53 |
| Raw 2450 | 13.26 | 6.45 | 19.71 |

2500

| | Avg. E_gross 2510 | Avg. E_fine 2520 | Avg. E_total 2530 |
|---|---|---|---|
| Pruned 2540 | 5.58 | 7.04 | 12.62 |
| Raw 2550 | 13.29 | 7.74 | 21.03 |

| Size/Signal | Synth1 | Synth2 | Synth3 | Synth4 |
|---|---|---|---|---|
| 20 ms by 625 Hz | 6.95 | 4.66 | 7.40 | 16.37 |
| 42 ms by 625 Hz | 6.60 | 4.76 | 6.02 | 3.86 |
| 20 ms by 687.5 Hz | 6.60 | 4.55 | 7.45 | 16.78 |
| 20 ms by 812.5 Hz | 6.58 | 4.31 | 6.91 | 18.86 |
FIG. 28
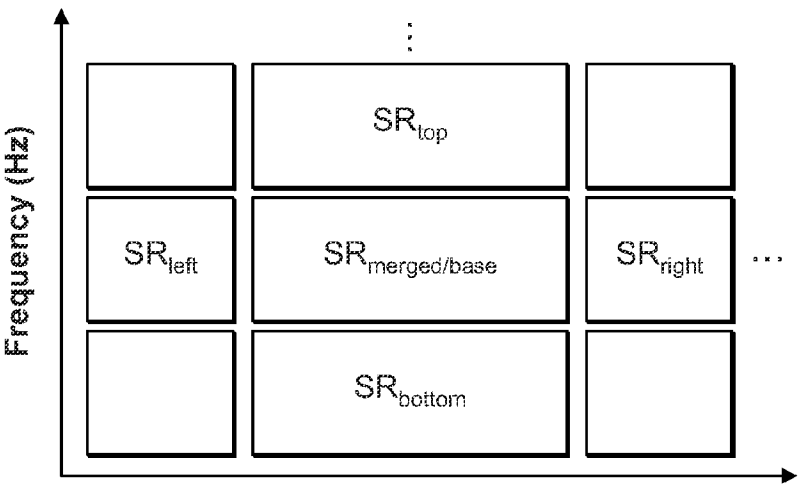
FIG. 29B
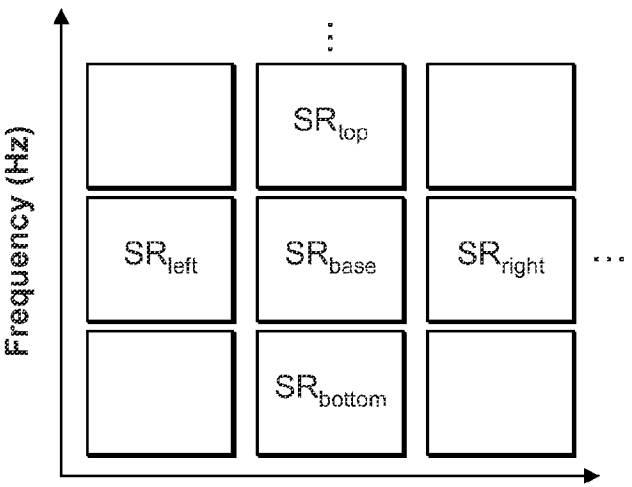
FIG. 29A

METHOD AND APPARATUS FOR AUDIO SOURCE SEPARATION

RELATED APPLICATION

This application claims the benefit of U.S. Provisional Application No. 61/240,062, filed on Sep. 4, 2009. The entire teachings of the above application are incorporated herein by reference.

GOVERNMENT SUPPORT

The invention was supported, in whole or in part, by a grant FA 8721-05-C-0002 from the United States Air Force. The Government has certain rights in the invention.

BACKGROUND

Co-channel audio source separation is a challenging task in audio processing. For audio sources exhibiting acoustic properties, such as pitch, current methods operate on short-time frames of mixture signals (e.g., harmonic suppression, sinusoidal analysis, modulation spectrum [1-3]) or on single units of a time-frequency distribution (e.g., binary masking [4]).

Estimating the pitch values of concurrent sounds from a single recording is a fundamental challenge in audio processing. Typical approaches involve processing of short-time and band-pass signal components along single time or frequency dimensions [12].

The Grating Compression Transform (GCT) has been explored [5-8] primarily for single-source analysis and is consistent with physiological modeling studies implicating 2-D analysis of sounds by auditory cortex neurons [9]. Ezzat et al. performed analysis and synthesis of a single speaker as the source using two-dimensional (2-D) demodulation of the spectrogram [7]. In [8], an alternative 2-D modulation model for format analysis was proposed. Phenomenological observations in [5, 6] also suggest that the GCT invokes separability of multiple sources.

In [10], the GCT's ability in analysis of multi-pitch signals is demonstrated. Finally, U.S. Pat. No. 7,574,352 to Thomas F. Quatieri, Jr., the teachings of which are incorporated by reference in its entirety, relates to determining pitch estimates of voiced speech [13].

FIG. 1A illustrates schematic diagrams of 2-D frequency-related representation and compressed frequency-related representations as described in [13]. FIG. 1A demonstrates an acoustic signal waveform 104. In order to obtain pitch estimates, a first frequency-related representation of the acoustic signal is obtained over time 106. A 2-D compressed frequency-related representation 108 is then obtained by performing a 2-D transform 107 on the first frequency-related representation 106 with respect to a localized portion 110. The localized portions 110 are illustrated as windows. Each window 110 includes a frequency range that is substantially less than the frequency range of the first representation. The compressed frequency related representations 108 that result from taking a two dimensional transform of the localized portions 110 correspond to respective windows 110 in the frequency-related representation of the original waveform (shown by arrows connecting each compressed frequency-related representation to its corresponding window).

FIG. 1B is a flow diagram of the process of speaker separation described in [13]. A frequency-related representation 105 of an acoustic signal 104 is determined. This may be done in a spectrogram. The spectrogram provides a first frequency-related representation of the acoustic signal is obtained over time. Subsequently, 2-D transform 107, such as a 2-D GCT transform, is performed on the first frequency-related representation 106 with respect to localized portions. The resulting signal 108 is processed 109 to produce a speaker separated speech signal 129. Specifically, the GCT is analyzed to find a location with a maximum value and the distance from the GCT origin to the maximum value is determined 125. The reciprocal of the distance 126 is computed to produce a pitch estimate 127. The pitch estimate is then used 208 to produce a speaker separated speech signal 129.

SUMMARY

Certain example embodiments of the present invention relate to processing an acoustic signal using a first frequency-related representation of an acoustic signal prepared over time and computing a two-dimensional transform of plural two-dimensional localized regions of the first frequency-related representation, each less than an entire frequency range of the first frequency related representation, to provide a two-dimensional compressed frequency-related representation with respect to each two dimensional localized region. At least one pitch for each of the plural regions is identified. The identified pitch from the plural regions is processed to provide multiple pitch estimates over time.

On the same or alternative embodiments, a mixed acoustic signal including multiple acoustic signals may be processed. Multiple time-frequency regions of a spectrogram of the mixed acoustic signal are localized to obtain pitch candidates and provide separate pitch estimates of each of the multiple acoustic signals as a function of combining the pitch candidates. The multiple time-frequency regions may be of predetermined fixed or variable sizes. At least one of the multiple acoustic signals is recovered as a function of the separate pitch estimate.

The acoustic signal may be any audio source or a mixture of sources. For example, the acoustic signal may be a pitch-based audio source or a mixture of sources. The acoustic signal may be a speech signal. The speech signal may include a plurality of speech signals from independent speech signal sources. The two-dimensional transform may be a two-dimensional Fourier Transform.

The example embodiments may identify acoustic properties corresponding to the at least one pitch for each of the plural regions and provide the multiple pitch estimates as a function of processing the acoustic properties (e.g., pitch and the pitch dynamics). The at least one pitch may be represented as a function of a vertical distance of a representation of the at least one pitch from an origin of a frequency-related region. The frequency related region may be a Grating Compression Transform region. The at least one pitch may be represented as a function of a vertical distance and a radial angle of a representation of the at least one pitch from an origin of a frequency-related region. The near DC components of the two-dimensional compressed frequency-related representation may be removed.

The example embodiments may identify at least one pitch for each localized time-frequency region of the spectrogram. Individual acoustic signal contents may be demodulated using pitch information to recover information corresponding to an individual acoustic signal. The recovered information of the localized regions may be combined and used to reconstruct the at least one of the multiple acoustic signals.

A sinusoidal demodulation scheme may be used to demodulate individual speaker contents.

Certain example embodiments may be employed in processing and source separation of an acoustic signal. The acoustic signal may include multiple signals from a variety of independent sources. The acoustic signal may include multiple audio signals, multiple sounds, multiple speech signals, a mixture of speech and unvoiced acoustic signals, voiced and/or unvoiced signals combined with noise, multiple unvoiced speech signals, and etc.

Certain embodiments of the present invention relate to processing a mixed acoustic signal including multiple signals. The example embodiments localize multiple time-frequency regions of a spectrogram of the mixed acoustic signal to obtain one or more acoustic properties of the mixed signal and provide a separate pitch estimate of each of the multiple signals as a function of combining the one or more acoustic properties. At least one of the multiple acoustic signals is recovered based on the separate pitch estimate.

The multiple signals may include two or more unvoiced signals, two or more voiced signals, one or more unvoiced signal and a noise signal, and/or one or more voiced signal and a noise signal.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 1C(b) illustrates localized region of FIG. 1C(a) with harmonic structure and envelope.

FIG. 1C(c) illustrates GCT of the schematic shown in FIG. 1C(a) with baseband and modulated versions of the envelope.

FIG. 1C(d) illustrates demodulation performed to recover near-DC terms.

FIG. 5 is a table that includes average signal-to-noise ratios (SNR) of the original and reconstructed waveforms shown in FIGS. 3 and 4.

FIG. 7*a* includes a plot that relate to a localized region with two distinct pitch values with no temporal change.

FIG. 7*b* illustrates GCT corresponding to the schematic shown in FIG. 7*a* with separability occurring along the Ω-axis.

FIG. 7*c* illustrates localized region with two pitch candidates with the same pitch value but different temporal dynamics.

FIG. 7*d* illustrates GCT corresponding to the schematic shown in FIG. 7*c*, with separability occurring from difference in temporal dynamics.

FIG. 10 demonstrate estimates for the synthetic mixtures including concurrent vowel pitch estimates, clustering, single, and true pitch values.

FIG. 11 demonstrates estimates for real speech mixture with no crossing pitch tracks.

In FIG. 12*c* a "jump" due to differences in energy between sources in localized time-frequency regions is illustrated.

FIG. 13 is a table that includes average errors for examples studied in FIGS. 10-12.

FIG. 17 demonstrates the GCT computed for a region in which the formant structure of one speaker in the mixture exhibits a formant peak.

FIG. 18 demonstrates the GCT computed for a region in which the formant structures of both speakers in the mixture exhibit formant valleys.

FIG. 28 is a table that outlines the SNR value for all four signals shown in FIG. 27A-27D across four distinct regions sizes.

FIG. 29A illustrates the result of base tiling showing base region and its neighbors.

FIG. 29B illustrates schematic of base region grown from (a) and its new neighbors.

DETAILED DESCRIPTION

The teachings of all patents, published applications and references cited herein are incorporated by reference in their entirety.

Certain example embodiments of the present invention address multi-pitch estimation and speaker separation using a two-dimensional (2-D) processing framework of a mixture signal. For the speaker separation task, one example embodiment of the present invention relates to a method and corresponding apparatus for two-dimensional (2-D) processing approach for co-channel speaker separation of voiced speech. Localized time-frequency regions of a narrowband spectrogram may be analyzed using 2-D Fourier transforms to determine a 2-D amplitude modulation model based on pitch information for single and multi-speaker content in each region. Harmonically-related speech content may be mapped to concentrated entities in a transformed 2-D space, thereby motivating 2-D demodulation of the spectrogram for analysis/synthesis and speaker separation. Using a priori pitch estimates of individual speakers, the example embodiment determines through a quantitative evaluation: 1) utility of the model for representing speech content of a single speaker and 2) its feasibility for speaker separation. Localized time-frequency regions of a narrowband spectrogram may be analyzed using 2-D Fourier transforms. This representation is also referred to as the Grating Compression Transform (GCT).

Speaker Separation Using a Priori Pitch Estimates of Individual Audio Sources

Single-Speaker Modeling

Figure 1A:
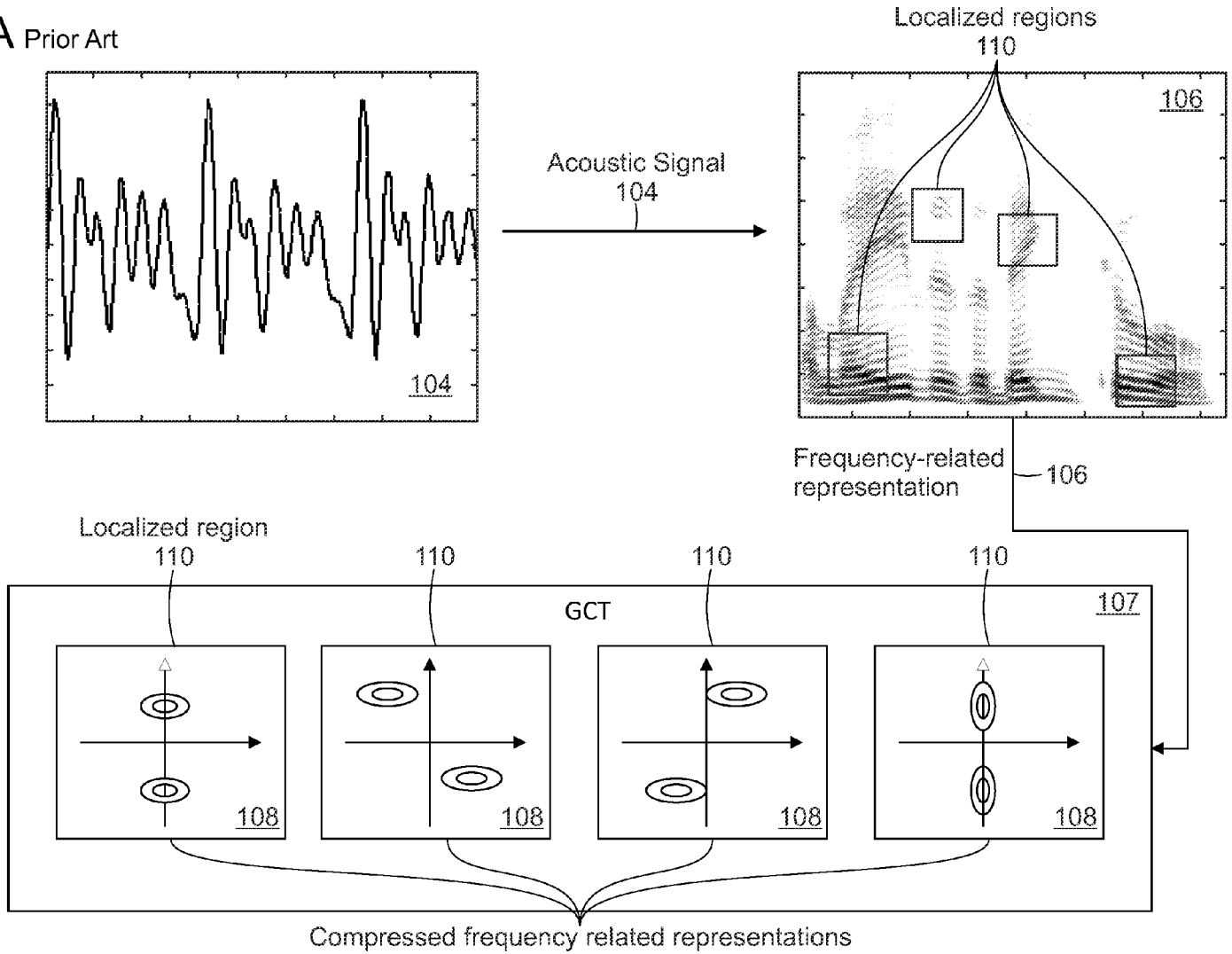
FIG. 1A Prior Art
FIGS. 1A-1B include plots that demonstrate localized time-frequency regions.
Figure 1B:
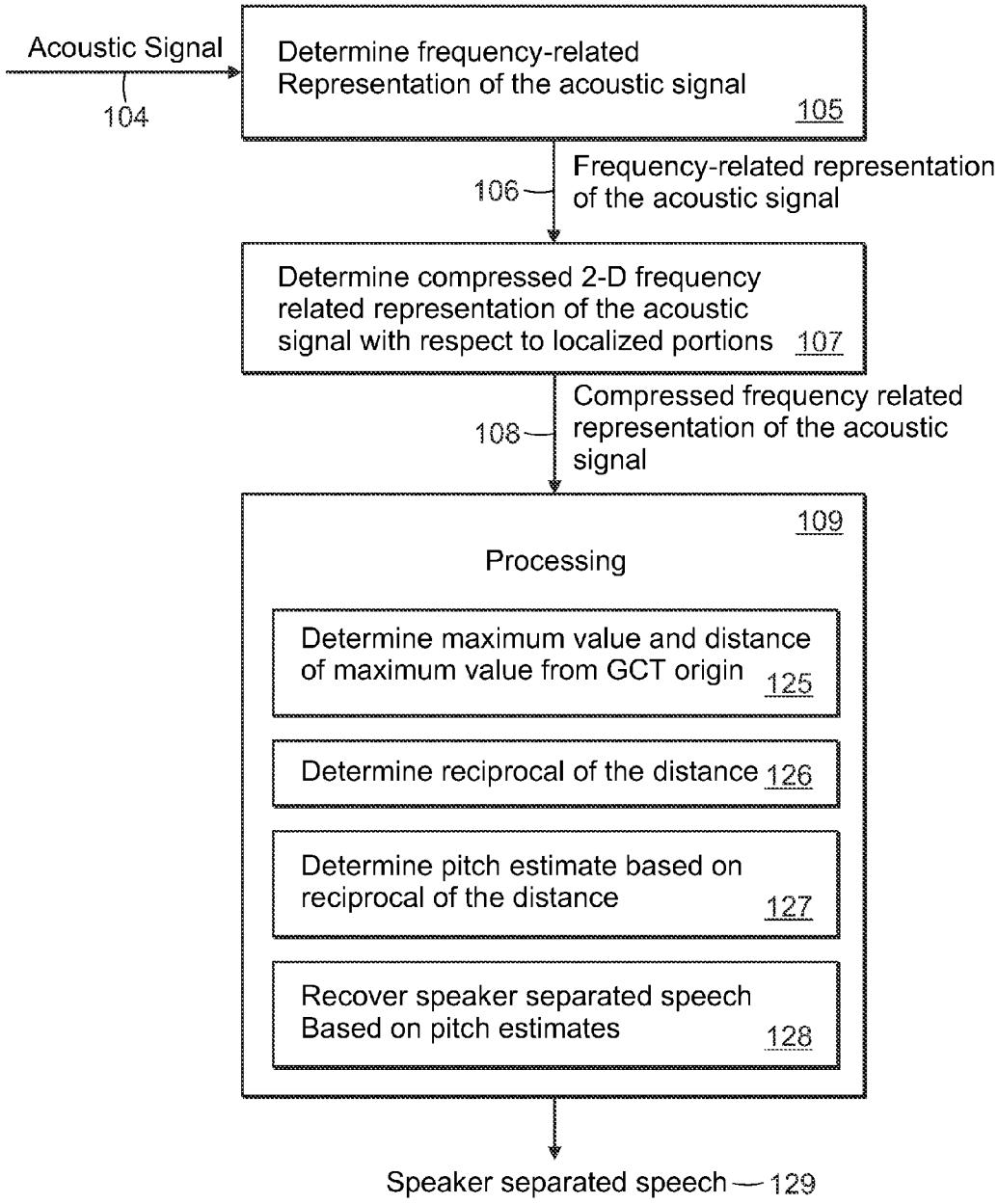
Prior Art FIG. 1B
Figure 1C:
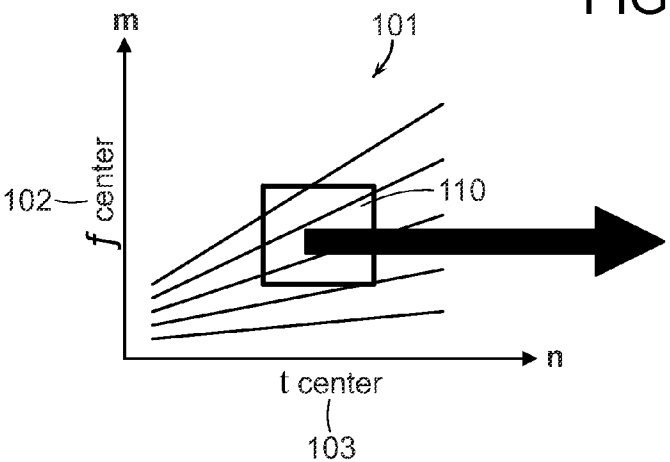
FIG. 1C(a) illustrates schematic of full STFTM with localized time-frequency region centered at $t_{center}$ and $f_{center}$ for GCT analysis.
Figure 1C:
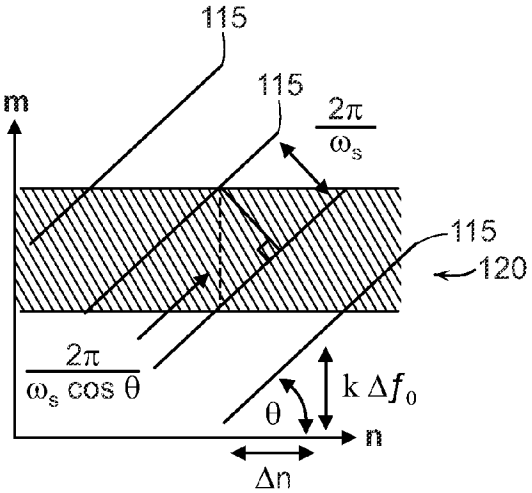
Figure 1C:
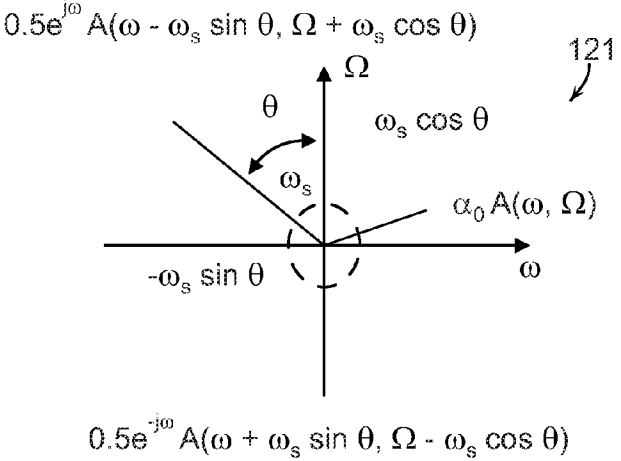
Figure 1C:
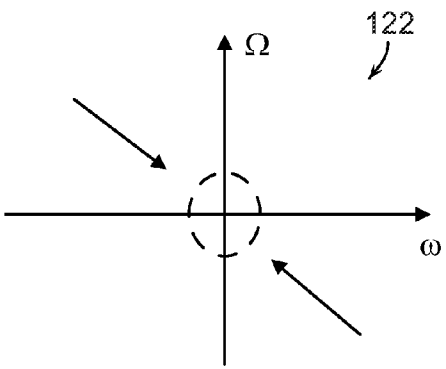

FIG. 1C includes plots that demonstrate localized time-frequency regions according to certain example embodiments. A localized time-frequency region s[n,m] (discrete-time and frequency n,m) of a narrowband short-time Fourier transform magnitude (STFTM) for a single voiced utterance may be computed. FIG. 1C(a) illustrates a schematic 101 of full STFTM with localized time-frequency region centered at $t_{center}$ 103 and $f_{center}$ 102 for GCT analysis (area shown using rectangle 110). The localized region 110 is shown in more details in the schematic of FIG. 1*b*. As demonstrated in FIG. 1C(b), the localized region 110 includes a harmonic structure (parallel lines) and an envelope (shaded area 120). The localized region 110 includes a frequency range that is substantially less than the frequency range of the first representation. A 2-D amplitude modulation (AM) model from [8] may be extended such that:

$$s[n,m]\approx(\alpha_0+\cos(\Phi[n,m]))a[n,m]$$

$$\Phi[n,m]=\omega_s(n\cos+m\sin\theta)+\phi. \quad (1)$$

Thus, a sinusoid with spatial frequency $\omega_s$, orientation $\theta$, and phase $\phi$ rests on a DC pedestal $\alpha_0$ and modulates a slowly-varying envelope a[n,m]. The 2-D Fourier transform of s[n,m] (i.e., the GCT) is $$S(\omega,\Omega)=\alpha_0 A(\omega,\Omega)+0.5e^{-j\phi}A(\omega+\omega_s\sin\theta,\Omega-\omega_s\cos\theta)+0.5e^{j\phi}A(\omega-\omega_s\sin\theta,\Omega+\omega_s\cos\theta) \quad (2)$$

where $\omega$ and $\Omega$ map to n and m, respectively. The sinusoid represents the harmonic structure associated with the speaker's pitch [5, 10]. Denoting $f_s$ as the waveform sampling frequency and $N_{STFT}$ as the discrete-Fourier transform (DFT) length of the STFT, the GCT parameters relate to the speaker's pitch ($f_0$) at the center (in time) of s[n,m] (as shown in FIGS. 1C(b) and 1C(c)) [5, 10]:

$$f_0=(2\pi f_s)/(N_{STFT}\omega_s\cos\theta). \quad (3)$$

A change in $f_0$ ($\Delta f_0$) across $\Delta n$ results in an absolute change in frequency of the $k^{th}$ pitch harmonic by $k\Delta f_0$. Therefore, in a localized time-frequency region (FIG. 1C(b))

$$\tan\theta\approx(k\Delta f_0)/\Delta n. \quad (4)$$

For a particular s[n,m] with center frequency $f_{center}$ (FIG. 1*a*), $f_0$ can be obtained from (3) such that $k\approx f_{center}/f_0$. The rate of change of $f_0$ ($\partial f_0/\partial t$) in s[n,m] is then $$\partial f_0/\partial t\square\Delta f_0/\Delta n=(f_0\tan\theta)/f_{center}. \quad (5)$$

Finally, $\phi$ corresponds to the position of the sinusoid in s[n,m]; for a non-negative DC value of a[n,m], $\phi$ can be obtained by analyzing the GCT at ($\omega=\omega_s\sin\theta,\Omega=\omega_s\cos\theta$):

$$\phi=\text{angle}[S(\omega_s\sin\theta,\omega_s\cos\theta)]. \quad (6)$$

FIG. 1C(c) demonstrates concentrated entities 121 in the GCT near DC and at 2-D carriers. As shown in FIG. 1C(c), harmonically related speech content in each s[n,m] are mapped into concentrated entities 121 in the GCT near DC and at 2-D "carriers."

FIG. 1C(d) illustrates demodulation process 122 performed to recover near-DC terms. Once the near-DC terms are removed or corrupted, approximate recovery of the near-DC terms from the carrier terms using sinusoidal demodulation becomes possible. Using demodulation, the full STFTM may then be recovered and combined with the STFT phase for approximate waveform reconstruction.

Multi-Speaker Modeling

Certain example embodiments approximate the STFTM computed for a mixture of N speakers in a localized time-frequency region x[n,m] as the sum of their individual magnitudes. Using the model of (1), $$x[n,m]\approx\sum_{i=1}^{N}\alpha_{0,i}a_i[n,m]+\sum_{i=1}^{N}a_i[n,m]\cos(\omega_i(n\cos\theta_i+m\sin\theta_i]+\varphi_i). \quad (7)$$

Equation (7) invokes the sparsity of harmonic line structure from distinct speakers in the STFTM (i.e., when harmonic components of speakers' are located at different frequencies). Nonetheless, separation of speaker content in the GCT may still be maintained when speakers exhibit harmonics located at identical frequencies (e.g., due to having the same pitch values, when pitch values are integer multiples of each other) due to its representation of pitch dynamics through $\theta$ in (7) [10].

Figure 2B:
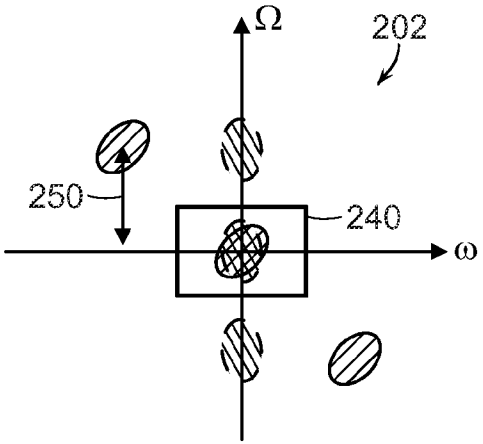
FIG. 2*b* illustrates GCT of the schematic shown in FIG. 2(*a*) including overlap of near-DC terms with speakers exhibiting the same vertical distances from the ω-axis corresponding to equal pitch values and separability being is maintained due to distinct angular positions off of the Ω-axis.
Figure 2C:
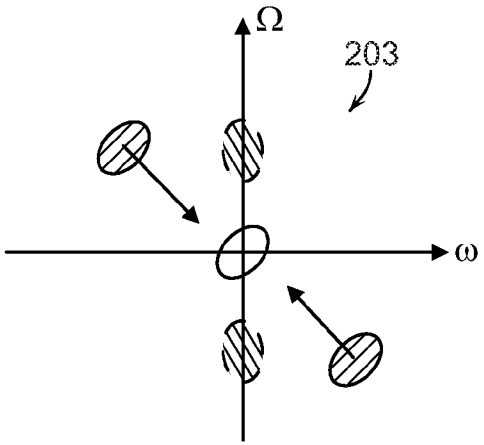
FIG. 2*c* illustrates Demodulation to recover near-DC terms of one speaker.
Figure 2A:
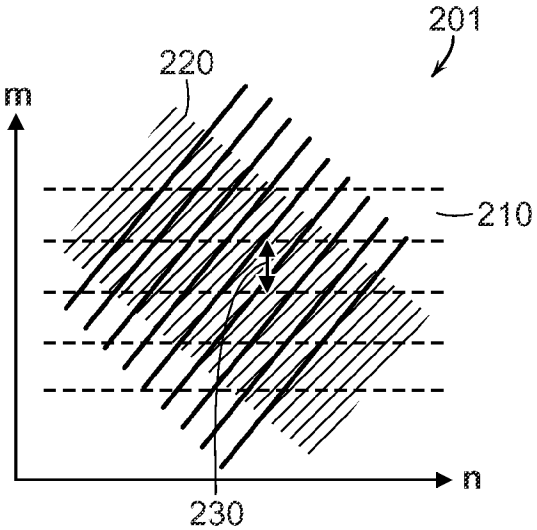
FIG. 2*a* illustrates localized time-frequency region of STFTM computed on a mixture of two speakers including a speaker with rising pitch and falling formant structure and a speaker with stationary pitch and stationary formant.

FIG. 2 illustrates an example embodiment that employs two speakers with equal pitch values and distinct pitch dynamics. In FIG. 2*a*, a localized time-frequency region 201 of STFTM is computed on a mixture of two speakers. One speaker may include a rising pitch and a falling formant structure 220. The other speaker may include a stationary pitch and a stationary formant structure 210. The speakers may give the same pitch value at center of region (shown by arrow 230). The GCT 202 of the localized time-frequency region 201 is illustrated in FIG. 2. The GCT 202 demonstrates overlap of near-DC terms 240. The two speakers exhibit the same vertical distances 250 from the $\omega$-axis corresponding to equal pitch values. However, separability is maintained due to distinct angular positions off of the $\Omega$-axis. Thus, as shown in FIGS. 2*a*-2*b*, since the two speakers have equal pitch values but distinct pitch dynamics, separability in the GCT is possible.

The 2-D Fourier transform of (7) is $$X(\omega,\Omega)=\sum_{i=1}^{N}\alpha_{0,i}A_i(\omega,\Omega)+0.5\sum_{i=1}^{N}A_i(\omega+\omega_i\sin\theta_i,\Omega-\omega_i\cos\theta_i)e^{-j\varphi_i}+0.5\sum_{i=1}^{N}A_i(\omega-\omega_i\sin\theta_i,\Omega+\omega_i\cos\theta_i)e^{j\varphi_i}. \quad (8)$$

For slowly-varying $A_i(\omega,\Omega)$, the contribution to $X(\omega,\Omega)$ from multiple speakers exhibits overlap near the GCT origin (FIG. 2*b*); however, as in the single-speaker case, $A_i(\omega,\Omega)$ can be estimated through sinusoidal demodulation according to the proposed model. This model therefore motivates localized 2-D demodulation of the STFTM computed for a mixture of speakers for the speaker separation task (FIG. 2*c*). By demodulating the STFTM near-DC terms of a speaker may be recovered.

In certain embodiments, a sinusoidal demodulation in conjunction with a least-squared error fit may be employed to estimate the gains $\alpha_{0,i}$ in (7) and (8). This notion can be generalized to include any parametric representation and can be extended beyond the gains $\alpha_{0,i}$ to include a parametric representation of the entire amplitude a[n,m] and phase $\phi$[n,m] functions of each signal component in the GCT domain.

Single-Speaker Analysis and Synthesis

To assess the AM model's ability to represent speech content of a single speaker, an STFT is computed for the signal using a 20 milliseconds (ms) Hamming window, 1-ms frame interval, and 512-point DFT. From the full STFTM ($s_F$[n,m]), localized regions centered at k and l in time and frequency ($s_{kl}$[n,m]) of size 625 Hz by 100 ms are extracted using a 2-D Hamming window ($w_h$[n,m]) for GCT analysis. A high-pass filter $h_{hp}$[n,m] is applied to each $s_{kl}$[n,m] to remove $\alpha_0 A(\omega,\Omega)$ in (2) (this result is denoted as $s_{kl,hp}$[n,m]). The $h_{hp}$[n,m] is a circular filter with cut-offs at $\omega=\Omega=0.1\pi$, corresponding in $\omega$ to a ~300 Hz upper limit of $f_0$ values observed in analysis.

For each $s_{kl,hp}$[n,m], certain example embodiments may approximately recover $\alpha_0 A(\omega,\Omega)$ using 2-D sinusoidal demodulation. The carrier (cos($\Phi$[n,m])) parameters are determined from the speaker's pitch track using (3) for $\omega_s$ and (6) for $\phi$. To determine $\theta$, a linear least-squared error fit is applied to the pitch values spanning the 100-ms duration of $s_{kl,hp}$[n,m]. The slope of this fit approximates $\partial f_0/\partial t$ such that $\theta$ is estimated using (5). The term $s_{kl,hp}$[n,m] is multiplied by the carrier generated from these parameters followed by filtering with a circular low-pass filter $h_{lp}$[n,m] with cut-offs at $\omega=\Omega=0.1\pi$ (this result is denoted as $\hat{a}$[n,m]). The term $\hat{a}$[n,m] is combined with the carrier using (1) and set equal to $s_{kl}$[n,m]

$$s_{kl}[n,m]=(\alpha_0+\cos(\Phi[n,m]))\hat{a}[n,m]. \quad (9)$$

For each time-frequency unit of $s_{kl}[n,m]$, (9) corresponds to a linear equation in $\alpha_0$ since the values of $s_{kl}[n,m]$,$\hat{a}[n,m]$, and $\cos(\Phi([n,m])$ are known. This over-determined set of equations is solved in the least-squared error (LSE) sense. The resulting estimate of $s_{kl}[n,m]$ using the estimated $\alpha_0$,$\hat{a}[n,m]$, and $\cos(\Phi[n,m])$ is denoted as $\hat{s}_{kl}[n,m]$. The full STFTM estimate $\hat{s}_F[n,m]$ is obtained using overlap-add (OLA) with a LSE criterion (OLA-LSE) [11]

$$\hat{s}_F[n,m] = \frac{\sum_k \sum_l w_h[kT-n, lF-m]\hat{s}_{kl}[n,m]}{\sum_k \sum_l w_h^2[kT-n, lF-m]}. \tag{10}$$

OLA step sizes in time and frequency (T and F) are set to ¼ of the size of $w_h[n,m]$. The term $\hat{s}_F[n,m]$ is combined with the STFT phase for waveform reconstruction using OLA-LSE [11].

Speaker Separation

For speaker separation, the demodulation steps are nearly identical to those used for single speaker analysis and synthesis. The demodulation steps are applied to the mixture signal. Assuming that $x_{kl}[n,m]$ is a localized region of the full STFTM computed for the mixture signal centered at k and l in time and frequency, the term $x_{kl}[n,m]$ is filtered with $h_{hp}[n,m]$ to remove the overlapping $\alpha_{0,i}A_i(\omega,\Omega)$ terms at the GCT origin (this result is denoted as $x_{kl,hp}[n,m]$). A cosine carrier for each speaker is generated using the corresponding pitch track and multiplied by $x_{kl,hp}[n,m]$ to obtain $$\begin{aligned} x_{kl,i}[n,m] &= x_{kl,hp}[n,m]\cos(\omega_i[n\sin\theta_i + m\cos\theta_i] + \varphi_i) \\ &= \hat{a}_i[n,m] + c[n,m]. \end{aligned} \tag{11}$$

If the speakers' carriers are in distinct locations of the GCT, c[n,m] summarizes cross terms away from the GCT origin such that $\hat{a}_i[n,m]$ can be obtained by filtering $x_{kl,i}[n,m]$ with $h_{lp}[n,m]$. For each speaker, $\hat{a}_i[n,m]$ is combined with its respective carrier using (1). These results are summed and set equal to $x_{kl}[n,m]$ to solve for $\alpha_{0,i}$ in the LSE sense:

$$x_{kl}[n,m] = \sum_{i=1}^{N} (\alpha_{0,i} + \cos(\Phi[n,m]))\hat{a}_i[n,m] \tag{12}$$

Since GCT represents pitch and pitch dynamics; it may, therefore, invoke improved speaker separability over representations relying solely on harmonic sparsity. In a region where speakers have equal pitch values and the same temporal dynamics, however, (12) invokes a near-singular matrix. To address this, the angle between the $\hat{a}_i[n,m]$ columns of the matrix may be computed. When this angle is below a threshold (in certain example embodiments this threshold may be $\pi/10$), the $\alpha_{0,i}$ is solved for by reducing the matrix rank to that corresponding to a single speaker.

Finally, the estimated full STFTMs of the target speakers are reconstructed using (10). Speaker waveforms are then reconstructed using OLA-LSE by combining the estimated STFTMs with the STFT phase of the mixture signal.

In certain embodiments, the acoustic signal being processed may include multiple voiced signals and unvoiced signals. In such embodiments, only the voice signal components require pitch estimation.

Certain embodiments may modify an audio-signal component in the GCT space prior to reconstruction (e.g., pitch modification to transfer/modify a concentrated entity).

Evaluation

Two all-voiced sentences sampled at 8 kHz ("Why were you away a year, Roy?" and "Nanny may know my meaning"), spoken by 10 males and females (40 total sentences), are analyzed. Pitch estimates of the individual sentences are determined prior to analysis from an autocorrelation-based pitch tracker.

First analysis and synthesis of a single speaker is performed. For comparison, a waveform by filtering $s_F[n,m]$ with an adaptive filter $$h_s[n,m] = h_{lp}[n,m](1+2\cos(\omega_s[n\sin\theta + m\cos\theta] + \phi_s)) \tag{13}$$

is also generated. In (13), $\omega_s$, $\theta$, and $\phi_s$ are determined for each localized time-frequency region using the speaker's pitch track. The term $h_{lp}[n,m]$ is obtained for use in single speaker analysis and synthesis. The filtered STFTM is used to recover the waveform.

To assess the feasibility of GCT-based speaker separation, mixtures of two sentences (Nanny and Roy) spoken by 10 males and females mixed at 0 dB (90 mixtures total) are analyzed. For comparison, a baseline sine wave-based separation system (SBSS) is used. The SBSS models sine wave amplitudes and phases given their frequencies (e.g., harmonics) for each speech signal [2]. This baseline is chosen for comparison as it similarly uses a priori pitch estimates to obtain the sinusoidal frequencies, and to assess potential benefits of the GCT's explicit representation of pitch dynamics.

Figure 3A:
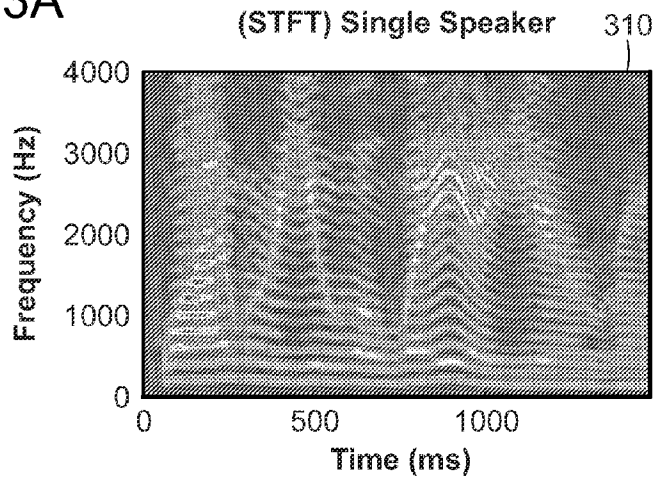
FIGS. 3*a*-3*d* are plots that demonstrate results obtained using analysis and synthesis of a single speaker.
Figure 3B:
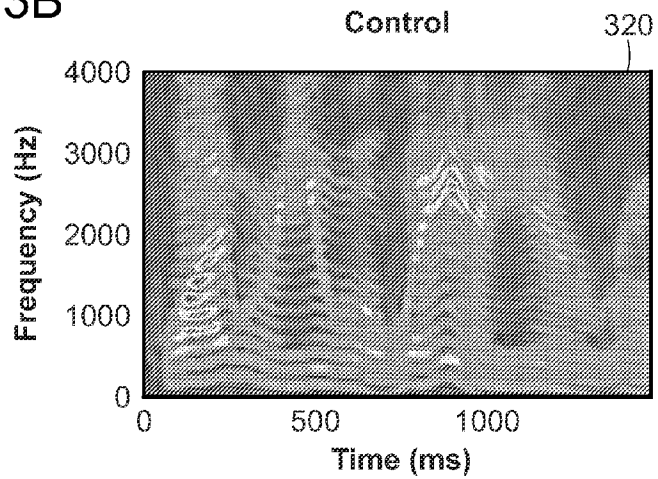
Figure 3C:
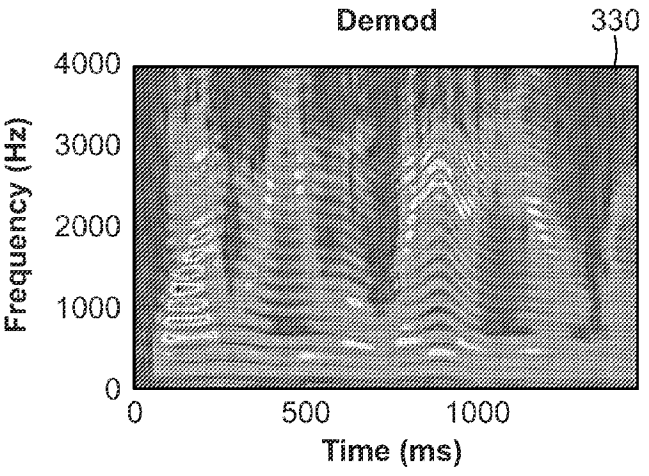
Figure 3D:
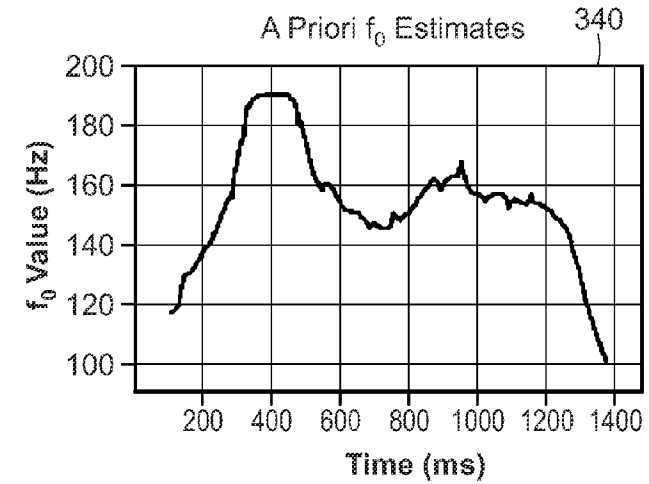

FIGS. 3*a*-3*d* are plots that demonstrate STFTMs obtained in the single-speaker experiment and a priori pitch estimates. FIG. 3*a* demonstrates the STFT magnitude of a single speaker sentence (Roy) 310. FIG. 3*b* demonstrates the recovered STFT magnitude using a control method 320. FIG. 3*c* demonstrates the recovered STFT magnitude using a demodulation method. FIG. 3*d* demonstrates the a priori pitch estimates of sentence analyzed in FIG. 3*a*-FIG. 3*c*.

In plots of FIGS. 3*a*-3*d*, STFTMs is obtained in the single-speaker experiment and a priori pitch estimates. The demodulation scheme appears to provide a similar reconstruction as the control method.

Figure 4A:
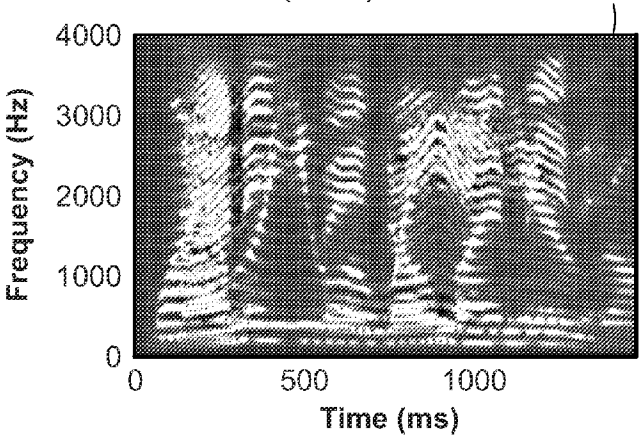
FIGS. 4*a*-4*d* are plots that demonstrate results obtained using analysis and synthesis of two speakers.
Figure 4B:
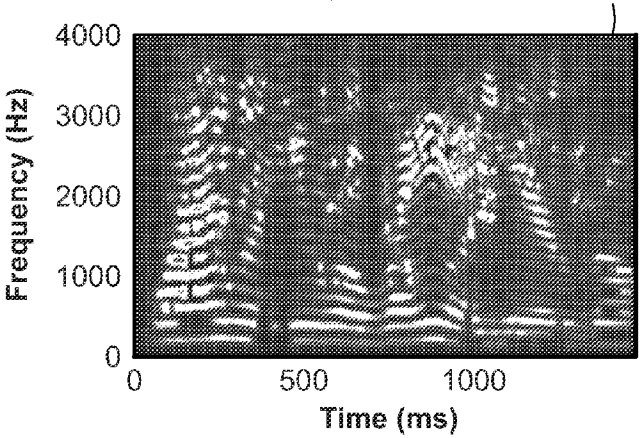
Figure 4C:
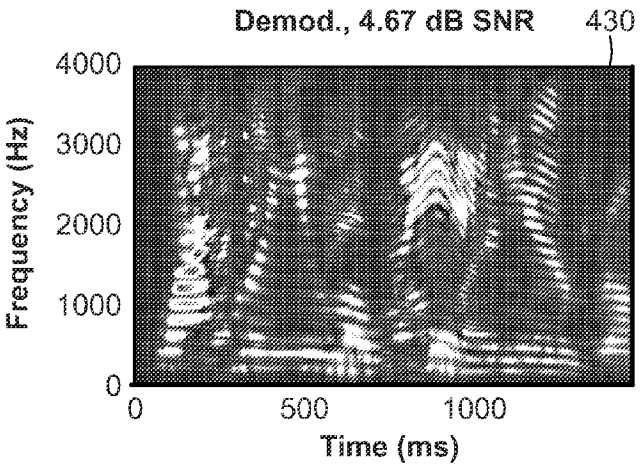
Figure 4D:
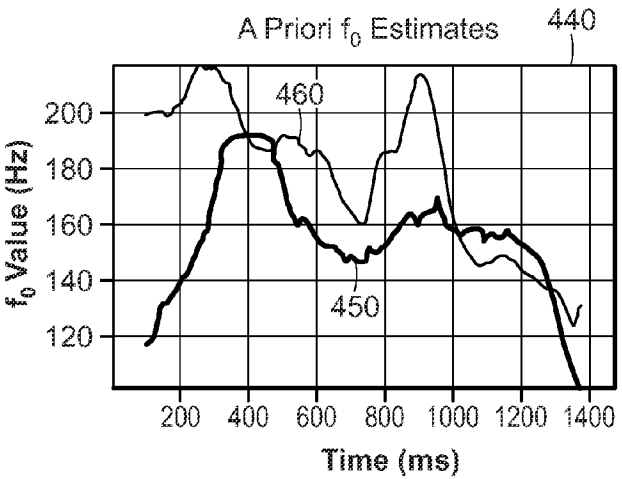

FIGS. 4*a*-4*d* are plots that demonstrate STFTMs obtained in the two-speaker experiment. FIG. 4*a* demonstrates the STFT magnitude of mixture speaker sentences (i.e., Nanny and Roy). FIG. 4*b* illustrates the recovered STFT magnitude of the Roy sentence using SBSS with resulting SNR listed. FIG. 4*c* illustrates the recovered STFT magnitude of the Roy sentence using demodulation. FIG. 4*d* demonstrates a priori pitch estimates of target 440 and interfering 450 speakers. The pitch tracks exhibit crossings throughout mixture.

In FIG. 4, the resulting STFTMs for the separation task using the single-speaker sentence as the target is shown. In this example, the pitch tracks of the target and interferer exhibit crossings (FIG. 4*d*), thereby leading to overlapping harmonic structure in the mixture STFTM. Qualitatively, GCT demodulation appears to provide a more faithful reconstruction of the target than SBSS.

FIG. 5 is a table 500 that includes average signal-to-noise ratios (SNR) of the original and reconstructed waveforms shown in FIGS. 3 and 4. In the single speaker case, demodulation provides a better reconstruction than filtering by ~1.3 dB. One possible cause for this is the introduction of negative magnitude values in the filtered STFTM. These effects are likely minimized in demodulation through the LSE fitting procedure. Nonetheless, both methods provide good reconstruction of the waveform with overall SNR>11 dB. In the mixed speaker case, consistent with the recovered STFTMs (FIG. 4), demodulation affords a larger gain in SNR than SBSS and on average. This is due to the GCT's explicit representation of pitch dynamics. In informal listening for the single speaker case, subjects report no perceptual difference between the filtering and demodulation methods in relation to the original signal. In the mixed speaker case, subjects report intelligible reconstructions of the target speech for both methods with a reduced amplitude of the interferer. However, in assessing SBSS, subjects report that the interferer sounded "metallic" while this synthetic quality was not perceived for the GCT system. These observations demonstrate the utility of the AM model for representing speech content of a single speaker. They also demonstrate the feasibility of GCT for speaker separation and its advantages in representing pitch dynamics for this task.

Therefore, a 2-D modulation model accounting for near-DC terms of the GCT provides good representation of speech content of a single speaker and may be used for co-channel speaker separation. The present method is to be combined with the subsequently discussed method for performing multi-pitch estimation. Specifically, the a priori estimated pitch estimates used in this section will be replaced by those obtained using the multi-pitch estimation method.

GCT-Based Multi-Pitch Estimation Methods

GCT-Based Analysis of Multi-Pitch Signals

For the multi-pitch estimation task, certain example embodiments may include two-dimensional (2-D) processing and analysis of multi-pitch speech sounds. Short-space 2-D Fourier transform magnitude of a narrowband spectrogram are invoked, and harmonically-related signal components are mapped to multiple concentrated entities in a new 2-D space. First, localized time-frequency regions of the spectrogram are analyzed to extract pitch candidates. These candidates are then combined across multiple regions for obtaining separate pitch estimates of each speech-signal component at a single point in time (referred to as multi-region analysis (MRA)). By explicitly accounting for pitch dynamics within localized time segments, this separability is distinct from that which can be obtained using short-time autocorrelation methods typically employed in state-of-the-art multi-pitch tracking algorithms.

Framework

FIG. 6 includes plots that illustrate an impulse train with linearly increasing pitch. FIGS. 6*a*-6*b* illustrate examples of localized time-frequency regions s[n,m] (with discrete-time and frequency: n,m) of a narrowband short-time Fourier transform (STFT) log-magnitude exhibiting harmonic line structure for an impulse train with linearly increasing pitch (125-200 Hz). In FIG. 6*a*, spectrogram with localized regions (rectangles 610) across frequency for a single time segment (arrow 620) are shown. FIG. 6*b* demonstrates a zoomed-in region 610.

Figure 6A:
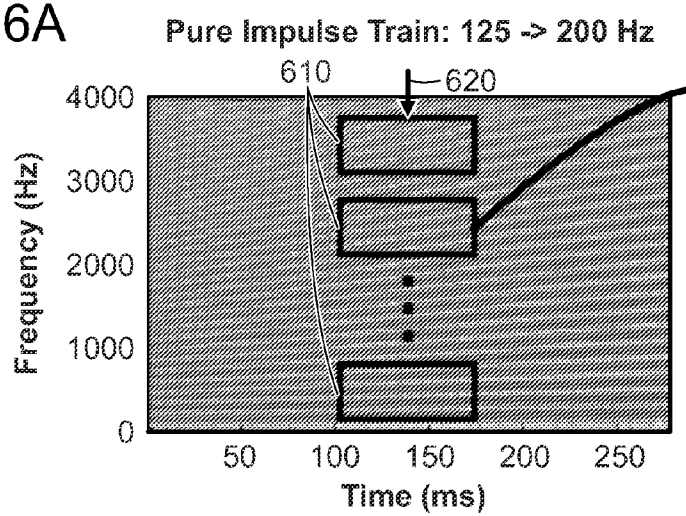
FIG. 6*a* is a plot of an impulse train with linearly increasing pitch that illustrates a spectrogram with localized regions across frequency for a single time segment.
Figure 6B:
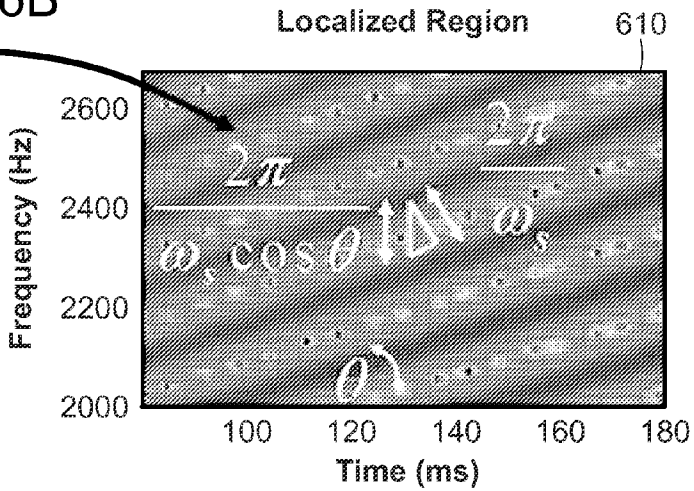
FIG. 6*b* demonstrates a zoomed-in region from FIG. 6(*a*) with vertical ($2\pi/\omega_s \cos\theta$) and spatial ($2\pi/\omega_s$) distance between harmonic lines and 2-D sine wave orientation (θ).
Figure 6C:
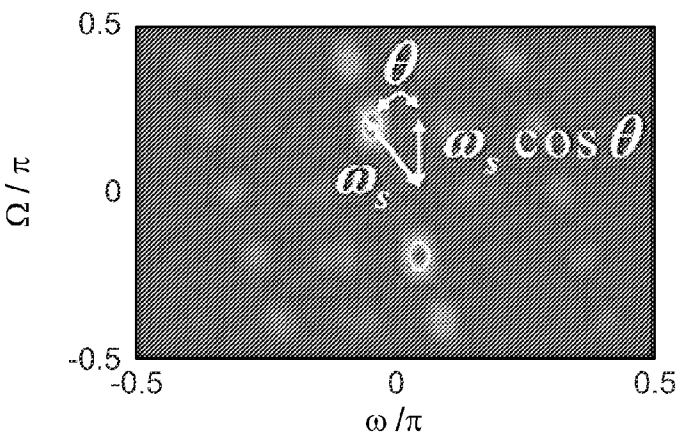
FIG. 6*c* demonstrates magnitude of GCT of the schematic shown in FIG. 6*b* with $\omega_s$, θ, $\omega_s \cos\theta$. The DC component is removed for display purposes.

A 2-D sinewave model for s[n,m] is [13]

$$s[n,m] \approx K + \cos(\omega_s \Phi[n,m]) \tag{14}$$

where $\omega_s$ denotes the local spatial frequency of the sinusoid, $\Phi[n,m]$ is a 2-D phase term indicating its orientation, and K is a constant DC term. The term $\Phi[n,m]$ is defined as $$\Phi[n,m] = n \sin\theta + m \cos\theta \tag{15}$$

where θ is the angle of rotation of the harmonic lines relative to the time axis. The 2-D Fourier transform of s[n,m] is then $$S(\omega, \Omega) \approx 2\pi K \delta(\omega, \Omega) + 2\pi\delta(\omega + \omega_s \sin\theta, \Omega - \omega_s \cos\theta) + 2\pi\delta(\omega - \omega_s \sin\theta, \Omega + \omega_s \cos\theta) \tag{16}$$

such that the harmonic line structure maps to a set of impulses in the GCT (FIG. 6*c*). The present embodiment employs $\omega_s \cos\theta$ (vertical distance of impulses to the GCT origin) to better represent pitch across all frequency regions $$\left(f_{0,vertical} = \frac{1}{N_{STFT}} \frac{2\pi f_s}{\omega_s \cos\theta}\right).$$

This is consistent with the fact that $\omega_s \cos\theta$ is inversely related to the vertical spacing between harmonic peaks in s[n,m]. Here, $f_s$ is the sampling rate of the waveform, and $N_{STFT}$ is the discrete-Fourier transform (DFT) length used to compute the spectrogram.

Figure 6D:
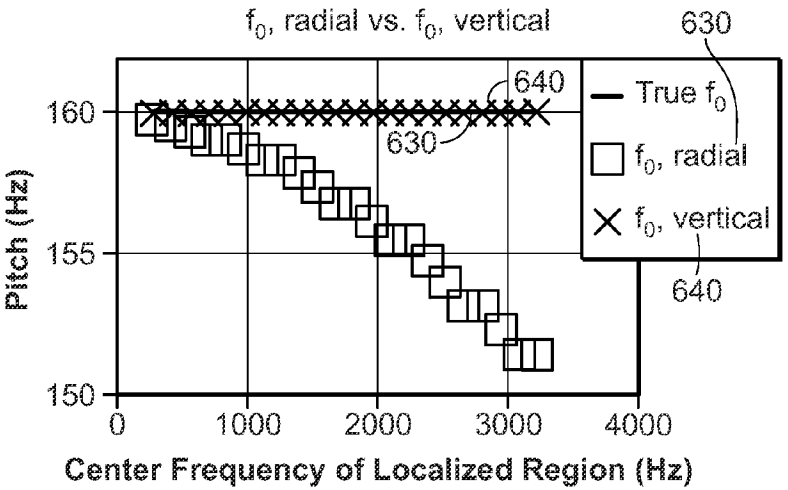
FIG. 6*d* illustrates pitch estimates obtained from vertical vs. radial distances to GCT origin.

FIG. 6*d* demonstrates pitch estimates obtained from vertical vs. radial distances to GCT origin. Specifically, FIG. 1*d* compares $f_{0,radial}$ 630 and $f_{0,vertical}$ 640 computed across multiple frequency regions 610 for a local time segment 620 by peak-picking of the GCT magnitude. While $f_{0,vertical}$ 640 remains constant across frequency regions and corresponds to the true pitch value at the center of segment (~160 Hz), $f_{0,radial}$ 630 decreases across frequency regions by ~10 Hz. This effect is presumably due to the increased fanning of harmonic line structure in higher-frequency regions with changing pitch. This comparison illustrates that rotation of the GCT components (i.e., θ) increases from low- to high-frequency regions.

Analysis of Multi-Pitch Signals and Separability of Pitch Information in the GCT Extending (15) and (16) to the case of N concurrent signals, $$s[n, m] \approx \sum_{i=1}^{N} (K_i + \cos(\omega_i \Phi[n, m; \theta_i])) \tag{17}$$

$$S(\omega, \Omega) \approx 2\pi \sum_{i=1}^{N} K_i \delta(\omega, \Omega) + 2\pi \sum_{i=1}^{N} \delta(\omega + \omega_i \sin\theta_i, \Omega - \omega_i \cos\theta_i) + 2\pi \sum_{i=1}^{N} \delta(\omega - \omega_i \sin\theta_i, \Omega + \omega_i \cos\theta_i). \tag{18}$$

Here, the (log)-magnitude STFT of a mixture of signals is approximated as the sum of the STFT (log)-magnitudes computed for each individual signal. This approximation holds best when the contribution to the STFT from distinct sources occupies different frequency bands. Nonetheless, separation of pitch in the GCT can be maintained even when these conditions do not necessarily hold, i.e., when a frequency band contains more than one source (with or without similar pitch values).

FIG. 7 includes plots that relate to a localized region with two distinct pitch values. In FIG. 7*a*, a localized region with two distinct pitch values and no temporal change is illustrated. Specifically, in FIG. 7*b*, a region of the spectrogram 710 having two sets of harmonic lines corresponding to two distinct pitch trajectories that are constant through s[n,m] is shown. FIG. 7*b* illustrates the GCT plot 720 of the localized region 710 shown in FIG. 7*a*. The GCT exhibits two sets of impulses along the Ω-axis 702. In this case, separability can only be achieved when the two pitch values are sufficiently different. This set-up also generalizes to the case when the two trajectories in s[n,m] move at the same rate and direction.

FIG. 7*c* illustrates that separability occurs along the Ω-axis and FIG. 7*d* illustrates the GCT plot of FIG. 7*c*. Specifically, FIG. 7*c*-7*d* illustrate a condition in which two pitch trajectories have equal pitch values defined at the center of s[n,m] in time but are moving in opposite directions at the same rate. Despite the overlap of harmonic structure in s[n,m], the GCT maintains separability of pitch information due to its explicit representation of the underlying temporal trajectories of the two sources in the values of $\theta_i$ (i.e., $\theta_1=-\theta_2=\theta$). More generally, this separability holds under conditions where the rates of change of the two pitch trajectories are different (i.e., $\theta_1\neq\theta_2$).

Since, for moving pitch trajectories, θ increases from low- to high-frequency regions (FIG. 6*d*), analysis of multiple regions across frequency and time can be expected to provide better separability of pitch information than that of a single low-frequency region across time as in [13].

Comparison to Short-Time Autocorrelation Analysis

The GCT's representation of pitch dynamics within a local time segment invokes separability of pitch information distinct from that obtained in short-time autocorrelation analysis.

Figures 8A, 8B, 8C, 8D, 8E, 8F:
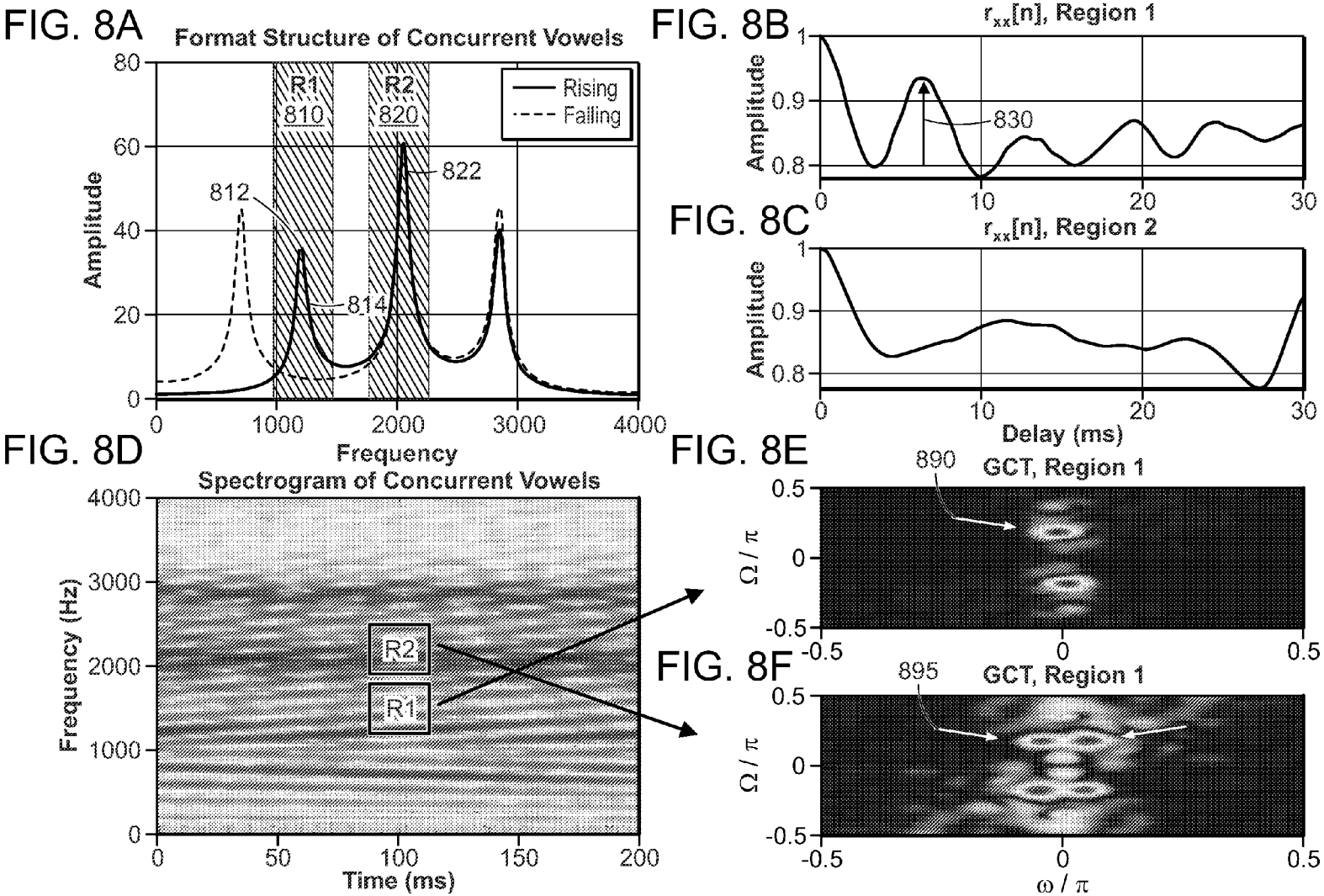
FIG. 8*a* demonstrates examples of analysis of two synthesized concurrent vowels with formant structure of rising and falling-pitched vowels in Region 1 (R1) and Region 2 (R2).
FIG. 8*b* illustrates $r_{xx}[n]$ for R1, shown in FIG. 8*a*, with lag corresponding to dominant pitch.
FIG. 8*c* illustrates $r_{xx}[n]$ for R2 shown in FIG. 8*a*.
FIG. 8*d* illustrates spectrogram of concurrent vowels.
FIG. 8*e* illustrates GCT for R1 (shown in FIG. 8*a*) with dominant pitch.
FIG. 8*f* illustrates GCT for R2 with two sets of pitch peaks.

FIG. 8 demonstrates analysis of two synthesized concurrent vowels with rising and falling pitch contours of 150-200 Hz and 200-150 Hz across a 200-ms duration. FIG. 8*a* demonstrates the formant structure for the vowels. In Region 1 (R1 810), the rising vowel exhibits a formant peak 812 while the falling vowel exhibits a valley 814. In Region 2 (R2 820), a formant peak 822 is present for both vowels. Analysis is done at the center of the mixture where both sources have pitch values of approximately 175 Hz.

For comparison, two linear-phase band-pass filters centered at the formant peaks of R1 810 and R2 820 were applied to the waveform. To obtain an envelope [12], filtered waveforms were then half-wave rectified and low-pass filtered (cutoff=800 Hz). The normalized autocorrelation ($r_{xx}[n]$) was computed for a 30-ms duration of the envelopes (FIGS. 8*b*-8*c*). For R1 810, a single distinct pitch estimate and its sub-harmonics are present (FIG. 8*b*, arrow 830). However, $r_{xx}[n]$ for R2 820 (FIG. 8*c*) reflects the interaction of closely-spaced periodicities and appears noisy.

FIGS. 8*e*-8*f* demonstrate GCTs computed over localized time-frequency regions at R1 810 and R2 820 (FIG. 8*d*). A single dominant set of impulses, corresponding to a single pitch value, is present in the GCT for R1, similar to $r_{xx}[n]$ for R1 810. However, two distinct sets of peaks can be seen for R2 820 (FIG. 8*e*-8*f*, arrows 890, 895) corresponding to two similar pitch values. The GCT can, therefore, separate pitch information of two speakers with similar energies and pitch values in a localized set of frequency bands by exploiting the temporal dynamics of their underlying pitch trajectories. This separability is distinct from that obtained using short-time autocorrelation analysis (as compared with FIG. 8*c*). This separability may be generalized to the case where source signals exhibit similar energies but different pitch values/temporal dynamics.

Multi-Pitch Estimation Method 1: GCT-Based Multi-Region Analysis Approach

The log-STFT magnitude is computed for all mixtures with a 25-ms Hamming window, 1-ms frame interval, and 512-point DFT. Time-frequency regions of size 100 ms by 700 Hz are extracted from the spectrogram at a 5-ms and 140-Hz region interval in time and frequency, respectively. A 2-D gradient operator is applied to the spectrogram prior to extraction to reduce the contribution of the DC and near-DC components to the GCT. To obtain pitch candidates for each region, the GCT magnitude is multiplied by three binary masks derived from thresholding the 1) overall amplitude, 2) gradient (∇GCT), and 3) Laplacian (ΔGCT). The thresholds are chosen as max(GCT)/3, max(∇GCT)/3, and min(ΔGCT)/3. Region growing is performed on the masked GCT, and pitch candidates are obtained by extracting the location of the maximum amplitude in each resulting region. Candidates corresponding to the two largest amplitudes are kept for each time-frequency region. In the case where only a single pitch value is present, the value is assigned twice to the region.

Post-Processing

For synthetic speech, a simple clustering method is used to assign pitch values at each point in time from the candidates of GCT-based MRA. All candidates at a single point in time are collected and sorted, and the median of the top and bottom halves of the collection are then chosen as the two pitch values. A similar technique is used for real speech. However, due to the longer duration of these signals, the temporal continuity of the underlying pitch contours is used in clustering. At each 5-ms interval for a time-frequency region, pitch candidates from its neighboring regions in time spanning 100 ms and across frequencies are combined for clustering. To compare GCT-based MRA with [13], each 5-ms interval is assigned the two candidates from analyzing a single low-frequency region.

Figure 9:
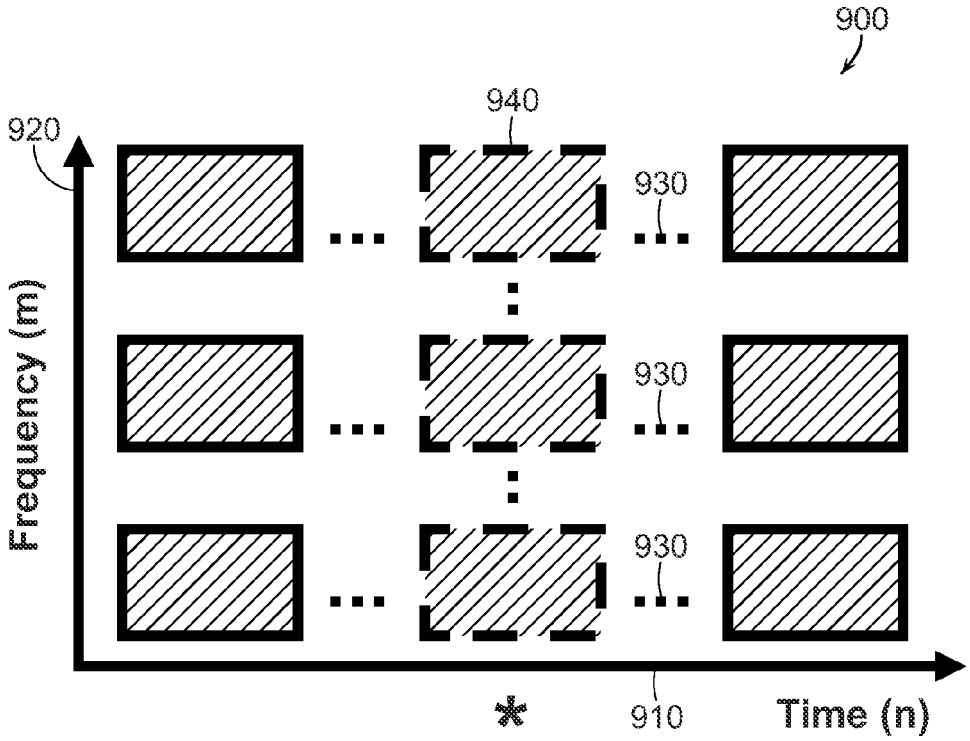
FIG. 9 illustrates post-processing methods for assigning pitch value at time *. The term "s" denotes single low-frequency region, dashed regions denote regions used in clustering for synthetic speech, and shaded regions denote regions used in clustering for real speech.

FIG. 9 illustrates post-processing methods for assigning pitch value at time * 910. Variable "s" denotes single low-frequency region. Dashed regions 930 denote regions used in clustering for synthetic speech and shaded regions 940 denote regions used in clustering for real speech. Finally, oracle pitch values are obtained by assigning to each time point the pitch candidate from GCT-based MRA closest in frequency to the true pitch values. The accuracy of these estimates is viewed as assessing the value of GCT-based MRA for obtaining pitch candidates independent of post-processing (e.g., clustering).

Data Used in Evaluation of Multi-Pitch Estimation Method 1

Concurrent vowels with linear pitch trajectories spanning 300 ms are synthesized using a glottal pulse train and an all-pole formant envelope with formant frequencies of 860, 2050, and 2850 Hz and bandwidths of 56, 65, 70 Hz (/ae/) [5]. For real speech, two all-voiced sentences spoken by a male and female are used. Two cases are analyzed to illustrate typical pitch-trajectory conditions: 1) separate or 2) crossing trajectories within the utterance. All signals are mixed at 0 dB overall signal-to-signal ratio (SSR) and pre-emphasized prior to analysis. True pitch value are obtained using a single-pitch estimator on the signals prior to mixing [6].

Results

FIGS. 10-12 demonstrate estimates for the synthetic and real speech mixtures. The total-best percent error between estimates and truth for both source signals is computed at each time point:

$$\%\ \text{error} = 100\left[\frac{|f_1-\hat{f}|}{f_1}+\frac{|f_2-\hat{f}|}{f_2}\right]. \tag{19}$$

where $\hat{f}$ is the estimate from clustering, single, or oracle closest in frequency to the true pitch values $f_1$ and $f_2$.

Figure 10B:
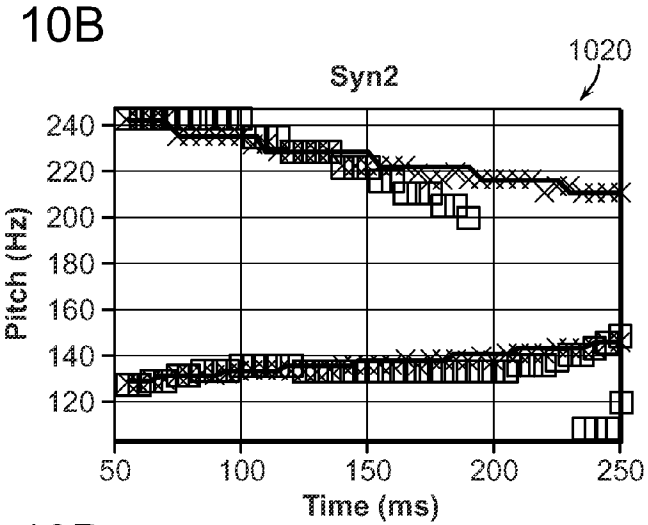
FIG. 10*b* illustrates estimates falling 250-200 Hz+rising 125-150 Hz.
Figure 10A:
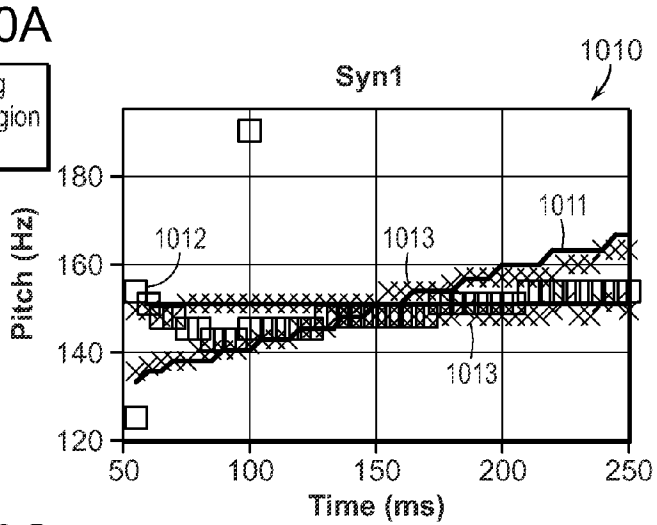
FIG. 10*a* illustrates estimates rising 125-175 Hz+constant 150 Hz.
Figure 10D:
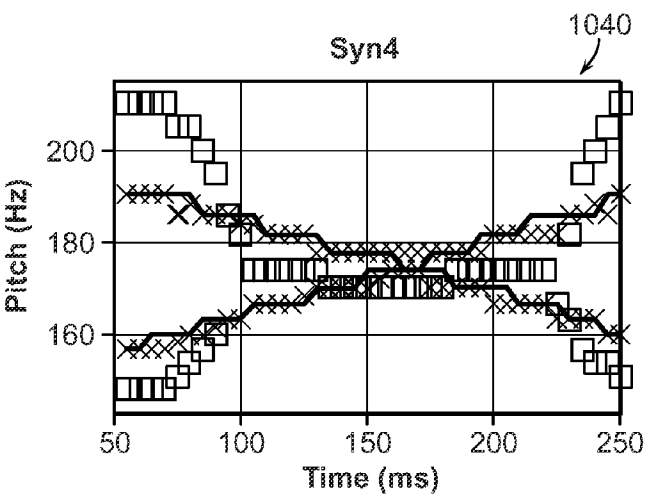
FIG. 10*d* illustrates estimates falling 200-150 Hz+rising 150-200 Hz. Estimates start (end) at 50 (250) ms to remove edge effects.
Figure 10C:
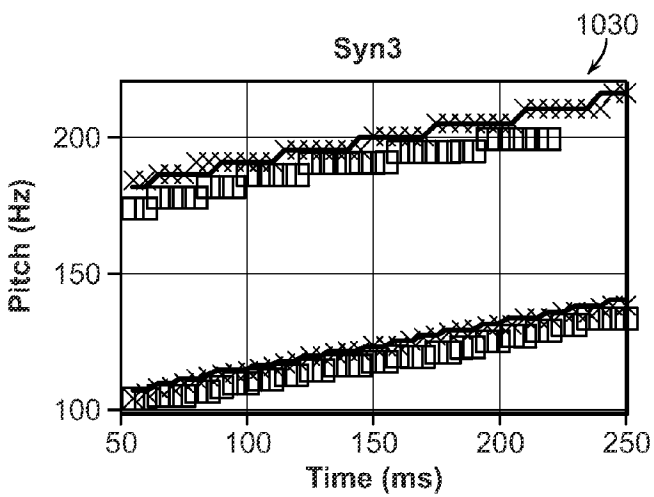
FIG. 10*c* illustrates estimates rising 100-150 Hz+rising 175-225 Hz.

FIG. 10*a* illustrates concurrent vowel pitch estimates 1010. Clustering values 1013, single values 1012, and true pitch values 1011 are shown. In Syn1 1010, the estimates rise at around 125-175 Hz and remain constant at around 150 Hz. In Sync2 1020, the estimates fall at around 250-200 Hz and rise at around 125-150 Hz. In Sync3 1030, these values rise at around 100-150 Hz and also at around 175-225 Hz. In sync 4 1040, the estimates fall at around 200-150 Hz and rise at around 150-200 Hz. Estimates start at around 50 (250) ms to remove edge effects.

Figure 11A:
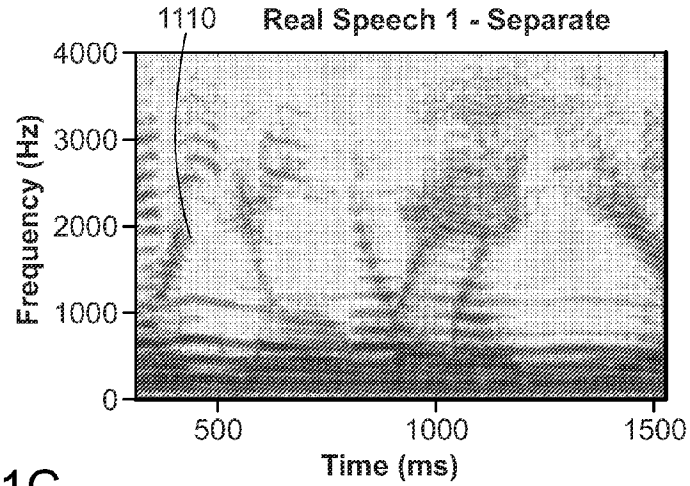
In FIG. 11*a*, all-voiced mixture spectrogram with separate pitch trajectories are illustrated. The all voice mixture includes Male—"Why were you away a year?"+Female—"Nanny may know my meaning" The first 250 ms and last 50 ms excluded to remove edge effects in clustering due to initial and final silent regions.
Figure 11B:
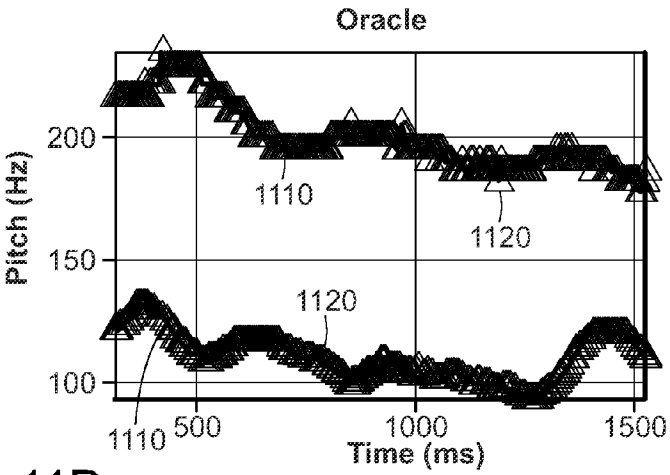
In FIGS. 11*b*-11*d*, truth, oracle, clustering, and single estimates are illustrated.
Figure 11C:
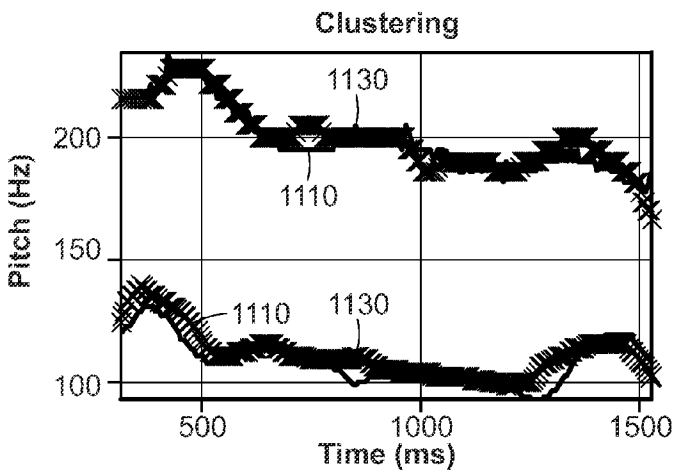
Figure 11D:
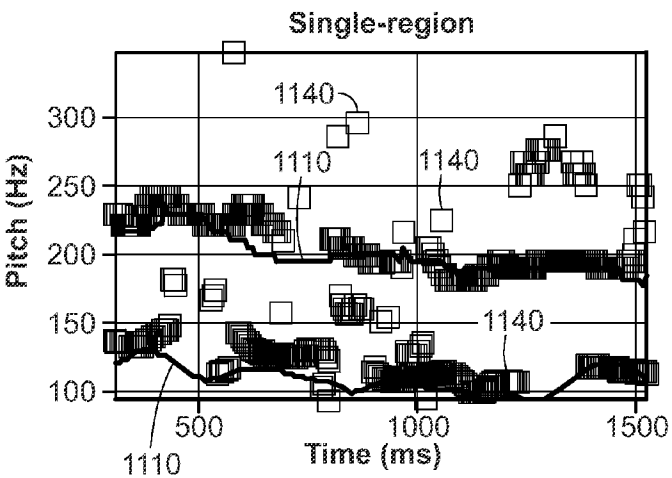
Figure 12A:
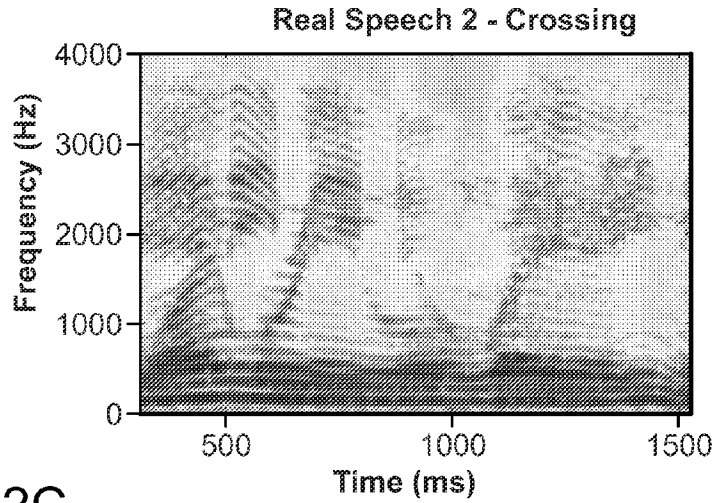
FIG. 12*a* demonstrates estimates for real speech mixture with crossing pitch tracks. All-voiced mixture spectrogram with separate pitch trajectories, Male—"Why were you away a year?"+Female—"Nanny may know my meaning" The first 250 ms and last 50 ms are excluded to remove edge effects in clustering due to initial and final silent regions.
Figure 12B:
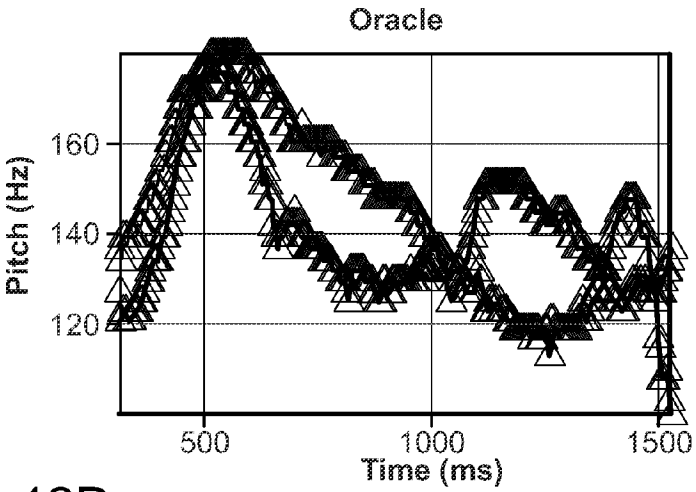
FIGS. 12*b*-12*d* illustrate estimates of truth, oracle, clustering, single.
Figure 12C:
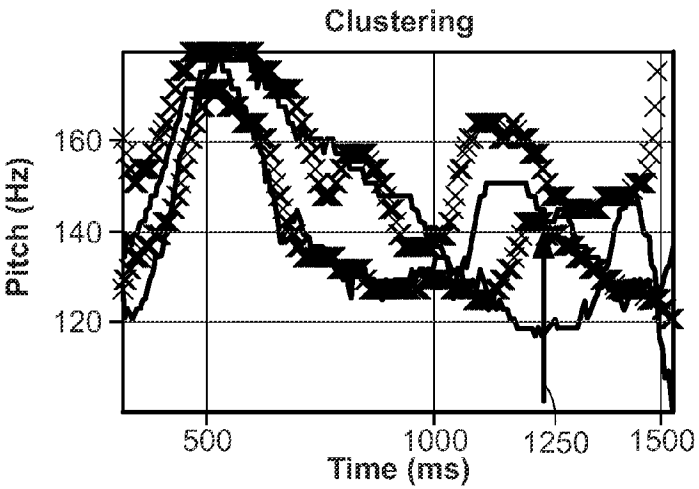
Figure 12D:
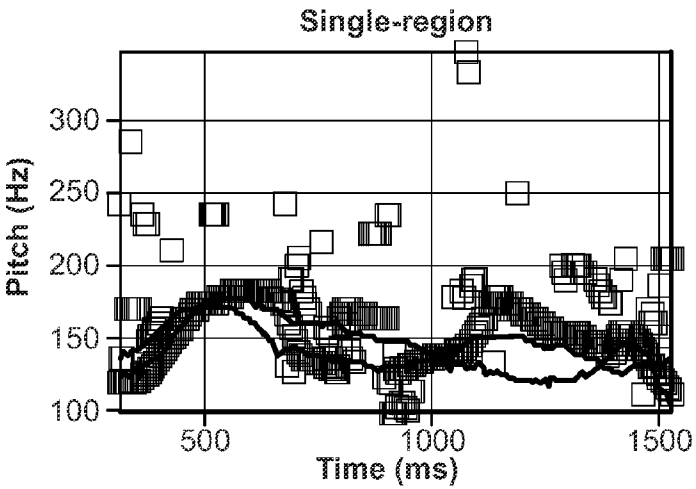

FIG. 11*a* illustrates all-voiced mixture spectrogram with separate pitch trajectories for a male stating "Why were you away a year?" and a female stating "Nanny may know my meaning" The first 250 ms and last 50 ms are excluded to remove edge effects in clustering due to initial and final silent regions. FIGS. 11*b*-11*d* illustrate the values for truth 1110, oracle 1120 (FIG. 11*b*), clustering 1130 (FIG. 11*c*), and single 1140 (FIG. 11*d*).

FIG. 12 includes similar plots as FIG. 11 but with all-voiced mixture with crossing pitch trajectories. In FIG. 12*c*, the arrow 1250 denotes a "jump" due to differences in energy between sources in localized time-frequency regions.

FIG. 13 is a table that includes average % error's (% $\text{error}_{avg}$) computed across time for examples studied in FIGS. 10-12. For the synthetic concurrent-vowels task (Syn1-4, FIG. 10), GCT-based MRA provides accurate estimates under a variety of mixed pitch trajectories. The oracle estimates follow the true pitch values with % $\text{error}_{avg}$<0.04% while the clustering scheme assigns pitch values across time for GCT-based MRA with % $\text{error}_{avg}$<1.75% (FIG. 13). The oracle and clustering of pitch candidates derived from GCT-based MRA exhibits lower % $\text{error}_{avg}$ than single-region analysis in all cases.

For real speech, the oracle pitch values match truth with 0.00% average error in both separate and crossing conditions. Although close to truth for the separate case, it appears that median-based clustering is not optimal for exploiting the oracle candidates in the crossing case, with jumps in pitch values from distinct talkers (e.g., FIG. 12*c*, arrow 1250). This is likely due to the inability of the clustering method to account for points in time in which one speaker is dominant in energy. Nonetheless, the accuracy of the oracle estimates demonstrates the feasibility of employing GCT-based MRA for multi-pitch estimation with an improved post-processing method. Finally, as in the synthetic cases, the oracle and clustering of the GCT-based MRA pitch candidates outperform the single-region method, thereby further illustrating the benefits of exploiting multiple regions for analysis.

Therefore, GCT-based MRA provides separability of pitch information for multi-pitch signals. Since the GCT can separate pitch information from multiple sources of similar energies, the assumption of a single dominant source does not need to be invoked when obtaining pitch candidates as is typically done for short-time autocorrelation analysis methods (e.g., [12]). The accuracy of the pitch estimates obtained using GCT-based MRA on real and synthetic mixtures further demonstrates the feasibility of employing this analysis framework in conjunction with existing multi-pitch tracking techniques (e.g., using hidden Markov models [12]).

Figure 14A:
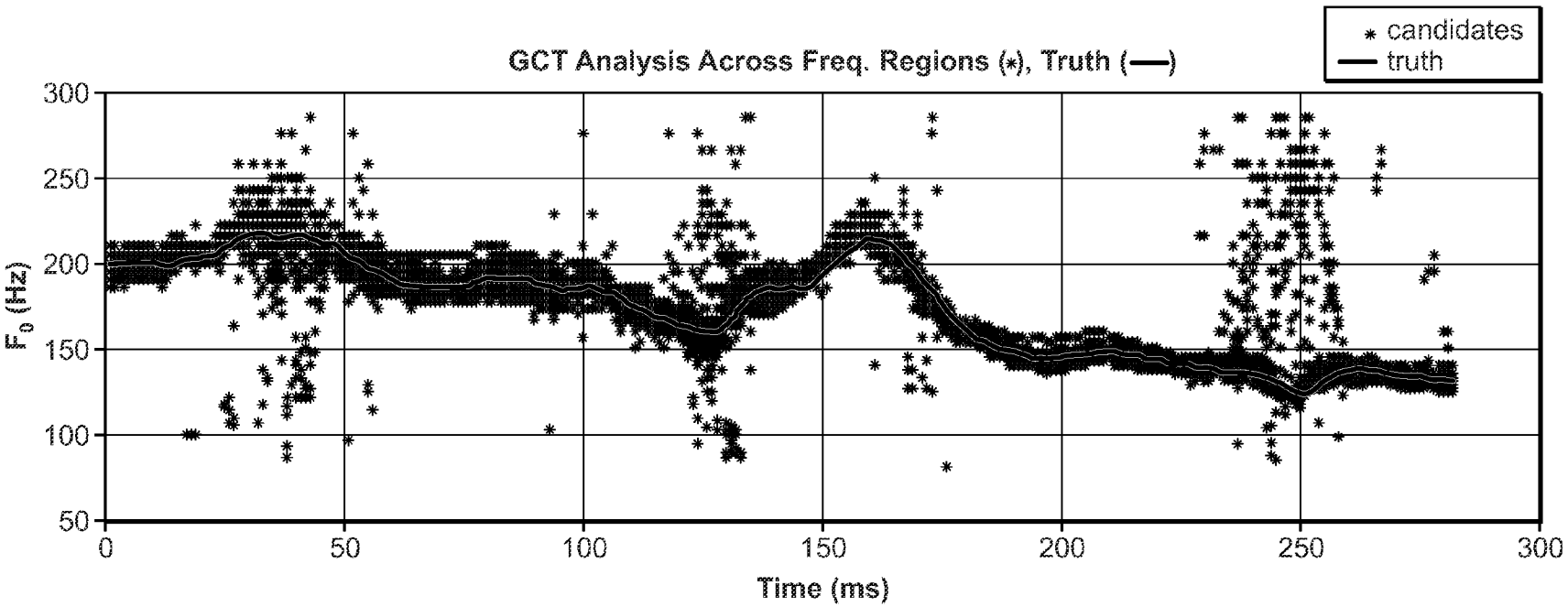
FIG. 14 includes plot of candidate collections obtained across frequency regions from GCT analysis. Each time-frequency region's candidate is represented by * and reference pitch and pitch-derivative values are shown using solid lines.
Figure 14B:
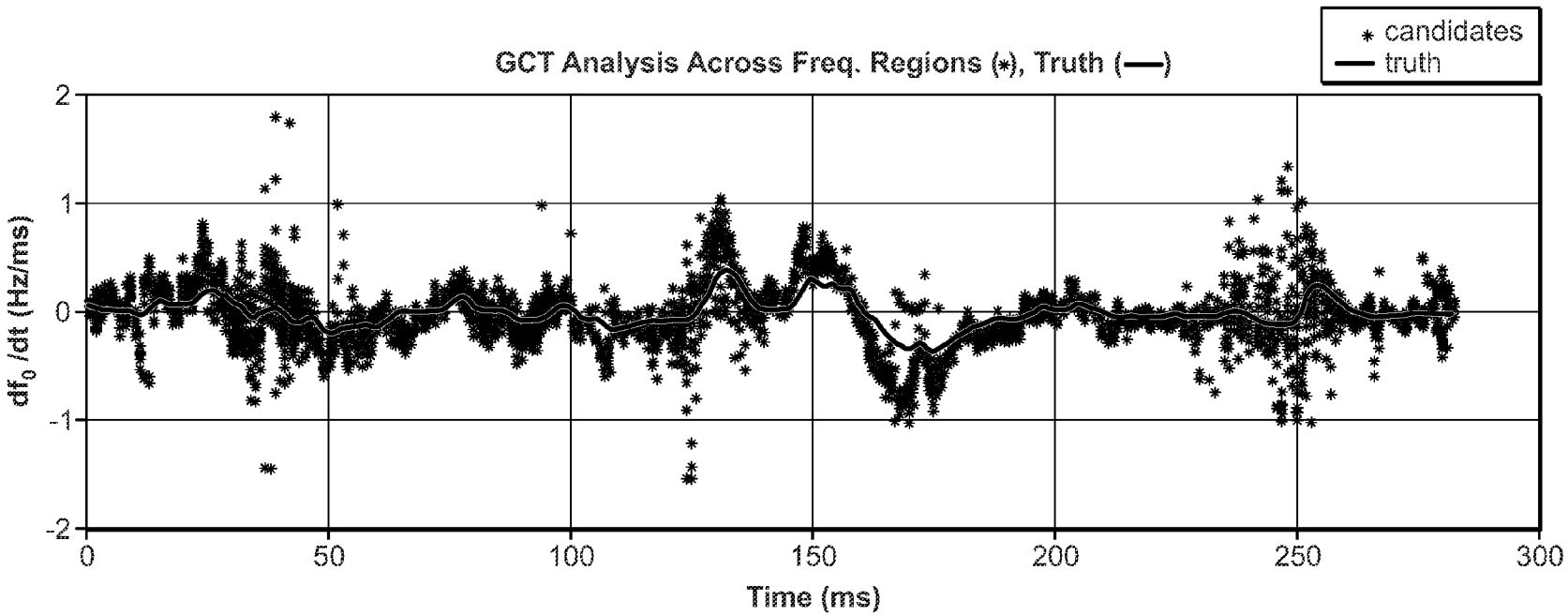

Multi-Pitch Estimation Method 2: Pattern Recognition of GCT-Based Features for Pitch Candidate Pruning FIG. 14 includes plot of candidate collections obtained across frequency regions from GCT analysis as described in the previous section "GCT-based Analysis of Multi-pitch Signals". The candidate collections generally are located within a neighborhood of approximately 20 Hz for the pitch values and approximately 0.5 Hz/ms for the pitch derivatives. As shown in FIG. 14, a number of time points exhibit candidates that are up to approximately 150 Hz away from the true pitch and approximately 1 Hz/ms from the true pitch derivative (e.g., at 250 ms). These substantial deviations highlight limitations in the underlying GCT analysis are used to obtain pitch candidates.

In relation to the multi-pitch estimation problem, certain example embodiments may apply an analysis scheme to obtain pitch. Specifically, one pitch candidate may be obtained from each time-frequency region of the short-time Fourier transform magnitude (STFTM) by first computing the GCT for the region and performing peak-picking. As an example, the STFTM on a mixture of two all-voiced sentences "Why were you away a year, Roy?" and "Nanny may know my meaning" by two distinct speakers may be computed. To assess the value of these candidates, a collection of histogram slices computed for the pitch candidates obtained across all frequency regions for a single time point of analysis may be utilized. In addition, the two reference pitch tracks of the two speakers estimated from their individual waveforms using a correlation-based pitch tracker may be employed [17].

Figures 15A, 15B, 15C, 15D:
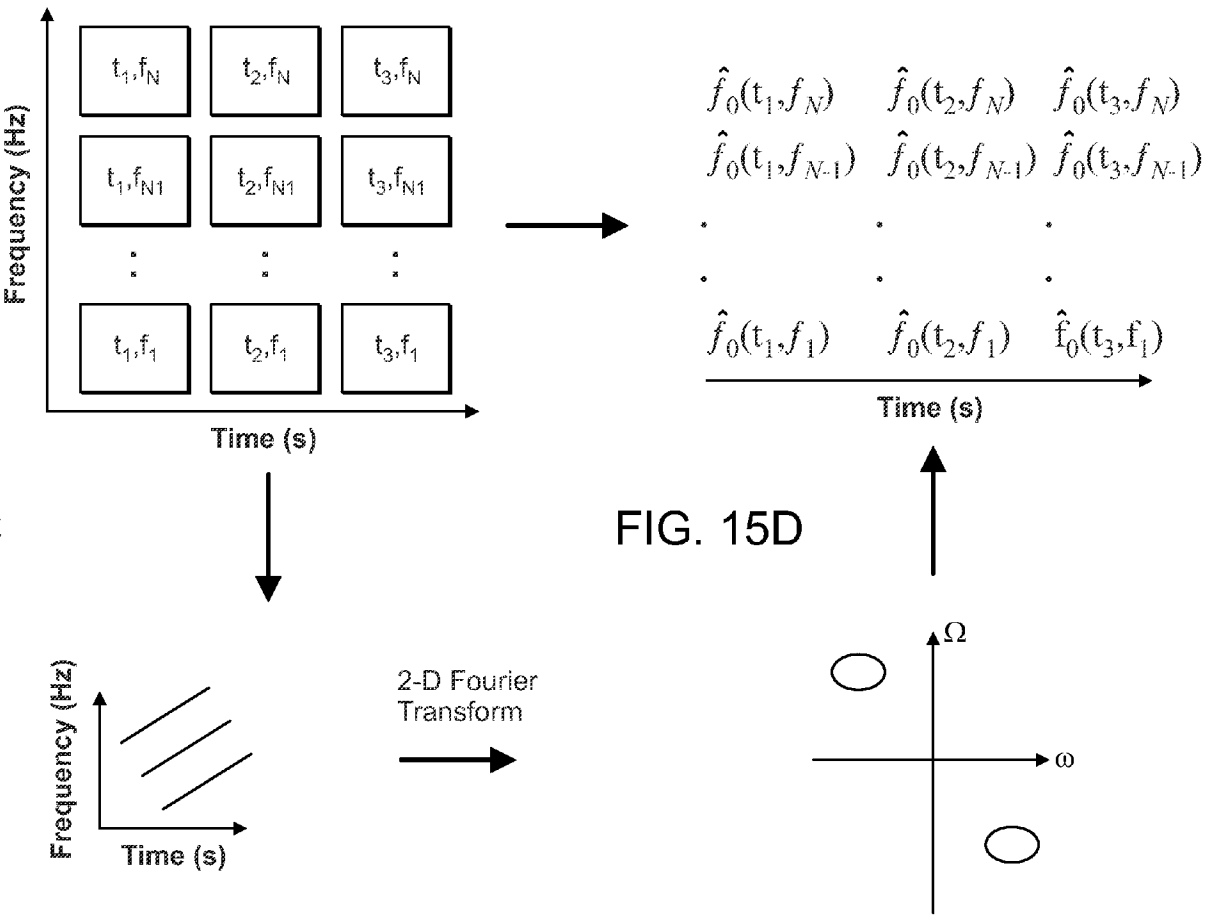
FIGS. 15*a*-15*d* includes schematics that illustrate a method for obtaining pitch candidates according to an example embodiment.

FIG. 15 is a schematic that illustrates a method for obtaining pitch candidates according to certain example embodiments. In FIG. 15*a*, the STFTM of the mixture is computed and localized time-frequency regions are analyzed using the GCT (FIG. 15*c*) and a set of pitch candidates and features are obtained across frequency regions for each time point (FIG. 15*c*).

Figure 16A:
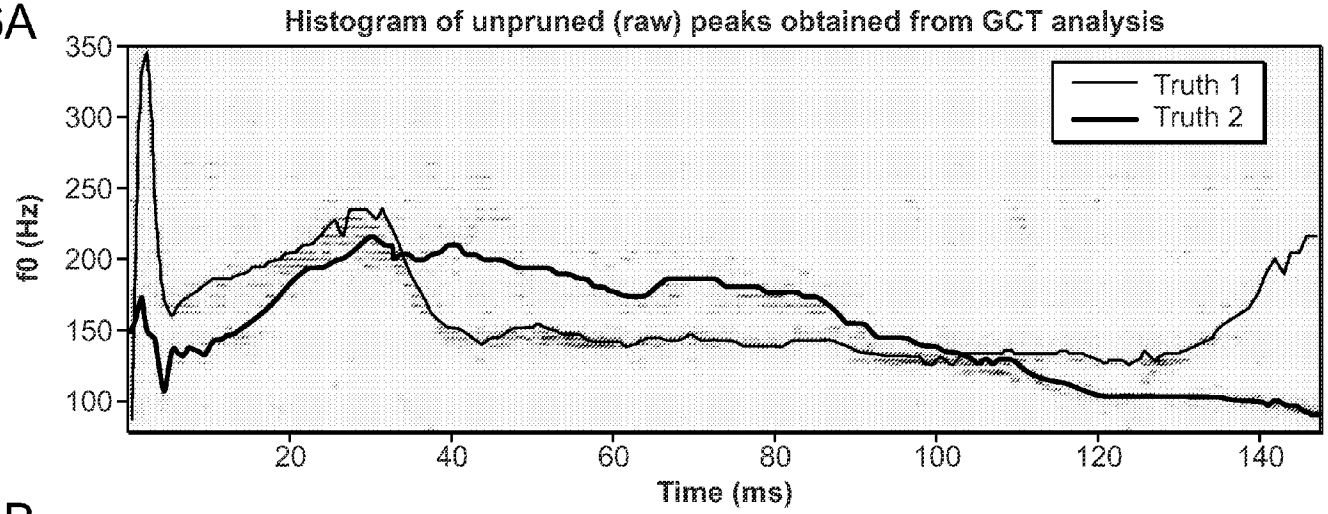
FIG. 16(*a*) illustrates a collection of histogram slices of pitch candidates and FIG. 16(*b*) illustrates a single histogram slice.
Figure 16B:
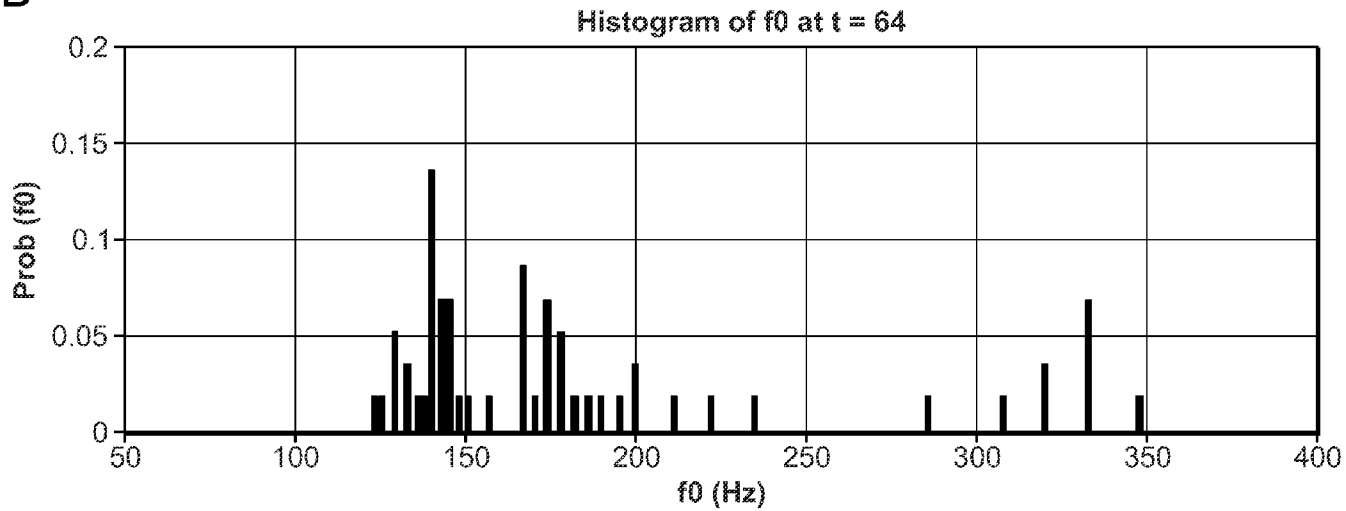
Figure 17A:
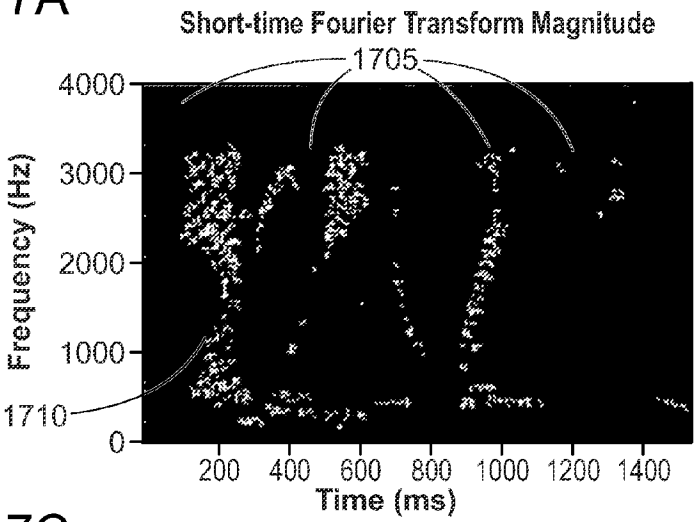
FIG. 17*a* demonstrates analysis of spectrogram of mixture and localized region.
Figure 17B:
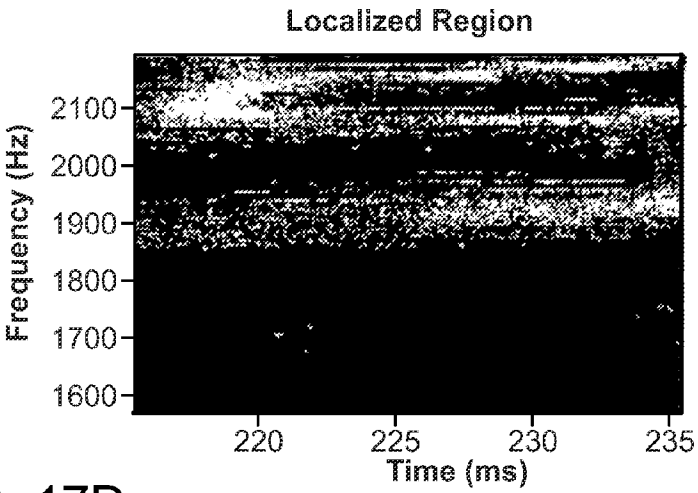
FIG. 17*b* is a zoomed-in version of localized region shown in FIG. 17*a*.
Figure 17C:
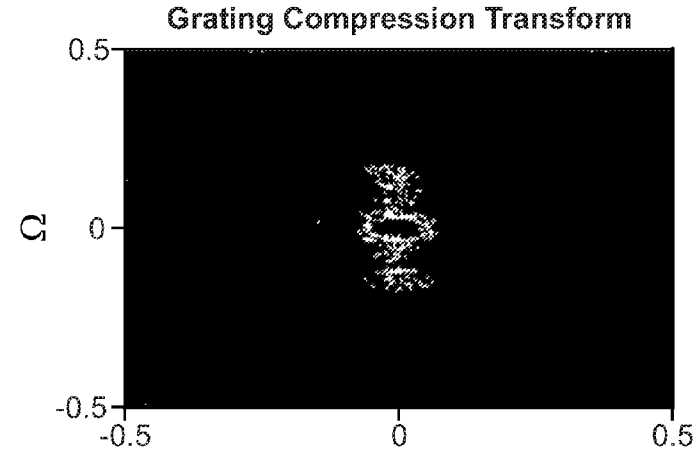
FIG. 17*c* demonstrates GCT computed without minimizing near-DC components.
Figure 17D:
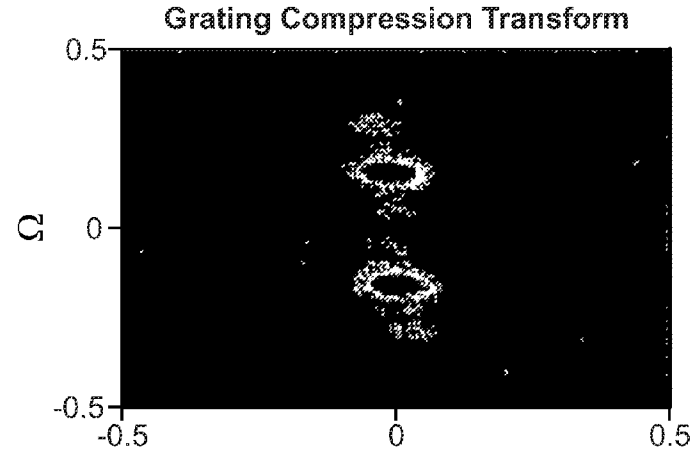
FIG. 17*d* demonstrates GCT computed with near-DC components minimized.
Figure 18A:
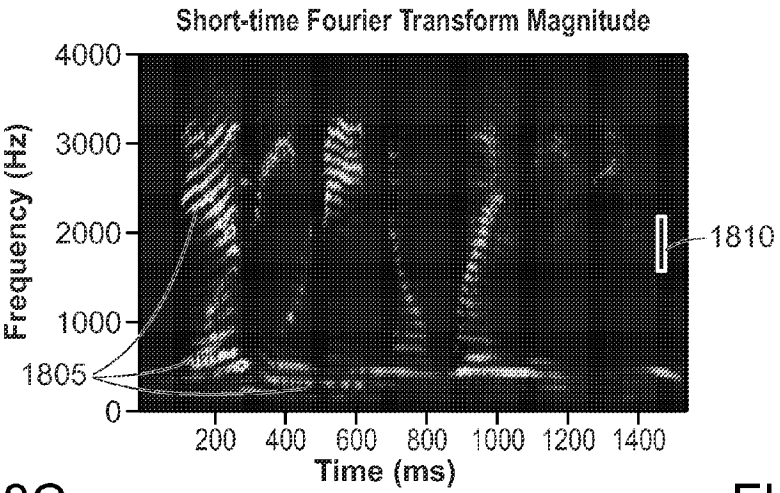
FIG. 18*a* illustrates spectrogram of analyzed mixture and localized region.
Figure 18B:
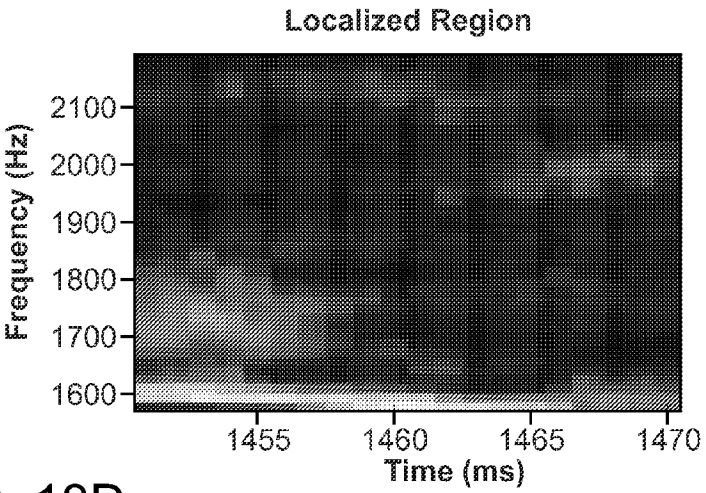
FIG. 18*b* demonstrates a zoomed-in version of the localized region of FIG. 18*a*.
Figure 18C:
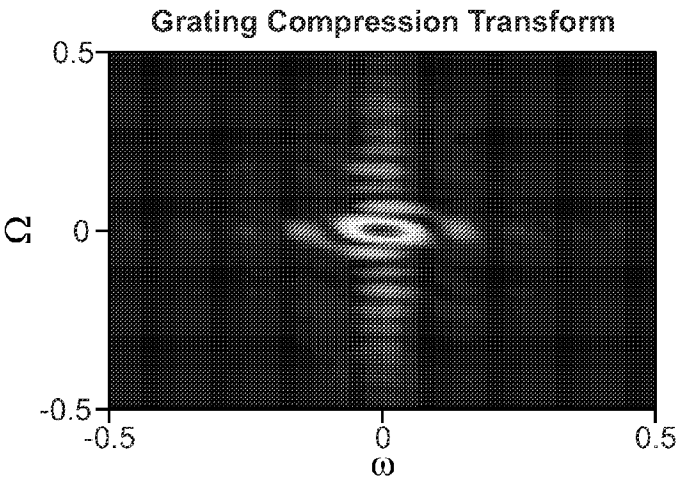
FIG. 18*c* demonstrates GCT computed without minimizing near-DC components.
Figure 18D:
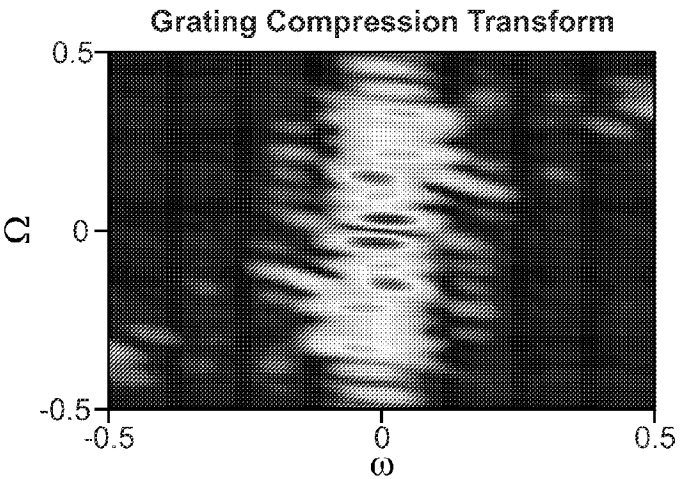
FIG. 18*d* demonstrates GCT computed with near-DC components minimized.

FIG. 16 illustrates a collection of histogram slices of pitch candidates obtained from GCT analysis (FIG. 16*a*) and a single histogram obtained at time=64 ms. Spurious candidates obtained from GCT analysis can be seen across the collection and in the individual slice (e.g., at 300~350 Hz, FIG. 16*b*).

Consistent with the single-speaker case, a number of spurious peaks can be obtained that are up to approximately 150 Hz away from the true pitch values of either speaker at time points across the mixture duration. For instance, at 64 ms, the histogram slice exhibits pitch candidates above 300 Hz while the true pitch values of the two speakers are between 150 to 200 Hz (FIG. 16). In performing pitch tracking (e.g., using a state-space model) these errors are poorly modeled with simple distributions (e.g., Gaussian in the Kalman filtering framework), which may motivated more sophisticated modeling (e.g., in a belief propagation framework). Nonetheless, as shown in FIG. 14, such an extension may also require the "noise" distributions surrounding the pitch candidates to vary with time (e.g., in FIG. 14, compare the variation of the pitch value at time=250 ms with that at time=75 ms).

To avoid this additional layer of complexity in modeling, certain example embodiments may consider an alternative approach to prune pitch candidates obtained from GCT analysis with the overall aim of improving multi-pitch tracking Specifically, using characteristics of the GCT analysis itself, it may be determined whether a pitch candidate is spurious or not spurious. The value of a data-driven approach may be assessed for peak selection.

Feature Extraction from the GCT

FIG. 17 demonstrates the GCT computed for a region in which the formant structure of one speaker in the mixture exhibits a formant peak. In FIG. 17*a*, STFTM of mixture 1705 and localized region 1710 are analyzed. FIG. 17*b* demonstrates a zoomed-in version of the localized region 1710. In FIG. 17*c*, the GCT is computed without minimizing near-DC components. FIG. 17*d* illustrates the computed GCT with near-DC components minimized.

FIG. 18 demonstrates the GCT computed for a region in which the formant structures of both speakers in the mixture exhibit formant peaks. In FIG. 18*a*, STFTM of mixture 1805 and localized region 1810 are analyzed. FIG. 18*b* demonstrates a zoomed-in version of the localized region 1810. In FIG. 18*c*, the GCT is computed without minimizing near-DC components. FIG. 18*d* illustrates the computed GCT with near-DC components minimized.

As shown in FIG. 17, the localized regions 1710 clearly contains harmonic structure from a speaker. The corresponding GCT exhibits a dominant set of peaks corresponding to these components. In contrast, in FIG. 18 demonstrates the GCT computed for a region in which the formant structure of both speakers has minimal amplitude. Specifically, FIG. 18*d* (e.g., GCT with near-DC components minimized by 2-D gradient) illustrates that a large number of peaks are present with comparable amplitudes.

Various features may be extracted from the GCT in addition to the pitch and pitch-derivative candidates. The combined features can be used to determine whether the pitch candidate is spurious or non-spurious using pattern classification techniques. For example, the following features may be extracted from each localized time-frequency region (i.e., localized region) of the STFTM from GCT analysis:

1. pitch value obtained from location of dominant peak [18],
2. pitch derivative obtained from the mapping [18],
3. magnitude value of peak corresponding to pitch value and pitch value derivative,
4. normalized magnitude value of peak,
5. signal to noise ratio of a chosen peak,
6. DC value of localized region, and
7. overall energy of localized region.

A localized region centered at $n=n_0$ and $m=m_0$ may be defined as $$s_w[n,m]==s[n-n_0,m-m_0]w[n,m] \tag{20}$$

where s[n,m] denotes the full STFTM computed for the mixture signal and w[n,m] denotes a 2-D Gaussian window. The GCT is defined as $$S_w(\omega,\Omega)=\mathrm{FT}[s_w[n,m]] \tag{21}$$

where FT denotes the 2-D Fourier transform.

Features 1-3 may be obtained from max peak-picking operation on the GCT magnitude:

$$Feature1 = f_0 = \frac{2\pi f_s}{N_{STFT}\omega_s\cos\theta} \tag{22}$$

$$Feature2 = \frac{\Delta f_0}{\Delta t} = \frac{f_0}{f_{center}}\tan\theta \tag{23}$$

$$Feature3 = |S_w(\omega = \omega_s\sin\theta,\ \Omega = \omega_s\cos\theta)|. \tag{24}$$

where $N_{STFT}$ corresponds to the discrete-Fourier transform length used in computing the STFTM, $f_s$ is the sampling frequency of the waveform, and $f_{center}$ is the center frequency of the localized region. $\omega_s\cos\theta$ and $\omega_s\sin\theta$ correspond to the location of the peak along the $\omega$ and $\Omega$-axes of the GCT magnitude; $\theta$ is the angle between the peak location and the $\Omega$-axis [18].

For Feature 4, the peak magnitude value is normalized by the sum of all magnitudes in the GCT:

$$Feature4 = \frac{Feature3}{\iint_{\omega,\Omega}|S_w(\omega,\ \Omega)|} \tag{25}$$

For Feature 5, a signal-to-noise ratio (SNR) is computed as $$Feature5 = 10\log_{10}\frac{\sum_n\sum_m|K\cos(\Phi[n,m])w[n,m]|^2}{\sum_n\sum_m|s[n-n_0,m-m_0]w[n,m]|^2-\sum_n\sum_m|K\cos(\Phi[n,m])w[n,m]|^2}. \tag{26}$$

where $\Phi[n,m]=2\pi\omega_s(n\cos\theta+m\sin\theta)+\phi$ and $\Phi[n,m]$ is determined from the location of the GCT peak used in obtaining Features 1 and 2. The term K is similarly determined from the magnitude of this GCT peak [18, 21].

Finally, Features 6 and 7 are computed as $$Feature6 = |S_w(\omega = 0,\ \Omega = 0)| \tag{27}$$

$$Feature7 = \iint_{\omega,\Omega}|S_w(\omega,\ \Omega)|^2. \tag{28}$$

Pattern Recognition for Pitch Candidate Selection

Certain example embodiments provide for pitch candidate selection using pattern recognition techniques. A training set of data may be employed to obtain a transformation that allows for a simple hypothesis test to determine whether a pitch candidate is spurious or not spurious based on the features derived from GCT analysis. This transformation is then applied to the results of GCT analysis performed on a testing data set.

To obtain the transformation, features are generated using GCT analysis. Specifically, assuming that $\underline{x}_{t_i,f_k}$ is a feature vector obtained from a localized region in the $k^{th}$ frequency band at time $t_i$ (FIGS. 14 and 16) and $\hat{f}_{0,i,k}=\underline{x}_{t_i,f_k}(1)$ denote its corresponding pitch candidate, the collection of all $\underline{x}_{t_i,f_k}$ across the training set in time are grouped into spurious and not spurious candidates based on the absolute difference between the candidate pitch value and the true pitch value of either speaker. A feature vector $\underline{x}_{t_i,f_k}$ is labeled spurious (i.e., sp) if $$\min(|\hat{f}_{0,i,k}-f_{01,i}|,|\hat{f}_{0,i,k}-f_{02,i}|)>\epsilon \tag{29}$$

where $f_{01,i}$ and $f_{02,i}$ are the true pitch values of the two speakers at time i and $\epsilon$ is a threshold value. Otherwise, $\underline{x}_{t_i,f_k}$ is labeled not spurious (i.e., nsp). The term $\epsilon$ is chosen to be 20 Hz and is motivated from the observations regarding pitch candidates obtained from the GCT (e.g., FIGS. 14 and 16).

A linear discriminative analysis (LDA) may be performed to obtain a transformation that maps $\underline{x}_{t_i,f_k}$ to a single value $y_{t_i,f_k}$ to be used in a hypothesis testing/classification framework, i.e., $$y_{t_i,f_k}=\underline{w}^T\underline{x}_{t_i,f_k} \tag{30}$$

LDA obtains the transformation $\underline{w}$ that maximizes $$J(\underline{w}) = \frac{|\tilde{m}_{sp}-\tilde{m}_{nsp}|^2}{\tilde{s}_{sp}^2+\tilde{s}_{nsp}^2} \tag{31}$$

where $\tilde{m}_{sp}$, $\tilde{m}_{nsp}$, and $\tilde{s}_{sp}$, $\tilde{s}_{nsp}$ are the means and standard deviations of the transformed features (i.e., $\underline{x}_{t_i,f_k}$'s) in the training data [22].

Figure 19:
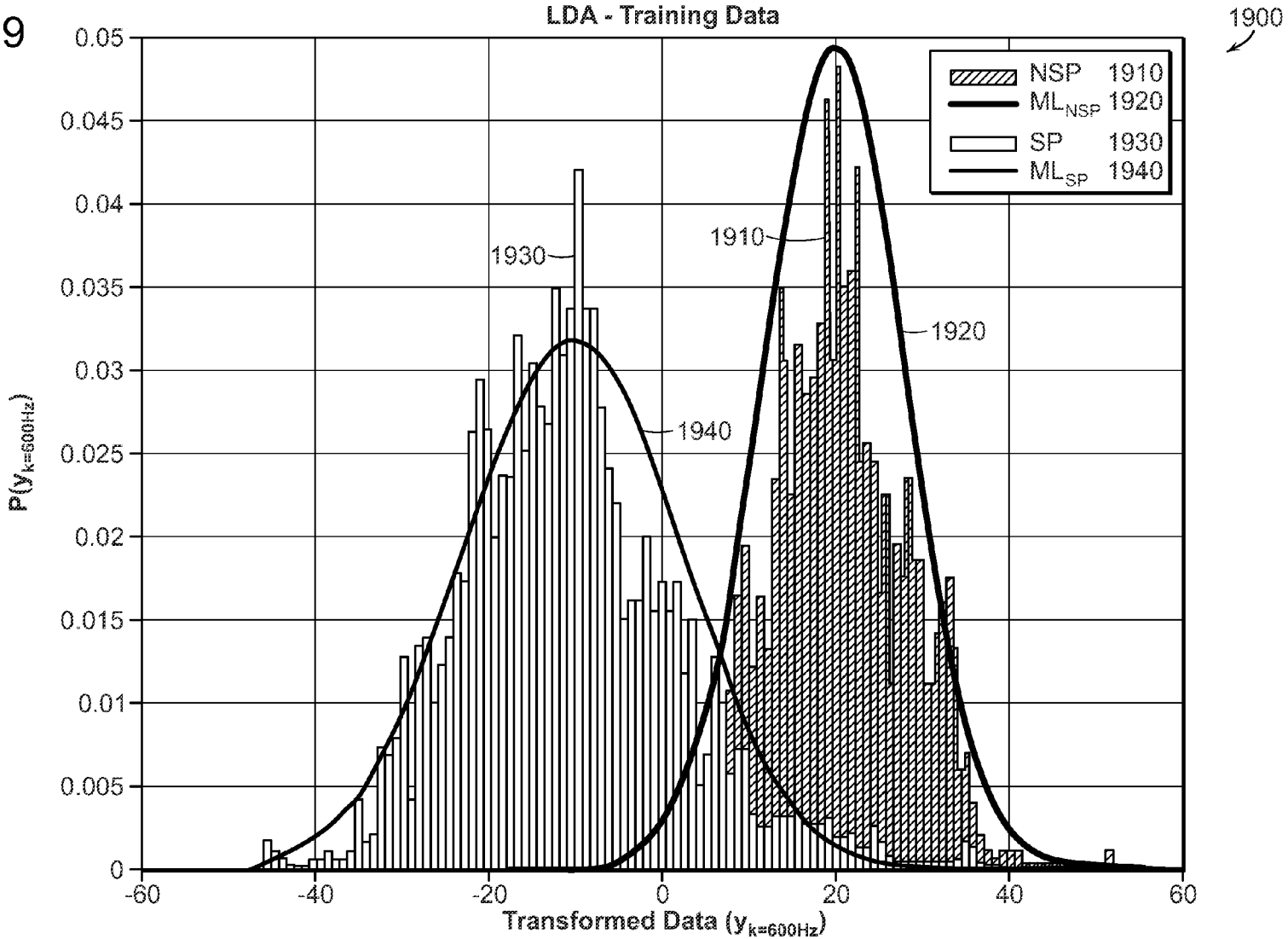
FIG. 19 includes results of LDA analysis of features on training data and maximum-likelihood fits to Gaussian distributions.

FIG. 19 includes results of LDA analysis of features on training data and maximum-likelihood fits for two classes (nsp 1910 and sp 1930). In FIG. 19, histograms computed for the two classes (nsp 1910 and sp 1930) of the transformed training data for a frequency band centered at 600 Hz are illustrated. In addition, the maximum-likelihood fits ($ML_{NSP}$ 1920 and $ML_{SP}$ 1940) to single Gaussians of these data are also illustrated. These fits 1920, 1940 are subsequently used in testing for classification using a hypothesis testing framework. Specifically, a feature vector $\underline{x}'_{t_i,f_k}$ obtained from the testing data is mapped to $y'_{t_i,f_k}$ by $\underline{w}$, i.e., $$y'_{t_i,f_k}=\underline{w}^T\underline{x}'_{t_i,f_k}. \tag{32}$$

$y'_{t_i,f_k}$ is then classified as "not spurious" (nsp) if $$\frac{p(y'_{t_i,f_k}\mid nsp_{f_k})}{p(y'_{t_i,f_k}\mid sp_{f_k})} > \frac{p(sp_{f_k})}{p(nsp_{f_k})} \tag{33}$$

and "spurious" (sp) if $$\frac{p(y'_{t_i,f_k}\mid nsp_{f_k})}{p(y'_{t_i,f_k}\mid sp_{f_k})} < \frac{p(sp_{f_k})}{p(nsp_{f_k})} \tag{34}$$

to minimize the probability of error [22]. Here, $p(y'_{t_i,f_k}|nsp_{f_k})$ and $p(y'_{t_i,f_k}|sp_{f_k})$ are the frequency band-wise single-Gaussian fits obtained in training Similarly, $p(sp_{f_k})$ and $p(nsp_{f_k})$ are the band-wise priors estimated from the training data.

Evaluation and Results

An example training set includes 40 mixtures of two all-voiced sentences ("Nanny may know my meaning"+"Why were you away a year, Roy?") spoken by distinct speakers. A similar set of 40 mixtures is obtained for the two all-voiced sentences in the testing set. However, speakers in the training set are distinct from those in the testing set. True pitch tracks for each individual speaker are obtained a priori using a correlation-based pitch estimator as in [18].

Figure 20:
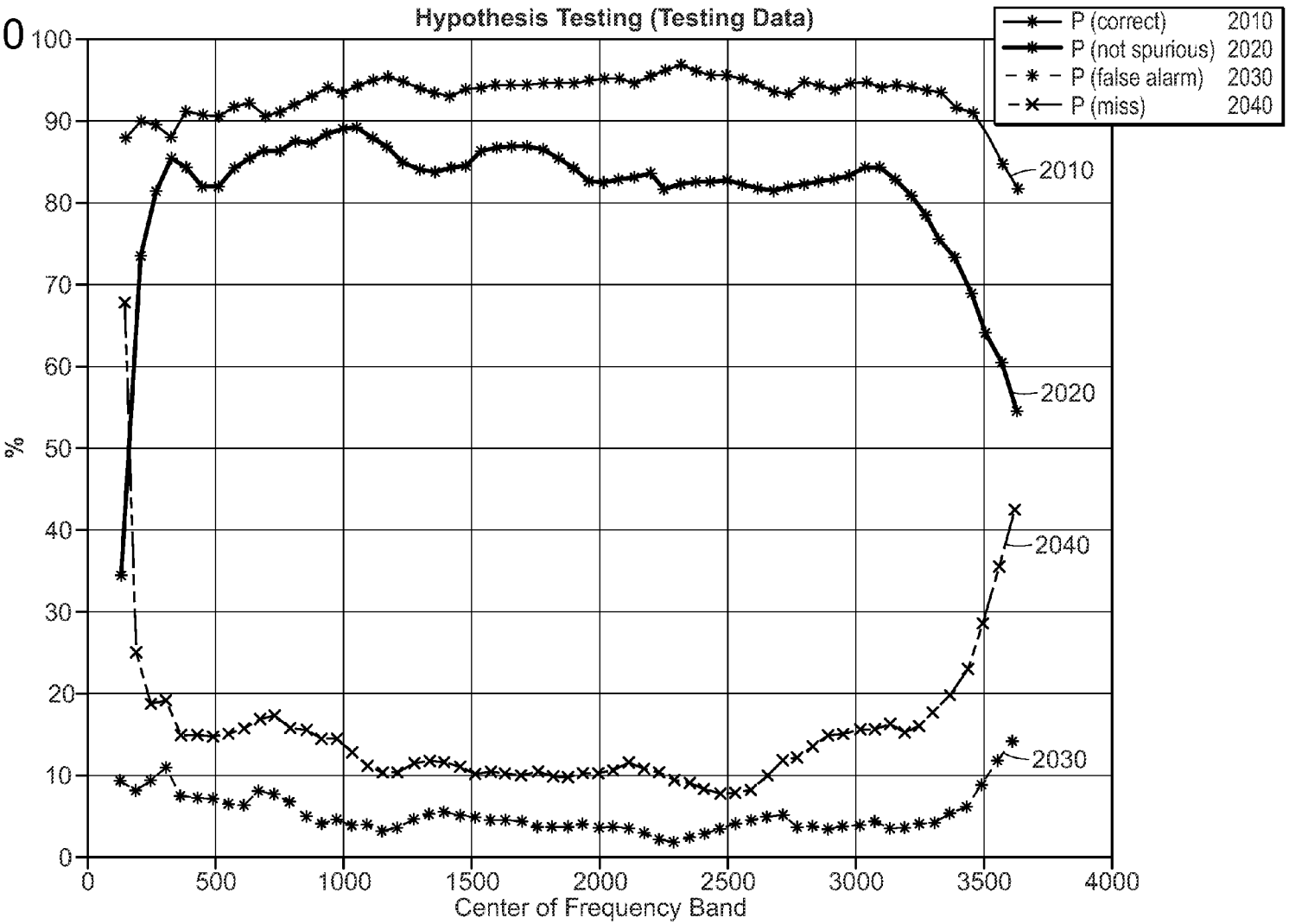
FIG. 20 includes plots of performance metrics obtained using a hypothesis testing framework on testing data.

FIG. 20 includes plots obtained using a hypothesis testing framework on testing data. Specifically, FIG. 20 includes a plot of band-wise classification accuracy 2010 obtained using a hypothesis testing framework on testing data (i.e., the transformed features from GCT analysis) as well as plots of probability of falsely detecting a not-spurious candidate 2030 (false alarm), the probability of a miss 2040 (i.e., missing a "not-spurious" candidate), and the prior probability of a not-spurious peak 2020. As shown in FIG. 20, the candidate selection technique 2010 exhibits a classification accuracy exceeding 90%. Furthermore, inverting the probability of misses results in an approximate 80% detection probability.

Figure 21A:
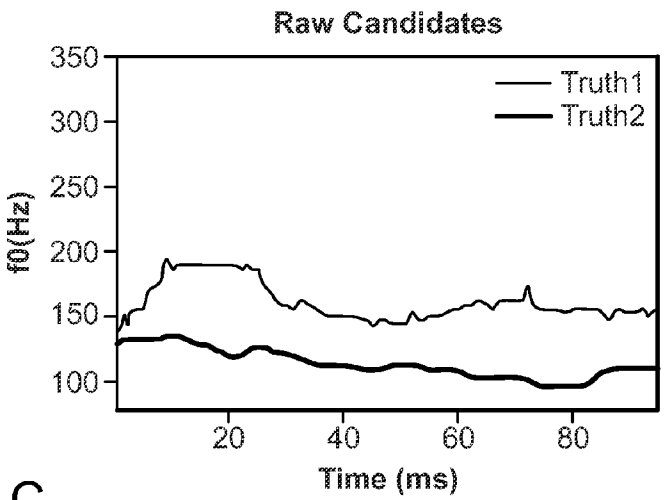
FIGS. 21*a*-21*d* include histogram plots of pitch candidates.
Figure 21B:
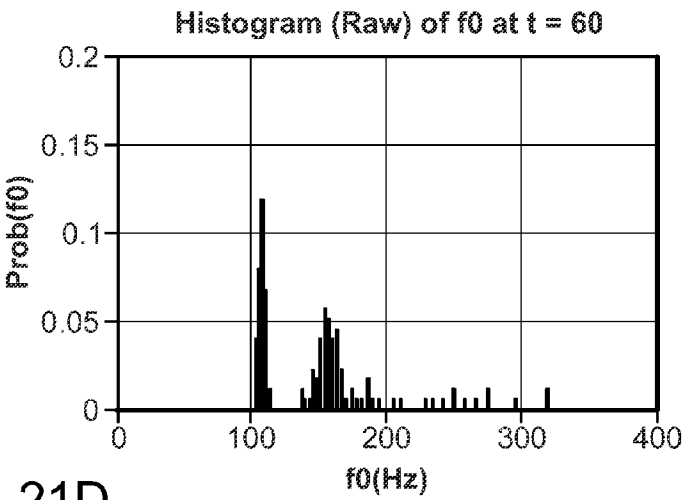
Figure 21C:
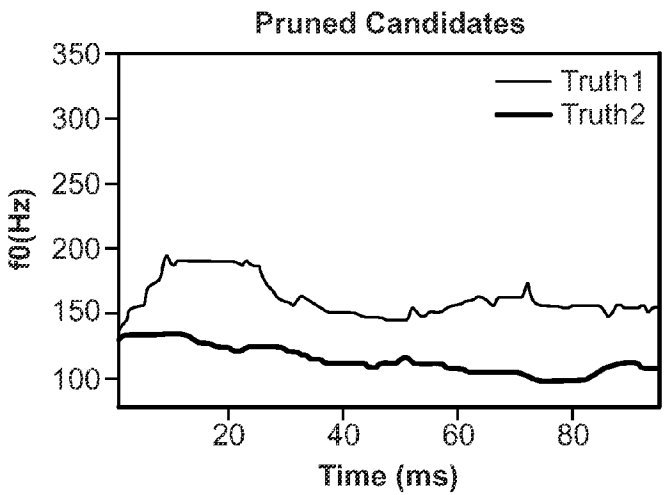
Figure 21D:
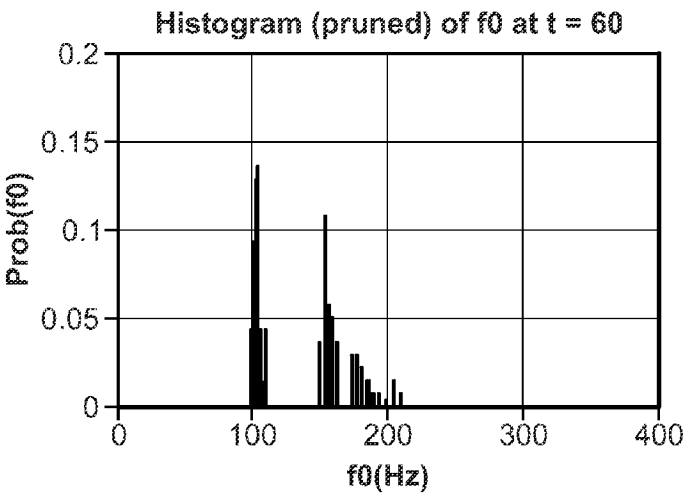

FIG. 21*a* is an illustration of collected histogram slices of raw pitch candidates. FIGS. 21(*a*) and 21(*b*) include raw pitch candidates and their corresponding histogram and FIGS. 21(*c*) and 21(*d*) include pruned pitch candidates using collections of histogram slices. At t=60, the true pitch values are about 156 Hz and 108 Hz. Observe that the pruned pitch candidates (FIG. 21*c*) exhibit fewer spurious candidates with substantially different (e.g., >20 Hz absolute difference) than the raw candidates (FIG. 21*b*). These results highlight the utility of the candidate selection method in improving the quality of candidates and is consistent with the empirical performance metrics of the hypothesis testing framework (FIG. 20). Furthermore, the results suggest that the pitch candidates selected from this method offer an improved basis for pitch estimation.

Clustering Techniques

To assess the value of the candidate selection method in multi-pitch estimation, certain example embodiments of the present invention may apply two simple clustering methods to generate pitch tracks of individual speakers. Candidates across both time and frequency regions are combined to form a set of candidates for a single time point and a simple median-based cluster is employed to select the pitch value at a point in time for both speakers. In the second method, a k-means clustering scheme is used. Both methods are applied to the pruned and raw pitch candidates.

To quantitatively assess the results, the pitch error metrics may be computed as in [8]. Specifically, a gross error may be defined as the condition where either assigned pitch value for a time point differs from the true pitch values by more than 20%:

$$\max\left(\frac{|\hat{f}_{0,i,k}-f_{01,i}|}{f_{01,i}},\ \frac{|\hat{f}_{0,i,k}-f_{02,i}|}{f_{02,i}}\right) > 0.2. \tag{35}$$

The total gross error (E_gross) is the percentage of time points across the entire mixture exhibiting a gross error. For time points in which there is no gross error, a fine error is computed based on the sum of percent errors between the two assigned pitch values and the true pitch values, i.e., $$FineError = 100\left(\frac{|\hat{f}_{0,i,k}-f_{01,i}|}{f_{01,i}}+\frac{|\hat{f}_{0,i,k}-f_{02,i}|}{f_{02,i}}\right) \tag{36}$$

The total fine error is the average of fine errors across all time points in the mixture (E_fine) and the total error (E_total) is the sum of the total gross and fine errors, i.e., $$E_total=E_fine+E_gross \tag{37}.$$

Figure 22A:
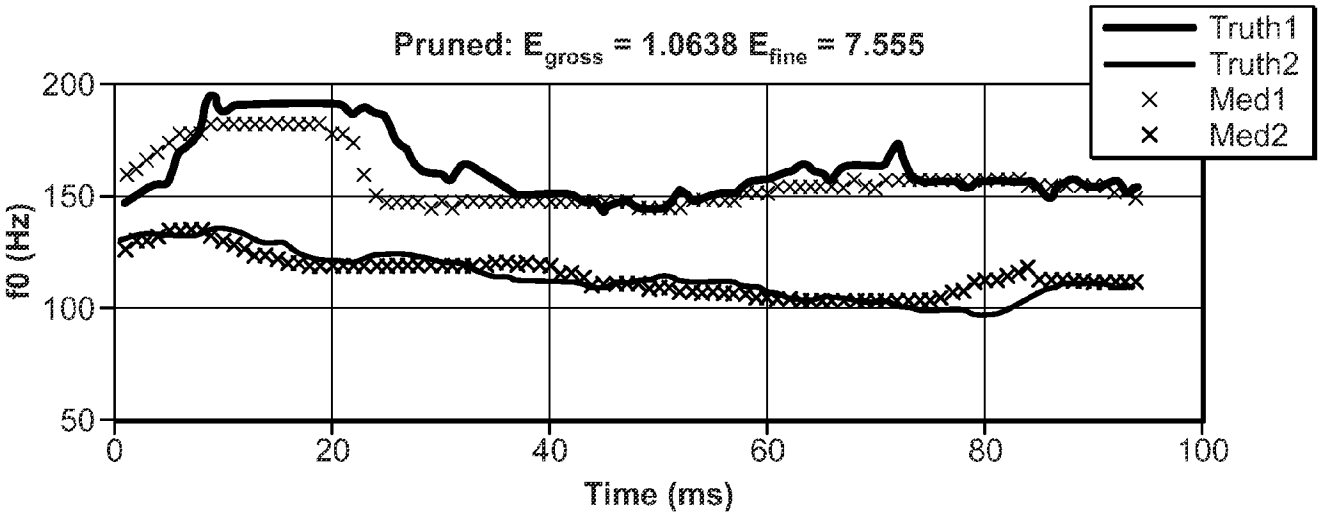
FIGS. 22*a*-22*b* include examples of pruned (FIG. 22*a*) and raw (FIG. 22*b*) pitch candidates and resulting median-based clustering method to assign pitch candidates to time points.

FIG. 22 illustrates an example of pruned and raw pitch candidates and resulting median-based clustering method to assign pitch candidates to time points.

Figure 23A:
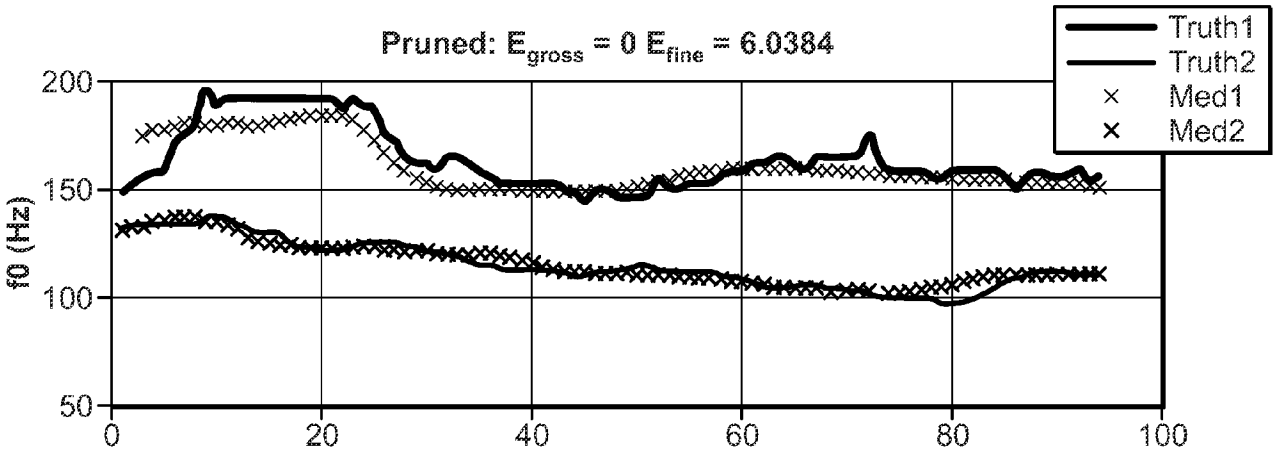
FIG. 23*a*-23*b* illustrate examples of pruned (FIG. 23*a*) and raw (FIG. 23*b*) pitch candidates and resulting k-means clustering method to assign pitch candidates to time points.

FIG. 23 illustrates an example of pruned and raw pitch candidates and resulting k-means clustering method to assign pitch candidates to time points.

Figure 22B:
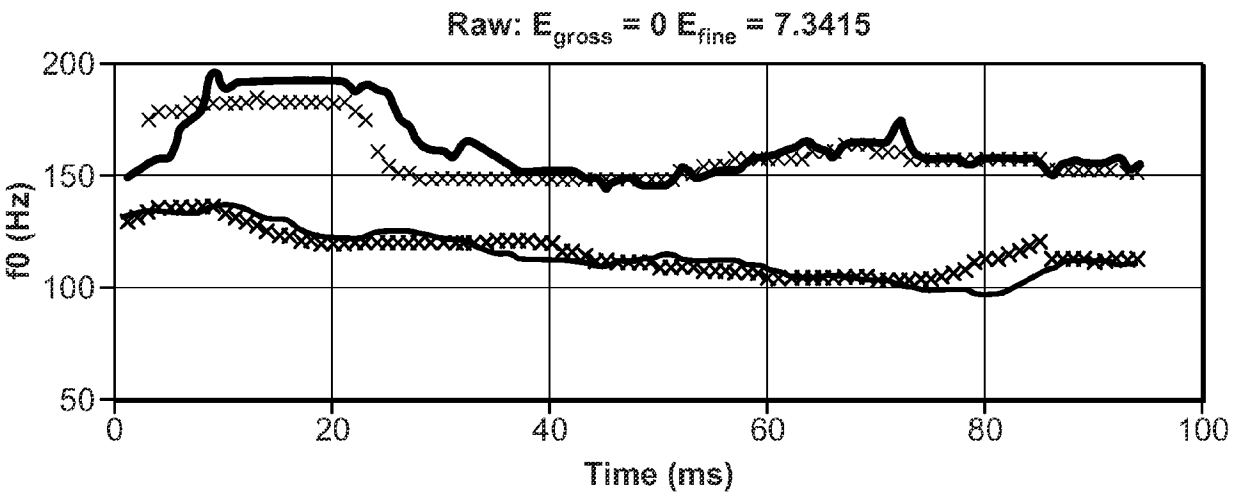
Figure 23B:
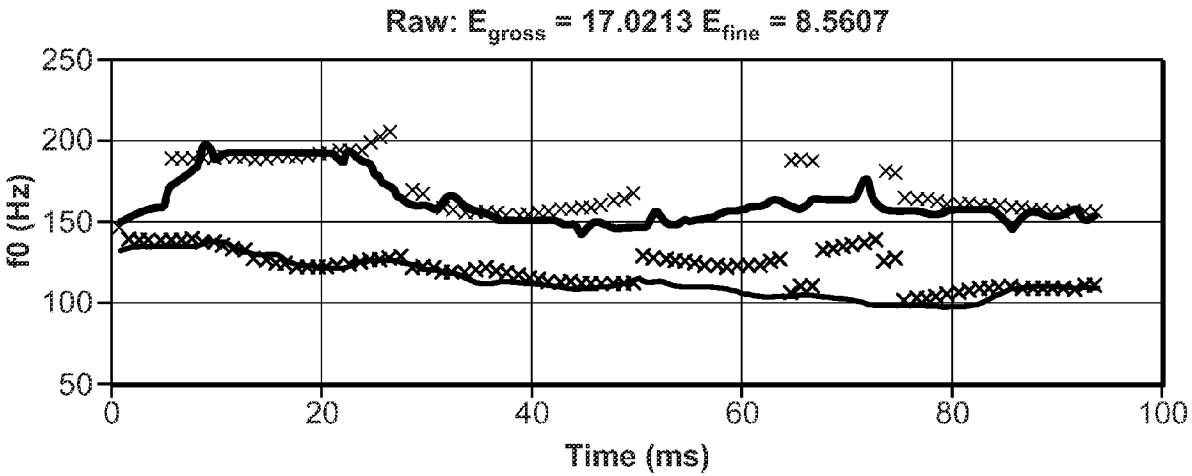

For multi-pitch tracking, the median-based clustering that prunes candidates (FIG. 22*a*) provides higher fine and gross errors than median-based clustering using the raw candidates (FIG. 22*b*). In contrast, the k-means clustering results in smaller fine and gross errors for the pruned candidates (FIG. 23*a*) than clustering based on the raw candidates (FIG. 23*b*).

Figures 24, 25, 26A:
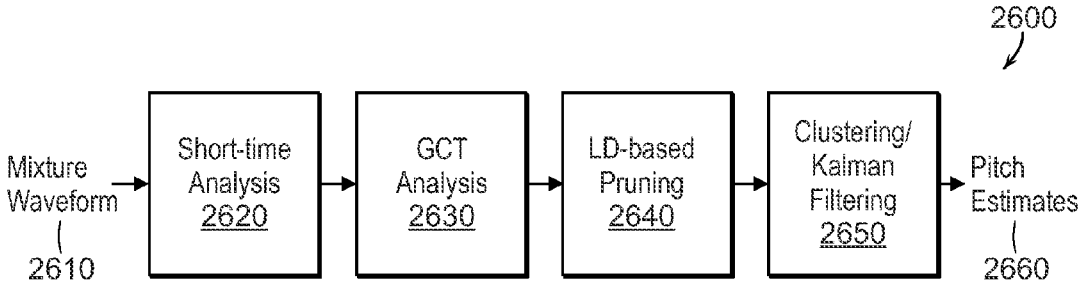
FIG. 24 includes a table of average metrics across all test mixtures for a median clustering method.
FIG. 25 includes a table of average metrics across all test mixtures for a k-means clustering method.
FIG. 26A is an illustration of a multi-pitch estimation method that employs clustering and Kalman filtering.

FIG. 24 includes a table of average metrics across all test mixtures for the median clustering method. Specifically, average E_gross 2410, E_fine 2420, and E_total 2430 (E_total=E_fine+E_gross) between median-based clustering using pruned candidates 2440 versus clustering based on raw candidates 2450 are shown. Similarly, FIG. 25 includes a table of average metrics across all test mixtures for the median clustering method. Specifically, average E_gross 2510, E_fine 2520, and E_total 2530 (E_total=E_fine+E_gross) between median-based clustering using pruned candidates 2540 versus clustering based on raw candidates 2550 are shown.

As shown in FIGS. 24-25, the pruned candidates provide an approximate 9% gross error reduction on average relative to the raw candidates for either clustering method. However, in k-means clustering, average fine errors are increased relative to median-based clustering (7.04% versus 6.45%). Overall, in this example, the best performing method appears to be k-means clustering of the pruned candidates with an average total error 12.62%, thereby demonstrating the potential value of the pitch candidate pruning method.

Therefore, by extracting features motivated from observations of the GCT space and combining them with pattern classification methods, an improved set of pitch candidates can be obtained. Using simple clustering methods for pitch tracking, improvements in fine and gross errors in multi-pitch estimation can be achieved using the results of pitch candidate selection.

Multi-Pitch Estimation Using a Joint 2-D Representation of Pitch and Pitch Dynamics The model of localized time-frequency region s[n,m] (discrete-time and frequency n,m) of a narrowband STFT log-magnitude computed for a single voiced utterance. A simple model of the harmonic structure in s[n,m] is a 2-D sinusoid resting on a DC pedestal:

$$s[n, m] \approx \alpha[n, m]\left(1 + \sum_{k=1}^{N} \alpha_k \cos\phi_k [n.m]\right) \tag{38}$$

$$\Phi[n, m] \approx \omega_s(n\cos\theta + m\sin\theta) + \varphi$$

where $\omega_s$, $\theta$, $\phi$, and $\alpha$ correspond to the frequency, orientation, phase, and amplitude of the 2-D sinusoid, respectively. The GCT is the 2-D Fourier transform of s[n,m] given by $$S(\omega, \Omega) = 2\pi K\delta(\omega, \Omega) + 2\pi\delta(\omega + \omega_s\sin\theta, \Omega - \omega_s\cos\theta) + 2\pi\delta(\omega - \omega_s\sin\theta, \Omega - \omega_s\cos\theta). \tag{39}$$

Denoting $f_{sp}$ as the waveform sampling frequency and $N_{STFT}$ as the discrete-Fourier transform (DFT) length of STFT, the speaker's pitch $f_0$ at the center (in time) of s[n,m] is related to $\omega_s \cos\theta$ through [10]

$$f_0 = \frac{2\pi f_{sp}}{N_{STFT}(\omega_s\cos\theta)} \tag{40}$$

A shift in $f_0$ ($\Delta f_0$) across a duration of $\Delta n$ in s[n,m] results in an absolute frequency shift of the $k_{th}$ pitch harmonic by $k\Delta f_0$. Therefore, within s[n,m]:

$$\tan\theta \approx \frac{k\Delta f_0}{\Delta n}. \tag{41}$$

Using $f_0$ from (40), k may be approximated as $k \approx f_{center}/f_0$ (shown in FIG. 1c(a)). The rate of change of $$f_0\left(\frac{\delta f_0}{\delta t}\right)$$

is:

$$\frac{\delta f_0}{\delta t} \triangleq \frac{\Delta f_0}{\Delta n} = \frac{f_0\tan\theta}{k f_0}. \tag{42}$$

Extending the model of (38) to the condition of N speakers in s[n,m], the localized time-frequency region may be approximated as:

$$s[n, m] \approx \sum_{i=1}^{N} [K_i + \alpha_i\cos(\Phi_i[n, m])] \tag{43}$$

$$\Phi[n, m] = \omega_s(n\cos\theta + m\sin\theta) + \varphi.$$

Such that the GCT is:

$$S(\omega, \Omega) = 2\pi\sum_{i=1}^{N} K_i\delta(\omega, \Omega) + \pi\sum_{i=1}^{N} K_i\delta(\omega + \omega_s\sin\theta, \Omega - \omega_s\cos\theta) + \pi\sum_{i=1}^{N} K_i\delta(\omega - \omega_s\sin\theta, \Omega + \omega_s\cos\theta) \tag{44}$$

The GCT therefore jointly represents both pitch and pitch derivative information distinctly for each speaker.

FIG. 26A is an illustration of a multi-pitch estimation method 2600 for a mixed waveform 2610 that employs clustering and Kalman filtering. The multi-pitch estimation method 2600 includes short-time analysis 2620, GCT analysis 2630, discriminate-based pitch candidate pruning 2640, and a clustering and Kalman filtering framework 2650.

Figure 26B:
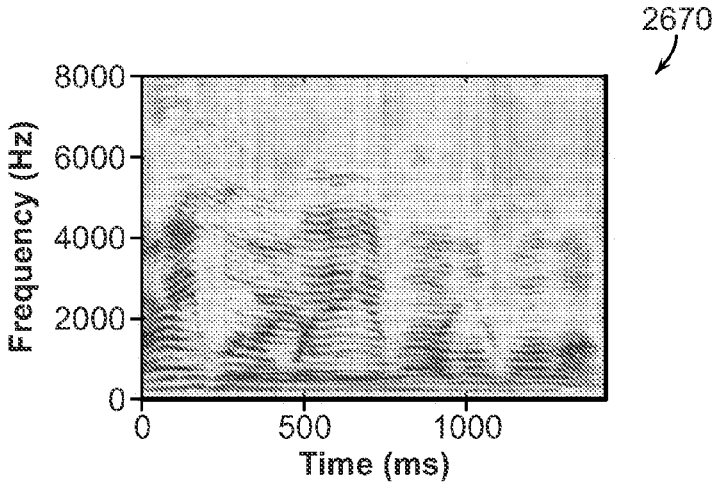
FIG. 26B is a plot of log of narrowband short-time Fourier Transform magnitude of mixture of "Walla Walla" and "Lawyer" sentences spoken by a male and female speaker.

Mixture waveforms 2610 may be analyzed using the short-Time Fourier transform (STFT) 2620 to form the log spectrogram. In certain embodiments, a 32-ms Hamming window, 1-ms frame interval, and 512-point discrete Fourier transform (DFT) may be used to compute the STFT, denoted as log-STFTM. A representative log-STFTM 2670 computed for a mixture of the "Walla Walla" and "Lawyer" sentences spoken by two female speakers is shown in FIG. 26B. Specifically, the "lawyer" and "Walla Walla" sentences were selected from sentences s5 and s6 of the following sentences:

s1—"May we all learn a yellow lion roar."
s2—"Why were you away a year, Roy?"
s3—"Nanny may know my meaning"
s4—"I'll willingly marry Marilyn."
s5—"Our lawyer will allow your rule."
s6—"We were away in Walla Walla."
s7—"When we mow our lawn all year."
s8—"Were you weary all along?"

STFTM results may subsequently be used for GCT analysis 2630. A 2-D high-pass filter was applied to log-STFTM to reduce the effects of the DC components in the GCT representation and is denoted as $STFTM_{HP}$ [6]. Localized regions of size 800 Hz by 100 ms may be extracted using a 2-D Hamming window from the magnitude of both log-STFTM and log-$STFTM_{HP}$. Overlap factors of 10 and 4 may be used along the time and frequency dimensions and result in a set of center frequencies for GCT analysis along the frequency axis and overlapped regions for analysis in time. A 2-D DFT of size 512 by 512 may be used to compute two GCT's: $GCT_M$ (from log-STFTM) and $GCT_M$ ($STFTM_{HP}$). Seven features may be extracted:

1. Pitch estimate $\hat{f}_0$ from peak-picking the dominant peak in the magnitude of $GCT_{HP}$ ($|GCT_{HP}|$) and Equation (40).
2. Pitch-derivative estimate $\partial\hat{f}_0/\partial t$ obtained from Equation (42) from the dominant peak in $|GCT_{HP}|$
3. Amplitude of the dominant peak in $|GCT_{HP}|$
4. Normalized value of the amplitude of the dominant peak in $|GCT_{HP}|$
5. "Harmonic to noise ratio" of dominant peak in $|GCT_{HP}|$
6. DC value of $GCT_M$
7. Overall energy of $GCT_M$ Feature 4 may be computed as:

$$\text{Feature 4} = \frac{\text{Feature 3}}{\iint |GCT_{HP}(\omega, \Omega)|} \tag{45}$$

Feature 5 may be computed as:

$$\text{Feature 5} = 10\log10\frac{\sum_n \sum_m |\alpha\cos(\Phi(n, m))|^2}{\sum_n \sum_m |s[n, m]|^2 - \sum_n \sum_m |\alpha\cos(\Phi(n, m))|^2}, \tag{46}$$

where $\alpha$=Feature 3 and s[n,m] corresponds to the localized region of log-STFTM.

Features 3-7 relate to properties of the GCT not captured by the pitch and pitch-derivative and are used in pitch candidate pruning 2640.

GCT analysis of multi-pitch signals may result in $\hat{f}_0$ far removed from the true pitch value (denoted as $f_0$), presumably from regions in which harmonic structure exhibits low amplitudes or substantial overlap from multiple speakers [19]. To account for these "spurious" candidates, linear discriminate analysis (LDA) [22] may be applied to the previously described set of 7 features to prune the candidates (LD-based pruning 2640). In training, certain embodiments define a "spurious" candidate as one in which $|\hat{f}_0-f_0|>\delta$. The term $\delta$ is set to, $3\sigma$ where $\sigma$ is the standard-deviation of the one-step differences in the pitch values of the training data. In one example embodiment $\sigma$=4.85 Hz. A discriminate function is trained for each center frequency in GCT analysis and applied in a band-wise fashion to prune the candidates.

Figure 26C:
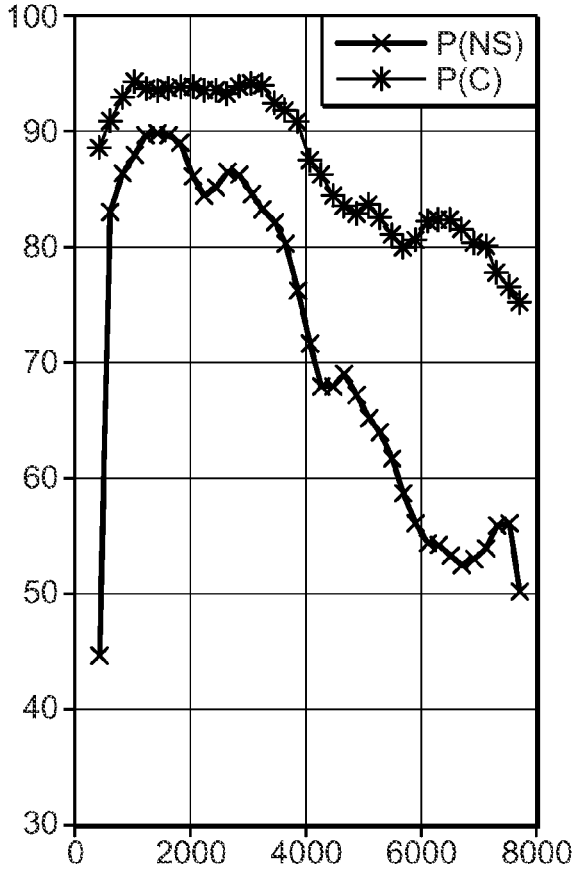
FIG. 26C is an illustration of band-wise classification performance of linear discriminate analysis on test data.
Figure 26D:
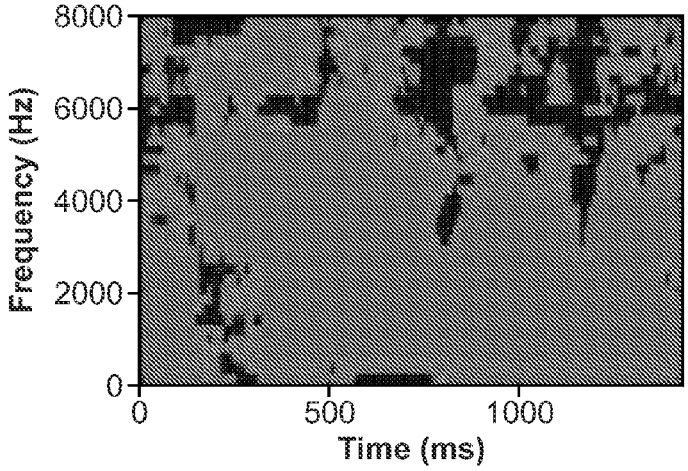
FIG. 26D is an illustration of resulting binary mask of pruning of the plot shown in FIG. 27A with 1's and 0's.
Figure 27A:
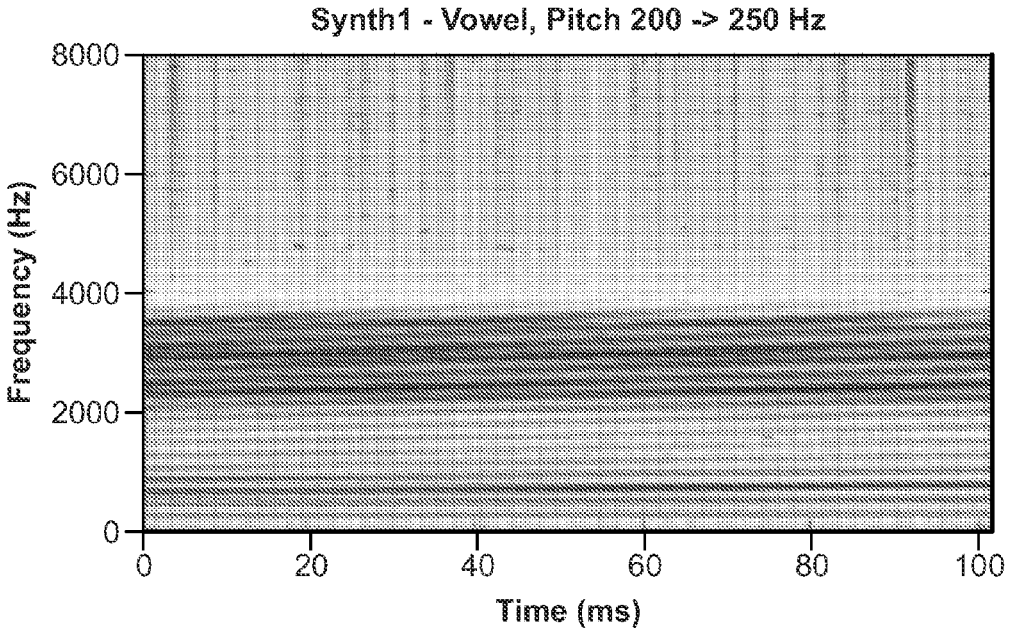
FIGS. 27A-27D are four spectrograms of synthetic signals.
Figure 27B:
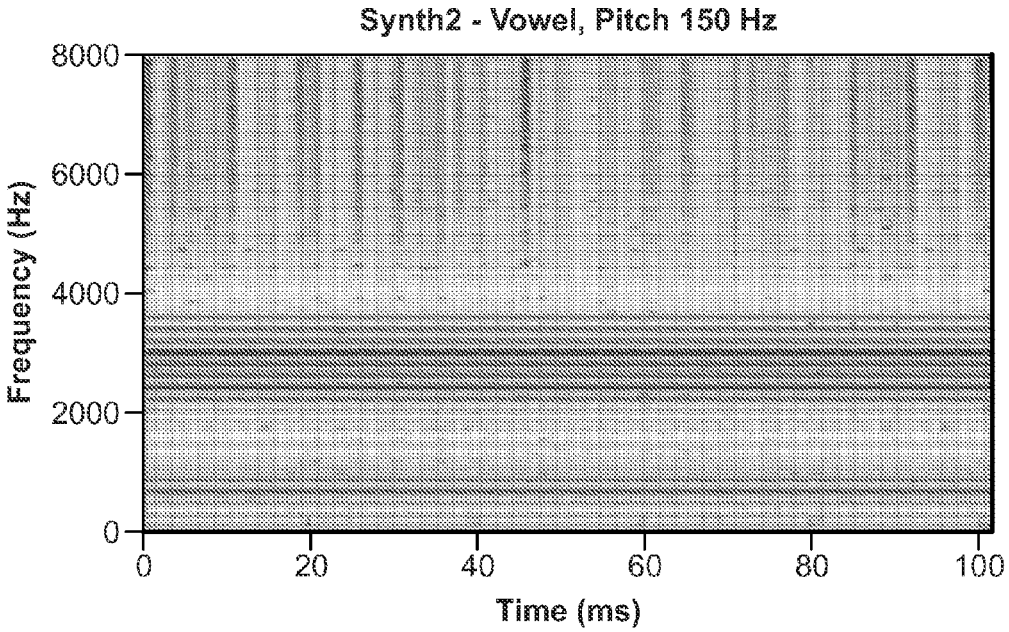
Figure 27C:
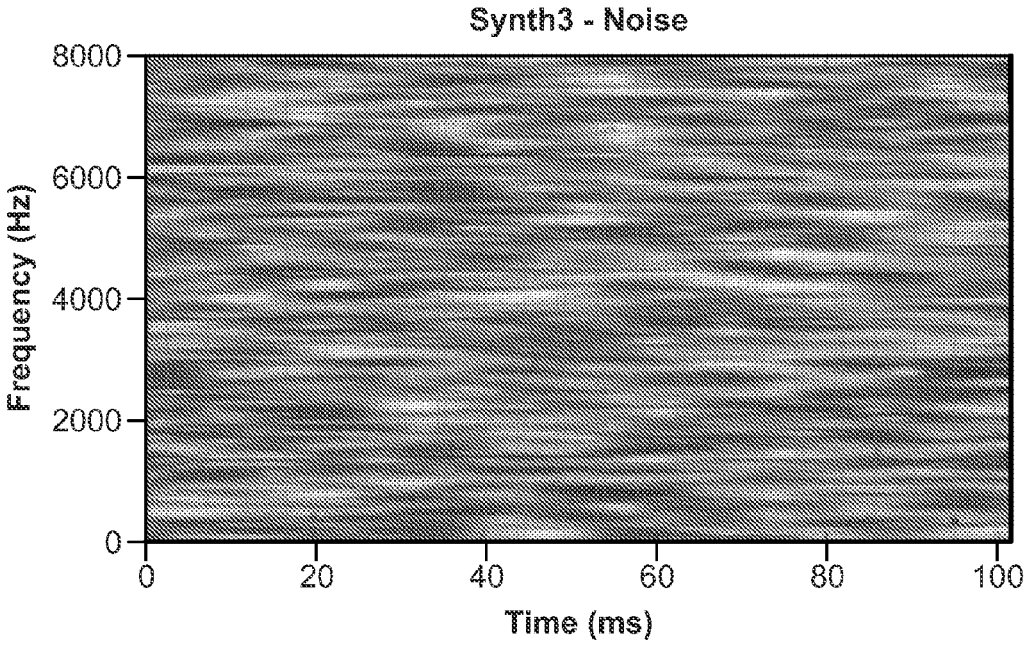
Figure 27D:
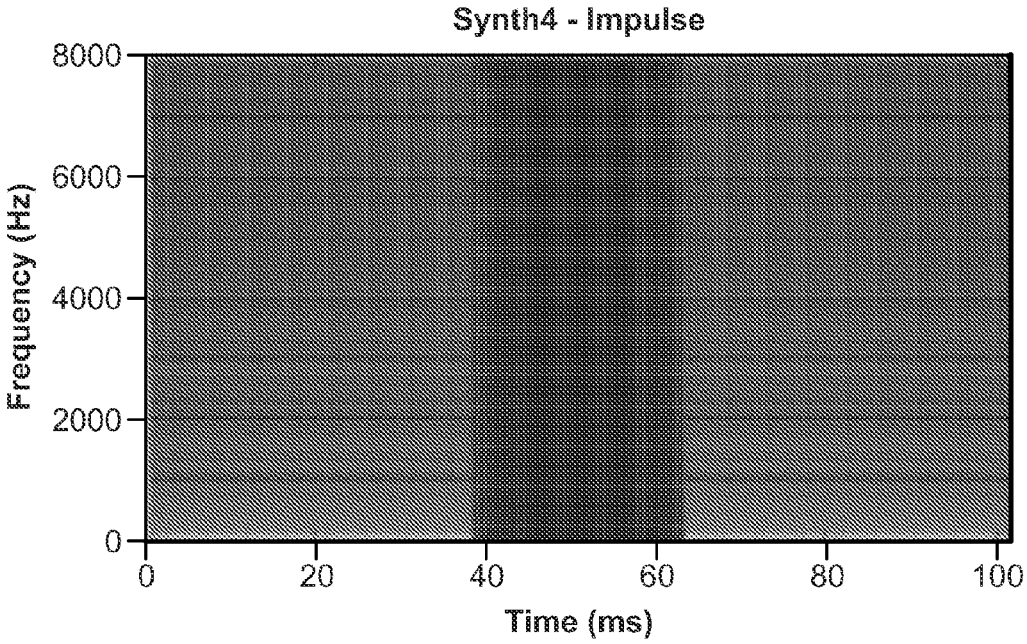

FIG. 26C is an illustration of band-wise classification performance of linear discriminate analysis on test data per band. FIG. 26D is an illustration of resulting binary mask of pruning of the plot shown in FIG. 27A with 1's and 0's. The pruning is performed across time and center frequency for the mixture in FIG. 26B. In FIG. 26D, 1's denote regions in which the candidate is kept while 0's denote regions in which they are discarded.

Given the pruned candidates across time-frequency regions, k-means clustering 2650 may be used to obtain local estimates in time. As our mixtures contained all-voiced speech from two speakers, two centroids were extracted from pruned candidates across all frequency bands at each time point. Specifically, certain embodiments my perform clustering along both the pitch and pitch-derivative dimensions, where the pitch derivative estimate is that tied to the pruned pitch value (i.e., Feature 2). Therefore, such embodiments account for conditions where pitch values may be identical but pitch-derivatives may differ for two speakers. To generate the pitch track for each speaker, each pair of centroids at a point in time may be used as observations to a pair of Kalman filters (KF) [24]. For each speaker i, certain embodiments may adopt a state-space model $$x_{t+1,i} = A\underline{x}(t+1, i) + \underline{v}_t \tag{47}$$

$$y_{t,i} = \underline{x}_{t,i} + \underline{w}_t$$

$$\text{Where } A = \begin{bmatrix} 1 & \Delta t \\ 0 & 1 \end{bmatrix},$$

-continued $$\underline{y}_{t,i} = \begin{bmatrix} \tilde{f}_0(t, i) \\ \frac{\partial \tilde{f}_0}{\partial t(t, i)} \end{bmatrix} \text{ is the centroids, and } \underline{x}_{t,i} = \begin{bmatrix} f_0(t, i) \\ \frac{\partial f_0}{\partial t(t, i)} \end{bmatrix}$$

is the true state. The terms $\underline{v}_t$ and $\underline{w}_t$ are Gaussian noise terms [24]. Given the assignment of a centroid to a speaker, the standard KF equations are used to generate the pitch track. In training, the covariances of $\underline{v}_t$ and $\underline{w}_t$ are obtained using the optimal assignment of centroids on a training set of mixtures. Optimal is defined as when the observation is closest in normalized distance to the true state, where normalization is done by the means and standard deviations of the pruned candidates at each time point.

To perform assignment of the centroids to each speaker/pitch track in testing, certain embodiments compute distances between the predicted states of the two pitch tracks $\hat{x}_{t,1|t-1}$ and $\hat{x}_{t,2|t-1}$ and the two observations $\underline{y}_{t,a}$ and $\underline{y}_{t,b}$ at time t. Specifically, $\chi_{1,a}$ may be defined as:

$$\chi_{1,a}=(\underline{y}_{t,a}-\hat{x}_{t,1|t-1})^T\Lambda^{-1}_{t|t-1}(\underline{y}_{t,a}-\hat{x}_{t,1|t-1}) \tag{48}$$

Where $\Lambda^{-1}_{t|t-1}$ is the covariance associated with the prediction at time t. $\chi_{1,b}$, $\chi_{2,a}$, and $\chi_{1,b}$ may be similarly defined. For $\hat{x}_{t,1|t-1}$, the minimum of $\chi_{1,a}$ and $\chi_{2,a}$ may be used to make the assignment to the corresponding observation, the same rule may be applied for $\hat{x}_{t,2|t-1}$ but with $\chi_{1,b}$ and $\chi_{2,a}$. If $\hat{x}_{t,1|t-1}$ and $\hat{x}_{t,2|t-1}$ acquire the same observation (e.g. if they both acquire $\underline{y}_{t,a}$), the assignments are changed based on the following criterion:

$$\text{If } (\chi_{1,a}+\chi_{2,a}>\chi_{2,a}+\chi_{1,a}) \text{ assign } \underline{y}_{t,b} \text{ to } \hat{x}_{t,2|t-1} \tag{49}$$

Otherwise, assign $\underline{y}_{t,b}$ to $\hat{x}_{t,1|t-1}$

The same rule is applied if $\hat{x}_{t,1|t-1}$ and $\hat{x}_{t,2|t-1}$ both acquire $\underline{y}_{t,b}$ but with $\underline{y}_{t,a}$ replacing $\underline{y}_{t,b}$ in (49). This assignment uses individual uncertainties of predicted observations and the combined uncertainty of both assignments to prevent pitch tracks from merging. Fixed-interval smoothing (across the entire duration of the pitch track) is applied to the filtered estimates [24]. Utilizing both pitch and pitch-derivative information in multi-pitch estimation hereinafter is being referred as "$f_0-\partial f_0/\partial t$."

To assess the utility of the GCT's joint representation of pitch and pitch-dynamics, certain embodiments use a reference system that does not utilize $\partial f_0/\partial t$ in estimation. The candidates are pruned based on the $|\hat{f}_0-f_0|>\delta$ criterion, but k-means clustering is done using only the pitch values. In tracking, the state-space model of (47) is modified such that A=1, $\underline{y}_{t,i}=\tilde{f}_0(t,i)$ is the centroid, and $\underline{x}_{t,i}=f_0(t,i)$. This approach is referenced hereinafter as "$f_0$_only."

For evaluation, an example data set, collected consisting of 8 males (m1-m8) and 8 females (f1-f8) speaking 8 all-voiced utterances (sentences s1-s8, outlined above) and sampled at 16 kHz was used. Data was obtained from speakers that maintained voicing throughout each utterance. Reference (or "true") pitch values of the sentences were obtained using Wavesurfer prior to mixing [25]. Speech files were pre-emphasized at a 0-dB overall signal-to-signal ratio. To train the LDA-based pruning and Kalman filters 2650, mixtures generated from first four male (m1-m4) and first four female (f1-f4) speakers, speaking sentences s1-s4 were used. In testing, mixtures generated from second four male (m5-m8) and second female (f5-f8) speakers speaking sentences s5-s8 were used. Distinct speakers and sentences were used in each mixture such that train and test sets consisted of 336 total mixtures each.

The test data was then divided into mixtures of "separate" and "close" pitch track conditions, with "close" referring to mixtures where at least one time point contains a pair of pitch values within 10 Hz of each other. This accounts for 136 mixtures, the majority of which contained either crossings, or both crossings and mergings. The remaining 200 mixtures are considered separate. Representative mixtures are shown in FIGS. 26F-26K.

In order to obtain a quantitative metric for performance, certain embodiments of the present invention define a root-mean-squared-errors (RMSE) as:

$$RMSE = \sqrt{\frac{1}{2L}\sum_{i=1}^{2}\sum_{t=1}^{L}(\hat{x}_{t,i} - x_{t,i})^2} \tag{50}$$

where L is the length of the mixture and $\hat{x}_{t,i}$ and $x_{t,i}$ are the reference and estimated pitch values, respectively.

Figure 26E:
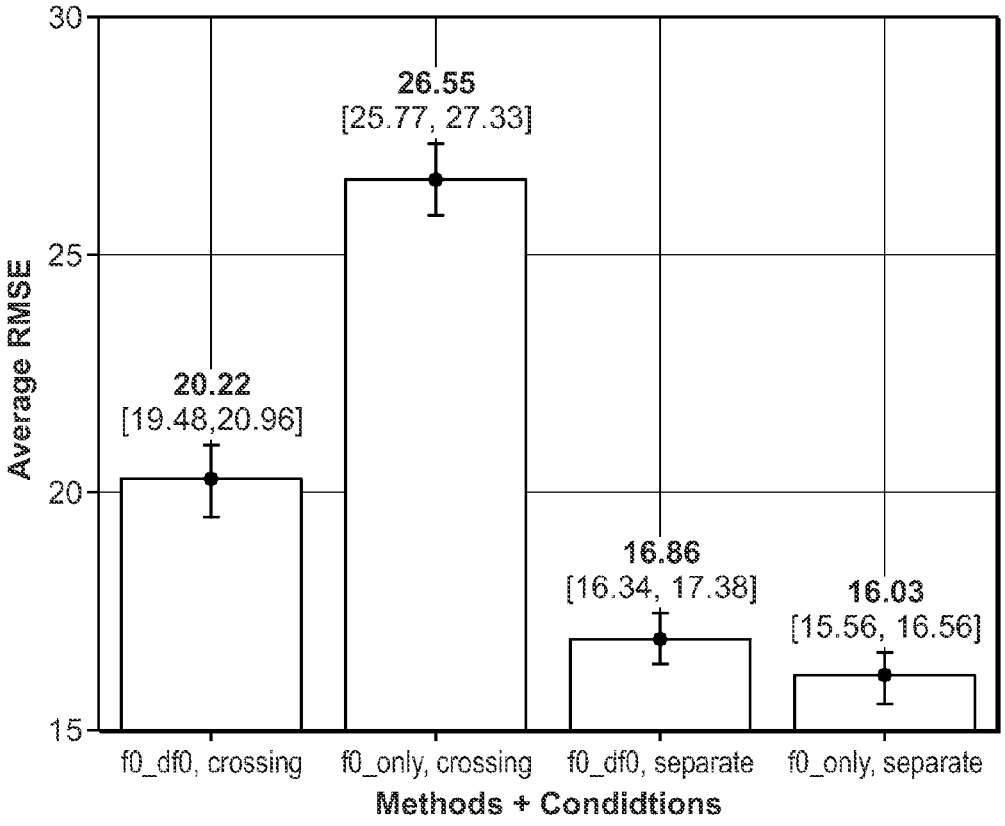
FIG. 26E is a plot that illustrates the average root mean square and standard errors for data collected from eight males and eight females and processed using embodiments of the present invention that employ Kalman filtering and clustering for multi-pitch analysis.
Figure 26F:
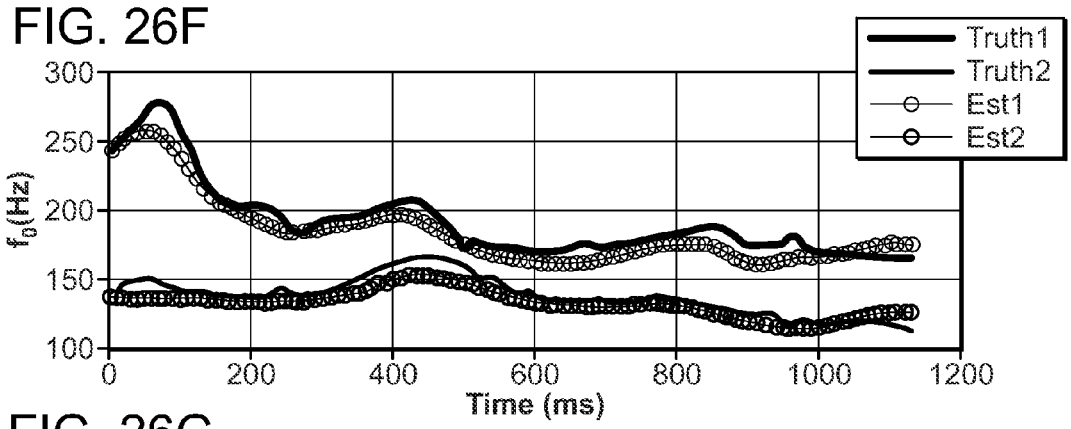
FIGS. 26F-26K are plots that illustrate estimation results obtained from embodiments of the present invention that employ Kalman filtering and clustering for multi-pitch analysis.
Figure 26G:
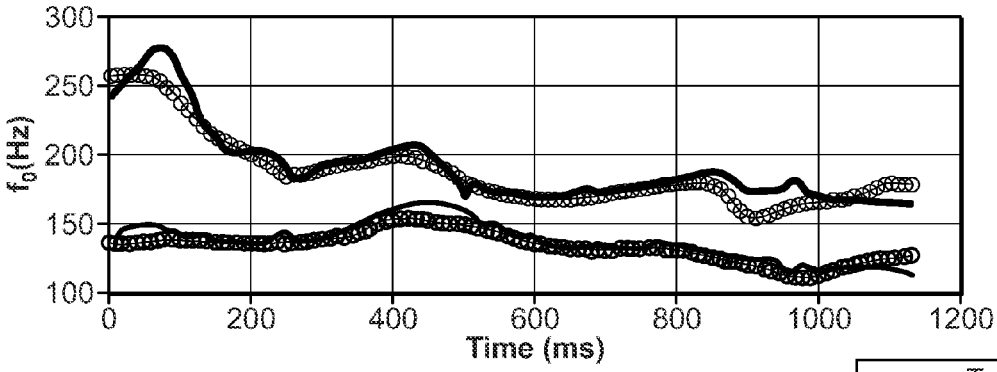
Figure 26H:
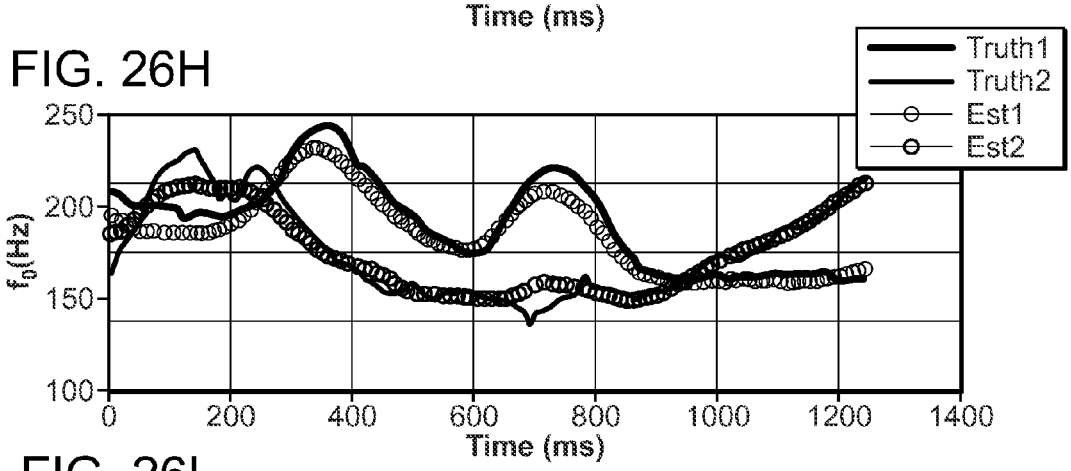
Figure 26I:
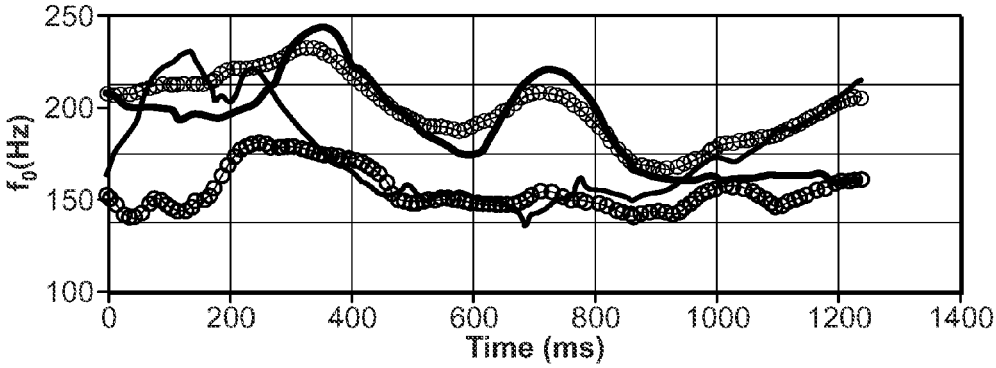
Figure 26J:
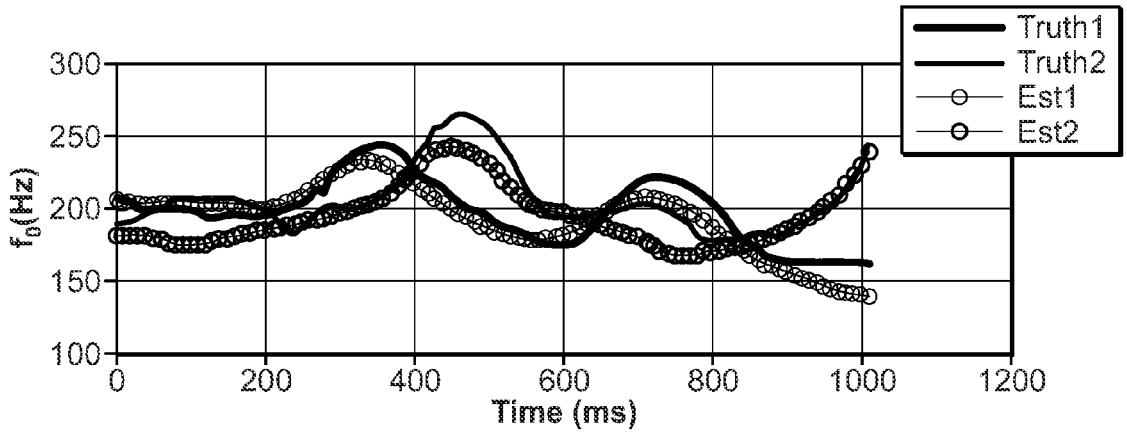
Figure 26K:
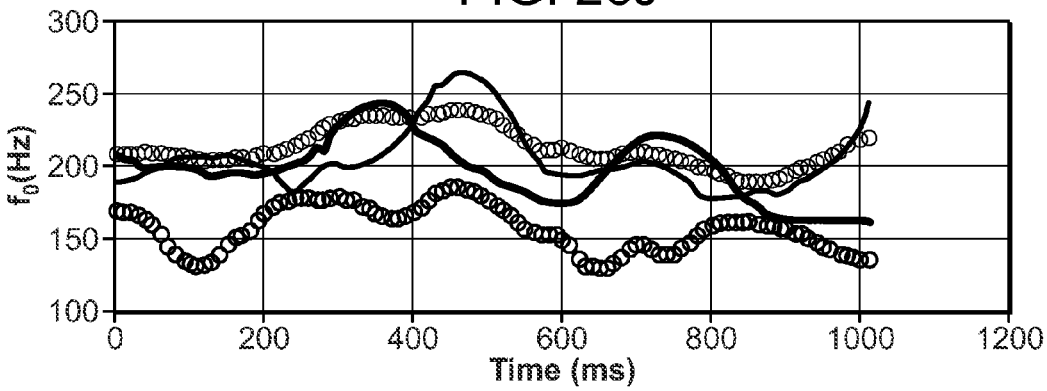
Figure 26M:
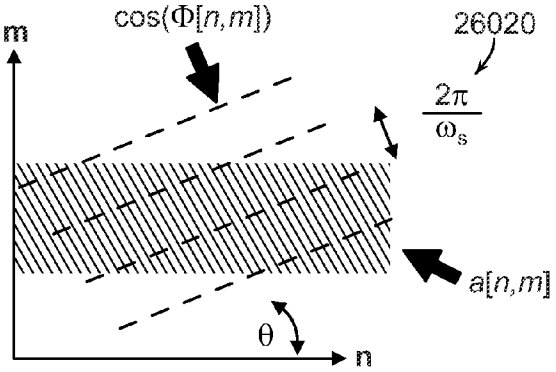
FIG. 26L illustrates a narrowband spectrogram having a local region.
FIG. 26 M illustrates a zoomed-in portion of the local regions shown in FIG. 26L.
FIG. 26N illustrates the GCT representation with near-DC component to be removed for analysis and synthesis and series modulated components.
FIG. 26O illustrates demodulation in the GCT domain for analysis and synthesis using series to reconstruct near-DC terms.

FIG. 26E shows average RMSEs in both the "separate" and "crossing"datasets for the two described estimation methods along with standard errors. FIGS. 26F-26G show the results of a "separate" case comparing the $f_0-\partial f_0/\partial t$ and $f_0$_only approaches. Consistent with the quantitative results in FIG. 26E, FIGS. 26F-26G exhibit similar performance to $f_0$_only and obtains reasonable estimates of pitch values. In contrast, the $f_0-\partial f_0/\partial t$ approach outperforms $f_0$_only by approximately 6 RMSE in the close conditions (FIGS. 26H-26K). This is due to a more accurate estimate of the trajectories when they exhibit crossings (e.g., compare in FIGS. 26H-26I, approximately 1000 ms). Nevertheless, an outstanding limitation of $f_0-\partial f_0/\partial t$ is when pitch tracks exhibit similar pitch values and pitch-derivatives. As an example, observe that erroneous estimates are made by $f_0-\partial f_0/\partial t$ near 150 ms in FIGS. 26J-26K, where the two pitch tracks are close in absolute frequency and have similar slopes.

Analysis and Synthesis of Speech Using 2-D Sinusoidal Series

Example embodiments of the present invention may model a localized time-frequency region s[n,m] of a narrowband short-time Fourier Transform magnitude based on a sinusoidal series modulated by an envelope:

$$s[n, m] \approx \alpha[n, m]\left(1 + \sum_{k=1}^{N}\alpha_k \cos\phi_k[n, m]\right. \tag{51}$$

$$\phi_k[n, m] = \omega_s k(n\cos\theta + m\sin\theta) + \psi_k \tag{52}$$

Figure 26O:
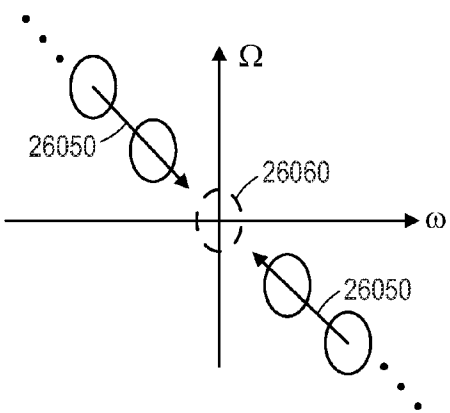
Figure 26L:
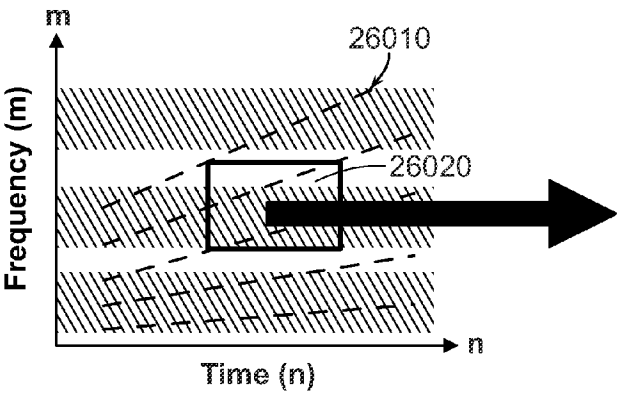
Figure 26N:
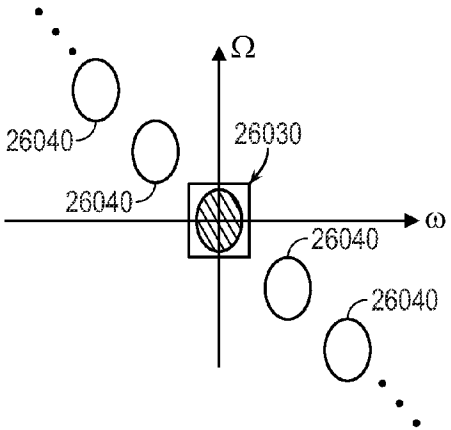

Accordingly, a series of N harmonically related sinusoids with spatial frequencies $k\omega_s$, orientation $\theta$, amplitudes $\alpha_k$, and phases $\psi_k$ resting on a DC pedestal modulates a slowly-varying envelope $\alpha[n,m]$. The GCT is the 2-D Fourier transform of s[n,m]:

$$S(\omega, \Omega) = A(\omega, \Omega) + .05\sum_{\kappa=1}^{N} e -$$

$$j\psi^k A(\omega + \kappa\omega_s\sin\theta, \Omega - \kappa\omega_s\cos\theta) + e^{j\psi k} A(\omega - \kappa\omega_s\sin\theta, \Omega + \kappa\omega_s\cos\theta)$$

where $\omega$ and $\Omega$ map to n and m, respectively (FIG. 26N). An approximate version of this model using a single sinusoidal carrier was derived in [21, 25] from properties of periodic source signals in speech. The sinusoidal series model may also be used to perform speaker separation as in the single sinusoid model. The representation presented in sinusoidal series model may further be exploited to perform multi-pitch analysis.

Certain embodiments of the present invention remove the approximation to account for multiple harmonically related carriers as observed in the GCT [25]. For voiced speech, formant structures may be mapped to the near-DC region of the GCT (FIG. 26N). The parameters of $\Phi_k[n,m]$ for k=1 relate to pitch and pitch-dynamic information while k=2, 3, . . . , H are harmonically related to this carrier.

Certain embodiments extend this model to account for onsets/offsets (e.g., vertical edges, FIG. 26N) in the spectrogram as they map along the GCT $\omega$-axis from image processing principles and as observed in [20].

To account for noisy/unvoiced regions, certain embodiments consider the short-time Fourier transform of a white Gaussian process and invoke an independence assumption between each time-frequency unit of the spectrogram. These embodiments model the magnitude of each unit as an independent realization of a 2-D Rayleigh process $P_r$ [n,m] as in [26]. Denoting $\sigma_R$ as the parameter of the Rayleigh distribution, the 2-D autocorrelation function and GCT-based power spectral densities are then $$\begin{aligned} R_{pp}[i, \kappa] &= E[P_r[n, m]P_r[n + \kappa, m + l] \\ &= 2\sigma_{R^2}, \kappa = 0, l = 0 \\ &= \frac{\pi}{2}\sigma_{R^2}, \text{otherwise} \end{aligned} \tag{54}$$

$$Spp(\omega, \Omega) = \sigma_{R^2}\left(\frac{\pi}{2}\delta(\omega, \Omega) + \frac{4-\pi}{2}\right) \tag{55}$$

From (55), noise content within local time-frequency regions, on average, is spread to all regions of the GCT. To account for this behavior in individual regions, certain embodiments adopt the model of (51) and extract distinct carrier positions for each region.

The log of s[n,m] may also be considered:

$$S_{log}[n, m] = \log\alpha[n, m] + \log\left(1 + \sum_{k=1}^{n}\beta_k \cos\phi_k[n, m]\right) \tag{56}$$

$$S_{log}[n, m] \approx K + \sum_{k=1}^{n}\beta_k \cos\phi_k[n, m] \tag{57}$$

From (57), example embodiments approximate log $\alpha[n,m]$ as a DC constant k based on observations that the log tends to "flatten" the underlying 2-D envelope in localized regions, thereby allowing for improved estimation of the 2-D carrier frequencies [19]. Moreover, $\log(1+\Sigma_{k=1}^{n}\beta_k \cos\phi_k[n,m])$ is periodic with a fundamental spatial frequency $\omega_s$ as in (51) since the log operation maintains the periodicity of its argument such that $\phi_k[n,m]$ are defined as in (52), but $\beta_k$ are arbitrary amplitudes distinct from $\alpha_k$.

FIGS. 26L-26O illustrate that certain embodiments of the present invention may employ GCT to represent information across the entire space in a distributed manner. Specifically, FIG. 26L illustrates a narrowband spectrogram 26010 having a local region 26020. FIG. 26 M illustrates a zoomed-in portion of the local region 26020 shown in FIG. 26L. FIG. 26N illustrates the GCT representation with near-DC component to be removed for analysis and synthesis 26030 and series modulated components 26040. FIG. 26O illustrates demodulation 26050 in the GCT domain for analysis and synthesis using series to reconstruct near-DC terms 26060.

Fixed Region Size Analysis/Synthesis

For analysis/synthesis using the described model, example embodiments adopt the experimental setup of [21] in which example embodiments first remove the $A(\omega,\Omega)$ component in the GCT. This is based on the observations that interference in the GCT domain (e.g., other speakers) tends to be concentrated at the origin. Certain embodiments may recover $A(\omega,\Omega)$ using series-based sinusoidal demodulation (FIG. 26N).

A narrowband magnitude spectrogram $s_{full}[n,m]$ and log spectrogram $s_{log\text{-}full}[n,m]=\log s_{full}[n,m]$ may be computed for the signal. A high-pass 2-D filter may further applied to both spectrograms to remove near-DC terms for GCT analysis. The filtered results are denoted herein as $s_{HP}[n,m]$ and $s_{log\text{-}HP}[n,m]$. Localized regions are extracted from $s_{full}[n,m]$, $s_{HP}[n,m]$, and $s_{log\text{-}HP}[n,m]$ using a 2-D Hamming window denoted as $s[n,m]$, $s_{local,hp}[n,m]$, $s_{local,log\text{-}hp}[n,m]$. A GCT is computed for $s_{local,log\text{-}hp}[n,m]$ using a 2-D discrete Fourier Transform (GCT). Peak-picking in the GCT domain is then used to estimate the k=1 carrier parameters $\omega_s$, $\theta$, and $\psi_1$.

A 2-D carrier $\cos\hat{\phi}_1[n,m]$ may be generated from these parameters and multiplied by $s[n,m]$. This result may be low-pass filtered to obtain a scaled estimate of $a[n,m]$, denoted as $\hat{a}[n,m]$. Subsequently, additional carriers are generated by scaling $\omega_s$ by k=2, 3, . . . , N, where N is such that $N\omega_s<\pi$ and extracting $\psi_k$ values at the carrier locations in the GCT. As in the k=1 case, each carrier is multiplied by $s[n,m]$ and low-pass filtered to obtain an estimate of $a[n,m](\hat{a}[n,m])$.

Least-squares error (LSE) fitting is used to solve for the set of gain parameters $\gamma_k$ by setting the known model components of (51) to $s[n,m]$:

$$S[n,m]=K+\sum_{k=1}^{N}\gamma_k\hat{\alpha}_k[n,m]+\sum_{k=1}^{N}\hat{\alpha}_k[n,m]\cos\phi_k[n,m] \tag{58}$$

The reconstructed spectrogram may be computed using 2-D overlap-add. The sinusoidal series model of embodiments of the present invention may also be used to solve for multiple speakers (as in [21]).

Adaptive Analysis and Synthesis

Certain embodiments of the present invention adaptively_region sizes for the GCT, inspired by evidence in mammalian auditory studies of adaptive signal processing mechanisms that adapt to properties of the analyzed signal itself [20]. Specifically, these embodiments adapt region sizes based on a quantitative metric that assesses the relative "salience" of the proposed signal model in each localized region, thereby allowing for distinct resolutions of the GCT analysis based on the signal analyzed.

FIGS. 27A-27D includes four spectrograms of synthetic signals. Synth1 (FIG. 27A) is a pulse_train with rising pitch (150 to 200 Hz). Synth2 (FIG. 27B) is a pulse train with_fixed pitch of 200 Hz. Synth3 (FIG. 27C) is a Gaussian white noise, and Synth4 (FIG. 27D) is a single impulse. Synth1 and Synth2 both excite a formant structure. In one embodiment, the formant structure may contain formant frequencies (bandwidths) of 669, 2349, 2972, 3500 Hz (65, 90, 156, 200 Hz).

Certain embodiments of the present invention may perform analysis/synthesis on these waveforms using the 2-D modeling developed in Equations (51)-(58), across distinct sets of fixed regions sizes. These fixed sizes may be varied in time ranging from 20 to 50 ms in 2-ms steps while in frequency from 625 Hz to 1000 Hz in 62.5-Hz steps. As a quantitative metric for comparison, the global signal-to-noise ratio (SNR) between the original and re-synthesized waveforms may be used.

FIG. 28 is a table that outlines the SNR value for all four signals shown in FIG. 27A-27D across four distinct regions sizes. These sizes correspond to those that maximized the SNR for each distinct signal such that the diagonal of the table are the maximal SNR values in re-synthesis. From these results, it can be observed that four distinct sizes are obtained for each signal. Furthermore, a sub-optimal selection of the region size for distinct signals can result in substantial SNR degradations (e.g., the optimal size for Synth2 leads to an SNR of 3.86 dB for Synth4, ~15 dB below the optimal size for Synth4). These results demonstrate that a "fixed tiling" of 2-D space exhibits limitations in reconstruction based on distinct properties of the signal itself.

Certain embodiments of the present invention may employ a "relative salience" of 2-D carrier frequencies in the GCT with respect to the rest of the GCT content. This metric quantitatively assesses the extent to which the series-based 2-D amplitude model is valid for a given region and may be used to guide adaptive region-growing and selection.

Let $s_{log}[n,m](s_{log\text{-}hp}[n,m])$ denote a local region of the (high-pass filtered) narrowband log-spectrogram for a given signal such that its corresponding GCT is $S_{log}(\omega,\Omega)(S_{log\text{-}hp}(\omega_d,\Omega_d))$. As discussed in Section 2, extracting the dominant peak magnitude of the $S_{log\text{-}hp}(\omega,\Omega)(|S_{log\text{-}hp}(\omega_d,\Omega_d)|)$ can be used to derive the carrier parameters $\omega_s$, $\theta$, and $\Phi_1$ a sinusoid denoted as $c_1[n,m]$. The term $c_1[n,m]$ is scaled such that its GCT magnitude has a dominant peak value of $|S_{log\text{-}hp}(\omega_d,\Omega_d)|$. The remaining harmonically related carriers $c_k[n,m]$, k=2, 3, . . . , N are then obtained by scaling the parameters of the dominant carrier.

A "salience ratio" (SR) as the ratio of following energies may be obtained as:

$$SR=10\log_{10}\frac{E_c}{\iint_{\omega,\Omega}|S_{log}(\omega,\omega)|^2d\omega d\Omega-E_c} \tag{59}$$

$$E_c=\iint_{\omega,\Omega}\sum_{k=1}^{N}|c_k(\omega,\Omega)|^2d\omega d\Omega \tag{60}$$

In the above terms, the denominator is the energy difference in the local region of the original (non-filtered) narrowband spectrogram and the carriers. This metric relates the relative energy contributions of the carrier positions in the signal model to the overall region analyzed.

To adapt and select region sizes based on SR, certain embodiments first perform GCT analysis across the spectrogram of the signal analyzed using a fixed region size with a modified 2-D Hamming window that satisfies the constant overlap-add property [11]. This is referred to as base tiling. In each region, the SR metric, shown in Equation (59) may be computed. The result of this initial analysis is a 2-D grid of SR values (FIG. 29A). Each base region is grown by examining its neighbors' SR values. Specifically, in FIGS. 29A-29B SRbase denotes the SR value of a base region with neighboring SRtop, SRbottom, SRleft, SRright as shown. Furthermore, SRmerged,neighbor denotes the SR value computed using the combined windows of the base and one of its neighboring regions. The base region is recursively merged with its neighbors based on:

a. Compute $SR_{merged,neighbor}$ of the base region for all of its neighbors (top, bottom, left, right)

b. Determine the maximum of the four SR values computed in a. (denoted as $SR_{merged,max}$) with its corresponding neighbor max_neighbor.

c. If $SR_{merged,max}$<max($SR_{base}$, $SR_{top}$, $SR_{bottom}$, $SR_{left}$, $SR_{right}$) terminate the algorithm by creating a new region $SR_{merged}$ equal to the base region. Otherwise, merge base region with max_neighbor to form $SR_{merged}$ with corresponding SR value $SR_{merged,max}$. Determine the new neighbors of $SR_{merged}$ by its four edges. Use $SR_{merge}$ as the base region in A1) to complete the recursion.

The algorithm iteratively grows each base region until the SR value of any resulting merged region is less than that of the unmerged region. The order of the base regions merged is based ordering the SR values of all base regions in descending order. In case the neighbor of a base region has already been incorporated into a previously merged region, it is excluded from the SR computations and comparison in the algorithm. The neighbors of any region are strictly those along its four vertical edges such that only rectangular regions are grown (FIG. 29B). After all base regions have been processed, the resulting set of merged regions is used in 2-D demodulation for Analysis and synthesis. The 2-D Hamming windows in each merged region are summed and used to extract the appropriate coordinates of the spectrogram and demodulated individually. The results are summed across all merged regions to reconstruct the spectrogram. The constant-overlap-add property of the 2-D Hamming windows guarantees a unity system if demodulation is not performed. The reconstructed spectrogram is combined with the phase of the original spectrogram and inverted for waveform reconstruction.

Full Audio Source Separation System

Figure 30A:
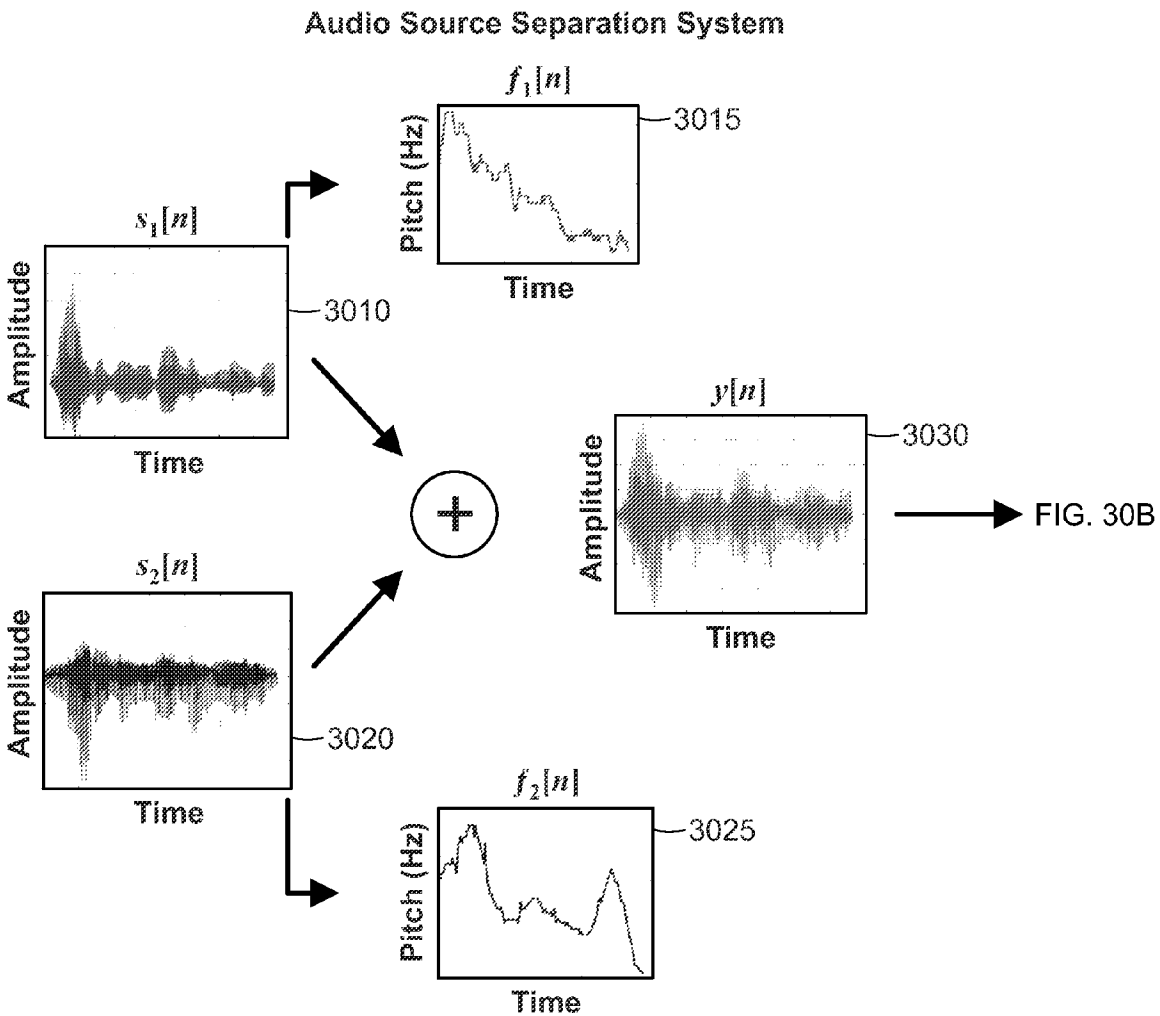
FIGS. 30A and 30B are high-level illustrations of an audio separation system according to an example embodiment.
Figure 30B:
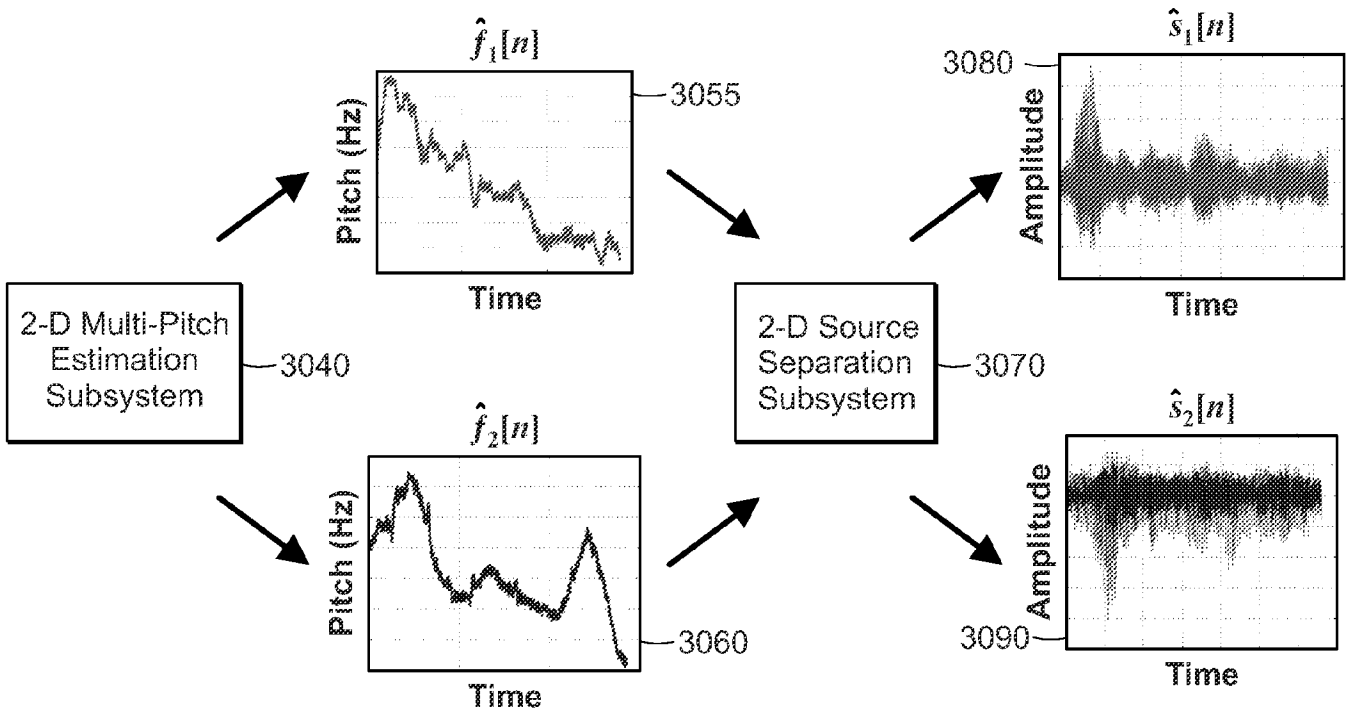

FIGS. 30A and 30B are a high-level illustration of an audio separation system according to certain example embodiments. Two audio source output audio signals $s_1[n]$ 3010 and $s_2[n]$ 3020. These speaker signals 3010, 3020 include distinct pitch trajectories $f_1[n]$ 3015 and $f_2[n]$ 3025. The speaker signals $s_1[n]$ 3010 and $s_2[n]$ 3020 are presented to a two-dimensional multi-pitch estimation subsystem 3040 as a mixed signal y[n] 3030. The two-dimensional multi-pitch estimation subsystem 3040 determines pitch estimates $\hat{f}_1[n]$ 3055 and $\hat{f}_2[n]$ 3060 of pitch values $f_1[n]$ 3015 and $f_2[n]$ 3025. The pitch estimates 3055, 3060 are applied to a source separation subsystem 3070. The source separation subsystem 3070 determines estimates $\hat{s}_1$ [n] 3080 and $\hat{s}_2[n]$ 3090 of source signals $s_1[n]$ 3010 and $s_2[n]$ 3020.

Figure 31A:
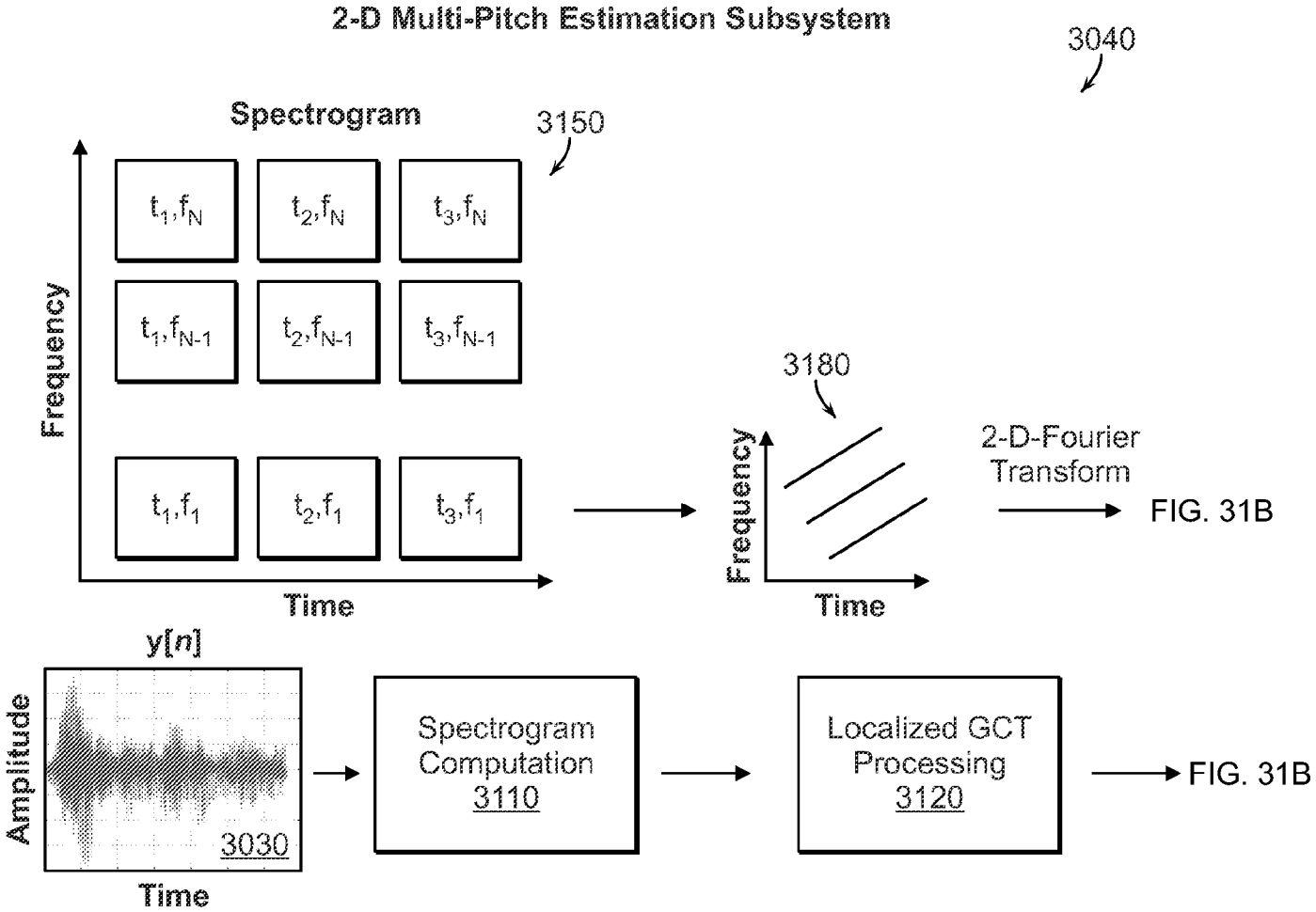
FIGS. 31A and 31B are high-level illustrations of a two-dimensional multi-pitch estimation subsystem according to an example embodiment.
Figure 31B:
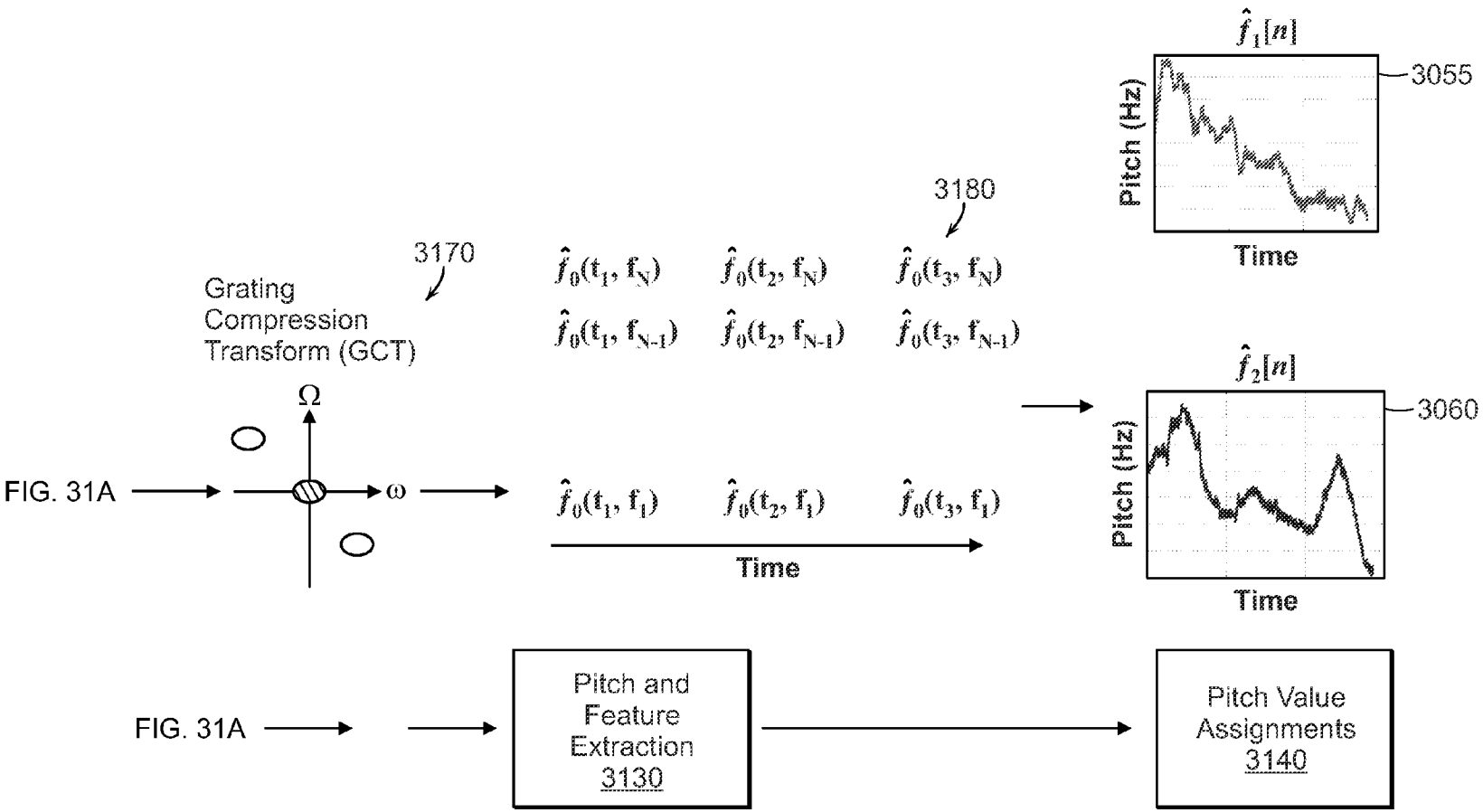

FIGS. 31A and 31B are a high-level illustration of a two-dimensional multi-pitch estimation subsystem 3040 according to certain example embodiments. The mixture signal y[n] 3030 is presented to the system for spectrogram computation 3110 to compute the STFTM of the mixture 3150. Localized time-frequency regions are analyzed using the GCT 3170 (localized GCT processing 3120). In pitch and feature extraction 3130, one pitch candidate may be obtained from each time-frequency region 3160 of the short-time Fourier transform magnitude (STFTM) by first computing the GCT 3170 for the region and performing peak-picking to obtain a set of pitch candidates across frequency regions for each time point 3180. Pitch value assignment 3140 is performed to determine whether a pitch candidate is spurious or not spurious. Based on the results obtained from pitch value assignment 3140, pitch estimates $\hat{f}_1$ [n] 3055 and $\hat{f}_2[n]$ 3060 of pitch values $f_1[n]$ 3015 and $f_2[n]$ 3025 are obtained.

Figure 32A:
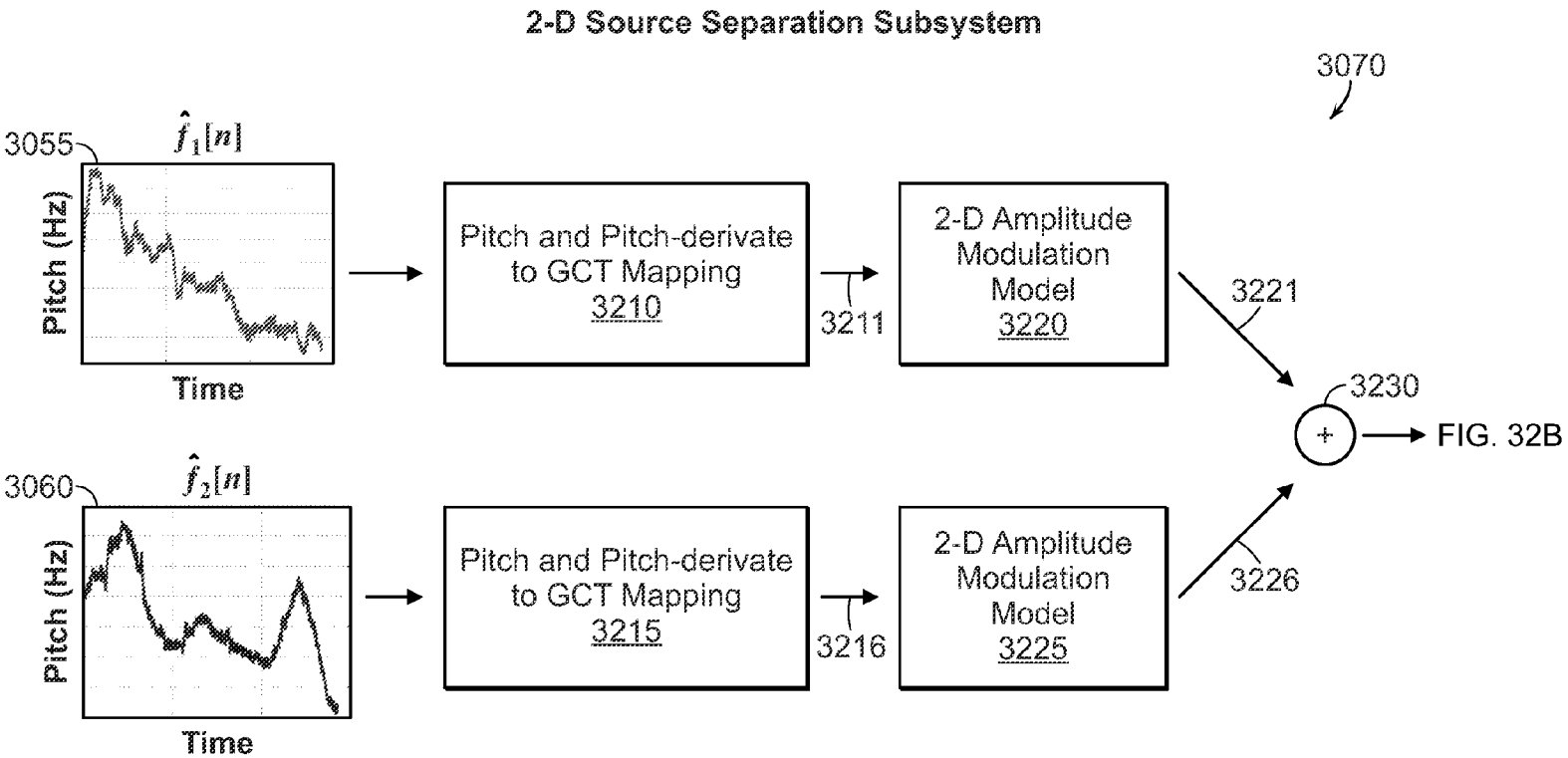
FIGS. 32A and 32B are high-level illustrations of a two-dimensional source separation subsystem according to an example embodiment.
Figures 32A, 32B:
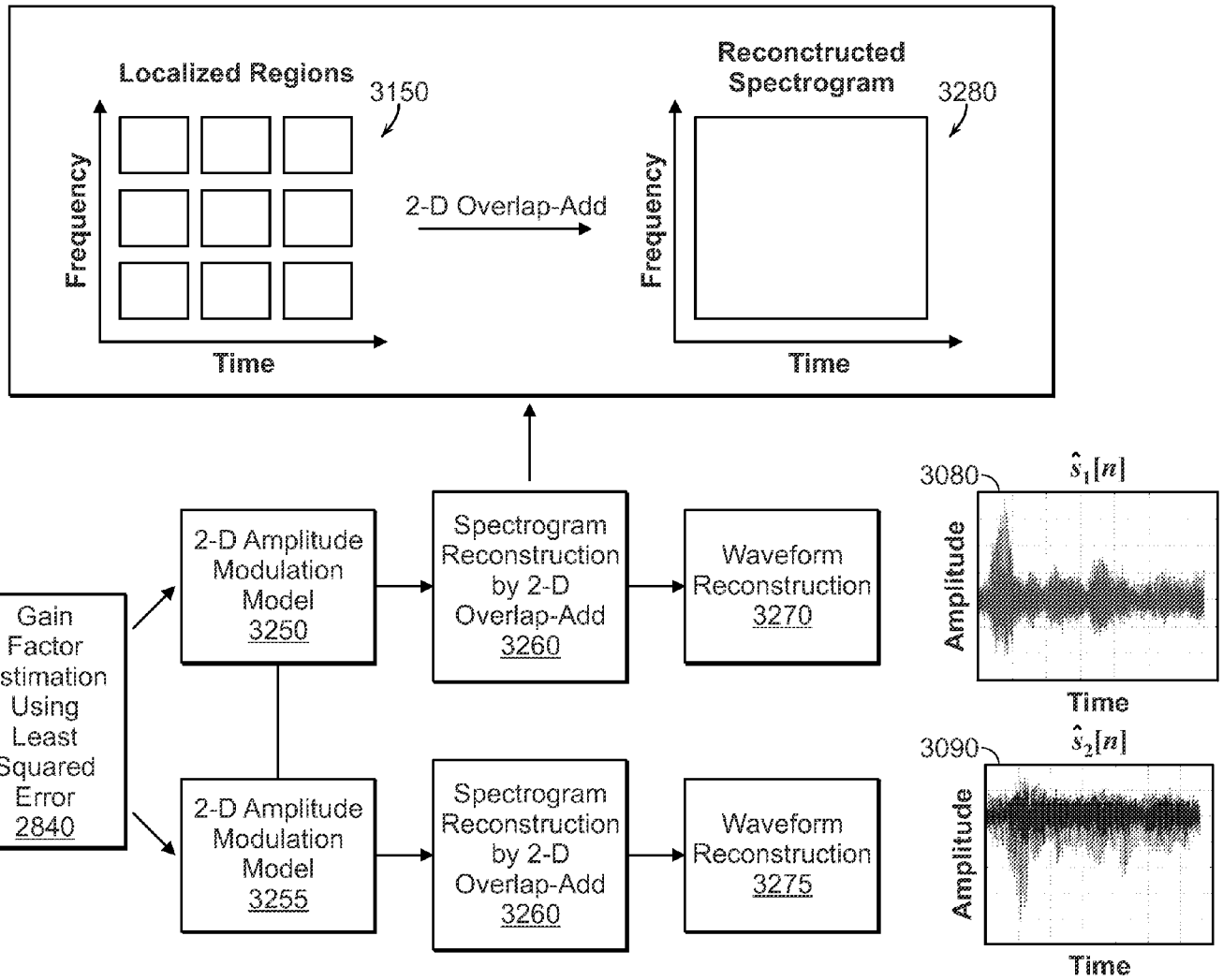

FIGS. 32A and 32B are a high-level illustration of a two-dimensional source separation subsystem according to certain example embodiments. The pitch estimates $\hat{f}_1$ [n] 3055 and $\hat{f}_2$ 3060 are used to obtain pitch and pitch-derivative candidates 3210, 3215. A 2-D AM model 3220, 3225 is applied to determine the speech contents in the resulting signals 3211, 3216. The signals 3221, 3226 are summed and a least-squared error fit is employed to estimate a gains parameter 3240. A 2-D AM model 3250, 3255 is applied to determine the speech contents and spectrogram reconstruction is performed 3260 by overlap-add (OLA) of localized time-frequency regions 3150. The 2-D source separation system 3070 determines estimates $\hat{s}_1$ [n] 3080 and $\hat{s}_2$ [n] 3090 of speaker signals $s_1[n]$ 3010 and $s_2[n]$ 3020 using the reconstructed spectrogram 3280.

Figure 33:
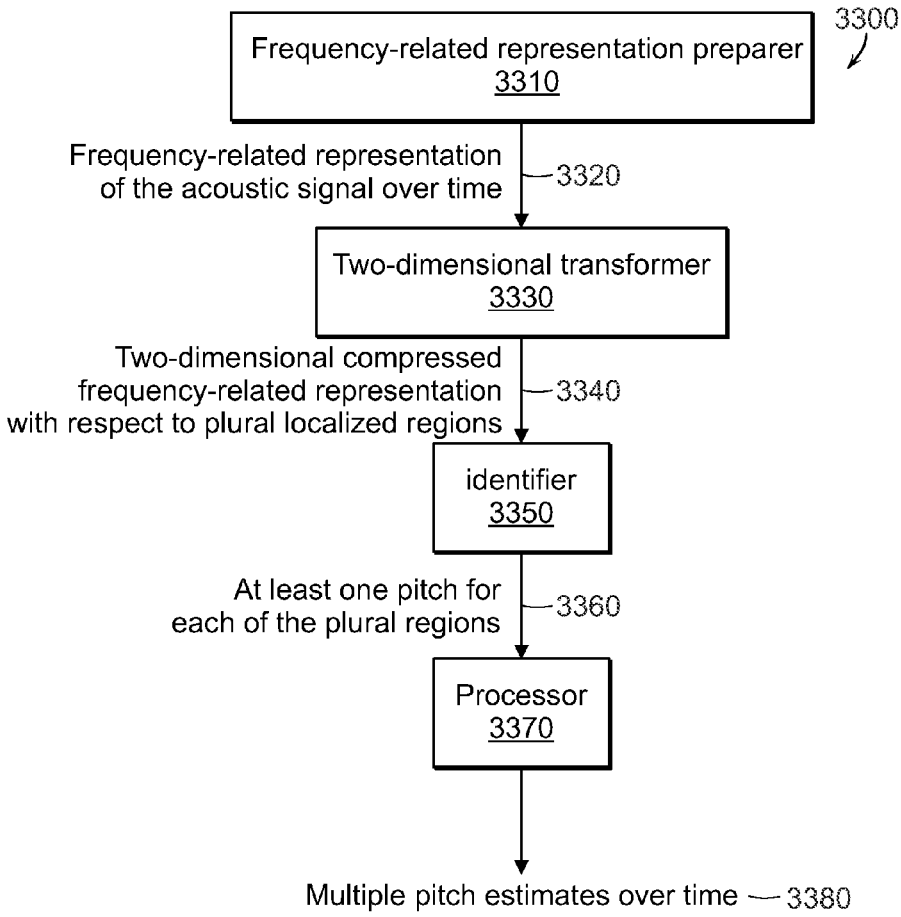
FIG. 33 is a high-level illustration of a system for processing an acoustic signal according to example embodiments of the present invention.

FIG. 33 is a high-level illustration of a system for processing an acoustic signal 3300 according to example embodiments of the present invention. A frequency-related representation preparer 3310 prepares a first frequency-related representation of the acoustic signal over time 3320. A two-dimensional transformer 3330 computes a two-dimensional transform of plural two-dimensional localized regions 3340 of the first frequency-related representation, each less than an entire frequency range of the first frequency related representation, to provide a two-dimensional compressed frequency-related representation with respect to each two dimensional localized region. An identifier 3350 identifies at least one pitch for each of the plural regions 3360. A processor 3370 processes the pitch from the plural regions to provide multiple pitch estimates over time 3380.

Figure 34:
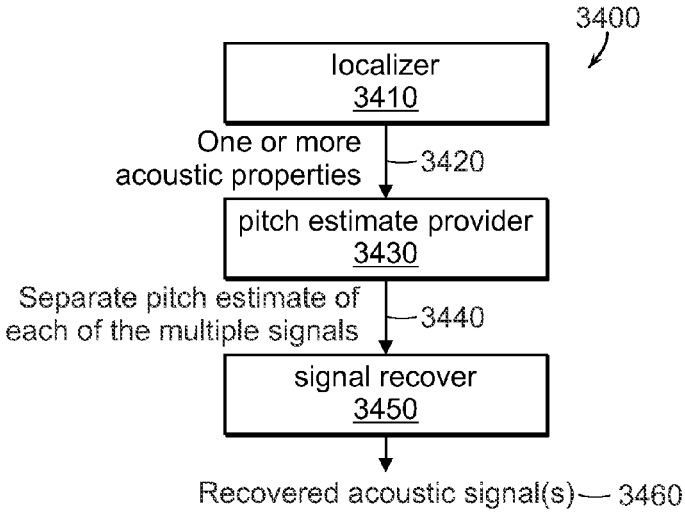
FIG. 34 is a high-level illustration of a system for processing a mixed acoustic signal according to example embodiments of the present invention.

FIG. 34 is a high-level illustration of a system for processing a mixed signal 3400 according to example embodiments of the present invention. A localizer 3410 localizes multiple time-frequency regions of a spectrogram of the mixed signal to obtain one or more acoustic properties 3420. A pitch estimate provider 3430 provides a separate pitch estimate of each of the multiple signals 3440 at a time point as a function of combining the one or more acoustic properties. A signal recoverer 3450 recovers at least one of the multiple signals 3460 as a function of the separate pitch estimate.

It should be understood that procedures, such as those illustrated by flow diagrams or block diagrams herein or otherwise described herein,may be implemented in the form of hardware, firmware, or software. If implemented in software, the software may be implemented in any software language consistent with the teachings herein and may be stored on any computer readable medium known or later developed in the art. The software, typically, in form of instructions, can be coded and executed by a processor in a manner understood in the art.

While this invention has been particularly shown and described with references to example embodiments thereof, it will be understood by those skilled in the art that various changes in form and details may be made therein without departing from the scope of the invention encompassed by the appended claims.

REFERENCES, ALL OF WHICH ARE INCORPORATED BY REFERENCE IN THEIR ENTIRETY

[1] D. Morgan, E. George, L. Lee, and S. Kay, "Cochannel Speaker Separation by Harmonic Enhancement and Suppression," IEEE TSAP, v5, pp. 407-424, 1997.

[2] T. Quatieri and R. Danisewicz, "An Approach to Co-channel Talker Interference Suppression Using a Sinusoidal Model for Speech," IEEE TASSP, v38, 1990.

[3] S. Schimmel, L. Atlas, K. Nie, "Feasibility of Single Channel Speaker Separation Based on Modulation Frequency Analysis," ICASSP 2007, Honolulu, Hi., USA.

[4] G. Hu and D. Wang, "Monaural speech segregation based on pitch tracking and amplitude modulation," IEEE TNN, vol. 15, 2004.

[5] T. Quatieri, "2-D Processing of Speech with Application to Pitch Estimation," ICSLP 2002.

[6] T. Ezzat, J. Bouvrie, and T. Poggio, "Spectrotemporal Analysis of Speech Using 2-D Gabor Filters," Interspeech 2007, Antwerp, Belgium.

[7] T. Ezzat, J. Bouvrie, and T. Poggio, "AM-FM Demodulation of Spectrograms Using Localized 2-D Max-Gabor Analysis," ICASSP, 2007.

[8] T. Wang and T. Quatieri, "Exploiting Temporal Change of Pitch in Formant Estimation," ICASSP, 2008, Las Vegas, Nev., USA.

[9] T. Chi, P. Ru, S. Shamma, "Multiresolution Spectrotemporal Analysis of Complex Sounds," JASA v118, pp. 887-906, 2005

[10] T. Wang and T. Quatieri, "2-D Processing of Speech for Multi-Pitch Analysis," Interspeech 2009, Brighton, UK.

[11] T. Quatieri, Discrete-time Speech Signal Processing: Principles and Practice. Upper Saddle River, N.J.: Prentice-Hall, 2001.

[12] M. Wu, D. Wang, and G. Brown, "A Multipitch Tracking Algorithm for Noisy Speech," IEEE TASL, v11, pp. 229-241, 2003.

[13] U.S. Pat. No. 7,574,352 to Thomas F. Quatieri, Jr.

[14] T. Tolonen and M. Karjalainen., "A Computationally Efficient Multi-pitch Analysis Model," *IEEE Trans. on Speech and Audio Proc.,* 8:708-716, 2000.

[15] T. Ezzat, J. Bouvrie, and T. Poggio, "Spectro-temporal Analysis of Speech Using 2-D Gabor Filters," ISCA Interspeech, 2007.

[16] K. N. Stevens, *Acoustic Phonetics*. Cambridge, Mass.: MIT Press, 1998.

[17] Y. Medan, E. Yair, and D. Chazan, "Super Resolution Pitch Determination of Speech Signals," *IEEE Trans. Sig. Proc.,* 39:40-48, 1991.

[18] "Program 1306 Quarterly Report," MIT Lincoln Laboratory, Jan. 1, 2009-Mar. 31, 2009.

[19] T. T. Wang and T. F. Quatieri, "2-D Processing of Speech for Multi-Pitch Analysis," Interspeech 2009, Brighton, UK, 2009, to be presented.

[20] T. Ezzat, J. Bouvrie, and T. Poggio, "Spectrotemporal Analysis of Speech Using 2-D Gabor Filters," presented at International Conference on Spoken Language Processing, Antwerp, Belgium, 2007.

[21] T. T. Wang and T. F. Quatieri, "Towards Co-channel Separation by 2-D Demodulation of Spectrograms," presented at IEEE Workshops on Applications of Signal Processing to Audio and Acoustics, 2009, to be presented.

[22] R. Duda, P. Hart, and D. Stork, *Pattern Classification,* 2nd ed. New York, N.Y.: John Wiley and Sons, 2001.

[23] L. Rabiner, M. Cheng, A. Rosenberg, and A. McGonegal, "A Comparative Study of Several Pitch Detection Algorithms," *IEEE Transactions on Acoustics, Speech, and Signal Processing*, vol. 23, 1976.

[24] Y. Bar-Shalom, X. Li, and T. Kirubarajan, *Estimation with Applications to Tracking and Navigation: Theory, Algorithms, and Software*. New York: Wiley, 2001.

[25] T. Wang and T. F. Quatieri, "High-pitch Formant Estimation by Exploiting Temporal Change of Pitch," IEEE TASL, v18-1, January 2010.

[26] J. Proakis, *Digital Communications*. New York, N.Y.: McGraw-Hill, Inc. 2001.

What is claimed is:

1. A method for processing a mixed acoustic signal comprised of multiple acoustic signals, the method comprising:

localizing multiple time-frequency regions of a spectrogram of the mixed acoustic signal to obtain one or more acoustic properties from respective regions;

providing at least one pitch estimate for at least one of the multiple acoustic signals as a function of combining the acoustic properties from multiple regions; and recovering at least one of the multiple acoustic signals as a function of the at least one pitch estimate, the recovering including demodulating individual signal contents using the at least one pitch estimate to recover information corresponding to and individual acoustic signal.

2. The method of claim 1 wherein the one or more acoustic properties include pitch candidates.

3. The method of claim 1 further including identifying at least one pitch for each localized time-frequency region of the spectrogram.

4. The method of claim 1 further including demodulating using a series-based sinusoidal demodulation.

5. The method of claim 4 further including demodulating using one or more sets of individual sinusoidal functions.

6. The method of claim 4 further including demodulating using one or more sets of sinusoidal series.

7. The method of claim 1 further including combining the recovered information of the localized regions and reconstructing the at least one of the multiple signals as a function of the combined information.

8. The method of claim 1 further including estimating model parameters for representing at least one of the multiple signals and recovering the at least one of the multiple signals as a function of the estimated model parameters.

9. The method of claim 1 wherein the multiple signals include at least one of unvoiced signals, periodic signals, non-periodic signals, and quasi-periodic signals.

10. The method of claim 1 wherein the multiple signals include two or more voiced signals.

11. The method of claim 1 wherein the multiple signals include one or more unvoiced signal and a noise signal.

12. The method of claim 1 wherein the multiple signals include one or more voiced signal and at least one noise signal.

13. The method of claim 1 wherein the multiple signals include one or more voiced signal and at least one unvoiced signal.

14. The method of claim 13 further including recovering at least one voiced signal and one unvoiced signal as a function of the at least one pitch estimate.

15. The method of claim 13 further including detecting voiced, unvoiced, or silent time-frequency regions and providing the at least one pitch estimate in an event a voiced time-frequency region is detected.

16. The method of claim 1 wherein the multiple time-frequency regions include predetermined sizes.

17. The method of claim 1 wherein the multiple time-frequency regions include variable sizes.

18. The method of claim 1 wherein the one or more acoustic properties include an impulse train representation.

19. An apparatus for processing a mixed acoustic signal comprised of multiple acoustic signals, the apparatus comprising:

a localizer that localizes multiple time-frequency regions of a spectrogram of the mixed acoustic signal to obtain one or more acoustic properties from respective regions;

a pitch estimate provider that provides at least one pitch estimate for each of the multiple acoustic signals as a function of combining the acoustic properties from respective regions; and a signal recoverer that recovers at least one of the multiple acoustic signals as a function of the at least one pitch estimate, the signal recoverer including a demodulator that demodulates individual signal contents using the at least one pitch estimate to recover information corresponding to an individual acoustic signal.

20. The apparatus of claim 19 wherein the one or more acoustic properties include pitch candidates.

21. The apparatus of claim 19 further including a pitch identifier that identifies at least one pitch for each localized time-frequency region of the spectrogram.

22. The apparatus of claim 19 wherein the demodulator is a series-based sinusoidal demodulator.

23. The apparatus of claim 22 wherein the demodulator employs one or more sets of individual sinusoidal functions.

24. The apparatus of claim 22 wherein the demodulator employs one or more sets of sinusoidal series.

25. The apparatus of claim 19 further including a combiner that combines the recovered information of the localized regions and reconstructs the at least one of the multiple signals as a function of the combined information.

26. The apparatus of claim 19 wherein the signal recoverer recovers the at least one of the multiple signals as a function of estimated model parameters that represent the at least one of the multiple signals.

27. The apparatus of claim 19 wherein the multiple signals include at least one of unvoiced signals, periodic signals, non-periodic signals, and quasi-periodic signals.

28. The apparatus of claim 19 wherein the multiple signals include two or more voiced signals.

29. The apparatus of claim 19 wherein the multiple signals include one or more unvoiced signal and a noise signal.

30. The apparatus of claim 19 wherein the multiple signals include one or more voiced signal and at least one noise signal.

31. The apparatus of claim 19 wherein the multiple signals include one or more voiced signal and at least one unvoiced signal.

32. The apparatus of claim 31 wherein the recoverer recovers at least one voiced signal and one unvoiced signal as a function of the at least one pitch estimate.

33. The apparatus of claim 31 further including a voicing state detector that detects voiced, unvoiced, or silent time-frequency regions and wherein the pitch estimate provider provides the at least one pitch estimate in an event a voiced time-frequency region is detected.

34. The apparatus of claim 19 wherein the multiple time-frequency regions include variable sizes.

35. The apparatus of claim 19 wherein the one or more acoustic properties include an impulse train representation.

36. A method for processing a mixed acoustic signal comprised of multiple acoustic signals, the method comprising:

localizing multiple time-frequency regions of a spectrogram of the mixed acoustic signal to obtain one or more acoustic properties from respective regions; and recovering at least one of the multiple acoustic signals as a function of at least one pitch estimate provided as a function of combining the acoustic properties from multiple regions, the recovering including demodulating individual signal contents using the at least one pitch estimate to recover information corresponding to an individual acoustic signal.

* * * * *